US005162195A

United States Patent [19]

Inagaki

[11] Patent Number: 5,162,195

[45] Date of Patent: Nov. 10, 1992

[54] METHOD FOR FORMING COLOR IMAGE

[75] Inventor: Yoshio Inagaki, Kanagawa, Japan

[73] Assignee: Fuji Photo Film Co., Ltd., Kanagawa, Japan

[21] Appl. No.: 479,920

[22] Filed: Feb. 14, 1990

[30] Foreign Application Priority Data

Feb. 14, 1989 [JP] Japan ..... 1-34761

[51] Int. Cl.[5] ..... G03C 7/407; G03C 7/00

[52] U.S. Cl. ..... 430/377; 430/363; 430/489; 430/505; 430/506; 430/508; 430/522; 430/944

[58] Field of Search ..... 430/363, 505, 944, 377, 430/506, 508, 489, 522

[56] References Cited

U.S. PATENT DOCUMENTS

| | | | |
|---|---|---|---|
| 4,536,473 | 8/1985 | Mihara | 430/944 |
| 4,619,892 | 10/1986 | Simpson et al. | 430/508 |
| 4,839,265 | 6/1989 | Ohno et al. | 430/522 |
| 4,874,684 | 10/1989 | Yamamoto | 430/944 |
| 4,904,561 | 2/1990 | Yamamoto | 430/944 |
| 5,004,675 | 4/1991 | Yoneyama et al. | 430/377 |

FOREIGN PATENT DOCUMENTS

| | | |
|---|---|---|
| 0080896 | 6/1983 | European Pat. Off. . |
| 0123983 | 11/1984 | European Pat. Off. . |
| 0256858 | 2/1988 | European Pat. Off. . |
| 0288076 | 10/1988 | European Pat. Off. . |

OTHER PUBLICATIONS

The Theory of the Photographic Process, T. H. James, Fourth Edition, pp. 417–418.

European Search Report 90 10 2806, May 3, 1991.

Japanese Patent Abstract, vol. 11, No. 340, Nov. 7, 1987.

Japanese Patent Abstract, vol. 12, No. 95, Mar. 29, 1988.

Japanese Patent Abstract, vol. 10, No. 157, Jun. 6, 1986.

Japanese Patent Abstract, vol. 5, No. 185.

Japanese Patent Abstract, vol. 10, No. 271, Sep. 16, 1986.

Japanese Patent Abstract, vol. 12, No. 354, Sep. 22, 1988.

*Primary Examiner*—Charles L. Bowers, Jr.

*Assistant Examiner*—Thorl Chea

*Attorney, Agent, or Firm*—Sughrue, Mion, Zinn, Macpeak & Seas

[57] ABSTRACT

A method for processing a silver halide color photosensitive material is disclosed: (i) subjecting a full-color photographic material to scanning exposure to three lights each having different wavelength; (ii) processing said exposed full-color photographic material with a color developer containing at least one aromatic primary amine color developing agent and containing chloride ion in amount of from $3.5\times10^{-2}$ to $1.5\times10^{-1}$ mole/liter and bromide ion in an amount from $3.5\times10^{-2}$ to $1.5\times10^{-1}$ mole/liter.

The full-color photographic material contains at least three silver halide light-sensitive layers each containing yellow-coloring, magenta-coloring or cyan coloring-couplers; at least two of the layers are so color-sensitized that may have a maximum value of the color sensitivity at a different wavelength of 670 nm or more; at least one of the layers contains high silver chloride emulsions having silver chloride content 90 mole % or more; and at least one dye of formula (A):

(A)

where $R^1$ to $R^6$, $Z^1$, $Z^2$, L, X and n are defined as disclosed in the specification.

6 Claims, No Drawings

METHOD FOR FORMING COLOR IMAGE

FIELD OF THE INVENTION

The present invention relates to a method for rapidly forming a full-color image by scanning exposure of a full-color photographic material followed by color development thereof.

BACKGROUND OF THE INVENTION

Known is an image-forming method for obtaining a color image by subjecting a photographic material (which has on a support at least three silver halide light-sensitive layers each containing a silver halide emulsion which is color-sensitized so that it may be selectively sensitive to any of three lights emitted from a semiconductor laser or a light-emitting diode and each containing a color image-forming color coupler), to scanning exposure of three different lights each having a different wavelength and then processing the exposed material for color development to form a color image on the material. Also known are the photographic materials which are employed for the method. For instance, the method and materials are illustrated in detail in JP-A-55-13505, JP-A-61-137149, JP A-62-295648 and JP-A-63-197947 (the term "JP-A" as used herein means an "unexamined published Japanese patent application") and in Reports in 4th International Conference (SPSE) of Non-Impact Printing (NIP), pages 245 to 247.

However, if a good full-color image is to be obtained by the method illustrated in the above-mentioned publications or literature, a relatively long development procedure is required. Therefore, the known method is inconvenient for rapidly and continuously forming a full-color image of high quality by employing a high-speed scanning exposure system. One reason is probably the high silver bromide content in the photographic emulsion of the photographic material, which requires a long period of time for the respective development, bleaching and fixation steps. In order to overcome the problem, an emulsion having a high silver chloride content might be recommended. Another reason is that a long time is required to decolor the dye which has been added for the purpose of absorbing a light of a particular wavelength to prevent color mixing in the photographic material or for the purpose of absorbing the unnecessary scattering or reflecting light in the hydrophilic colloid layer in the photographic material. Although images could be formed in the absence of such dye, such an image has poorer image characteristics, such as a lowered dissolving power. Accordingly, addition of the dye is essential to obtain images of high quality. Therefore, it is desired to employ such as a dye that may easily be decomposed during development to be decolored to that may easily be dissolved out of the photographic material after photographic processing.

It is required that the photographic dye have not only the above-mentioned easy decolorability but also a sufficient stability during storage without having a bad effect on the silver halide grains to reduce the photographic property of the photographic material. It has heretofore been difficult to obtain photographic dyes which satisfy all these requirements. In addition, this technical field has lately required further acceleration of the speed of photographic processing, and accordingly, finding appropriate dyes which satisfy this need is increasingly difficult.

Even though there is a dye which can resolve the above problems, it is expected based on the finding of a conventional photographic image formation using a surface exposure (not a scanning exposure) that remarkable decrease in sensitivity derived from light absorption inevitably occurs by addition of the dye, while the preferred effects increase.

On the other hand, it is know that where the processing conditions are made more severe by varying the temperature, the pH value and the composition of the photographic solution for the purpose of accelerating the photographic processing speed, the photographic property of the processed photographic material frequently worsens. In particular, where a high silver chloride emulsion having a silver chloride content of 90 mol% or more is employed, it is found that the processed photographic material is often fogged to have so-called high-density streaks induced by pressure applicaton. It may be presumed that such streaks are caused by the contact of the photographic material being processed with the roller or the like in the developer tank in an automatic developing machine whereupon the contacted portion of the photographic material is scratched and is over-sensitized under pressure.

SUMMARY OF THE INVENTION

An object of the present invention is to provide a method for forming a full-color image by scanning exposure followed by high-speed processing, without the problems of desilvering insufficinecy, residual color or high density streaks. A further object of this invention is a color processing method for rapidly processing a recording material (photographic material) containing a high silver chloride emulsion without any harmful results of high density streaks and the like and a photographic dye which may fully be decolored and free of remarkable decrease in sensitivity under high-speed processing conditions.

In accordance with the present invention, the above objects are attained by a method for forming a color image wherein a full-color photographic material which has at least three silver halide light-sensitive layers (each layer containing yellow-coloring, magenta-coloring or cyan-coloring couplers, at least two of the layers being color-sensitized so that they have a maximum value of the color sensitivity at a different wavelength of 670 nm or higher, and at least one of the layers is made of a high silver chloride emulsion having a layer average silver chloride content of 90 mol% or more) and which has a hydrophilic colloid layer containing at least one dye of the following general formula (A) is subjected to scanning exposure by three lights each having a different wavelength and then processed with a color developer containing (1) at least one aromatic primary amine color developing agent, (2) a chloride ion in an amount ranging from $3.5\times10^{-2}$ to $1.5\times10^{-1}$ mol/liter, and (3) a bromide ion in an amount ranging from $3.0\times10^{-5}$ to $1.0\times10^{-3}$ mol/liter.

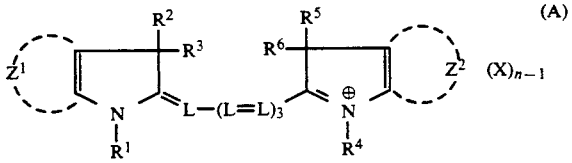

(A)

where $R^1$, $R^2$, $R^3$, $R^4$, $R^5$ and $R^6$ may be the same or different and each represents a substituted or unsubstituted alkyl group; $Z^1$ and $Z^2$ each represents a non-metallic atomic group necessary for forming a substituted or unsubstituted benzo-condensed ring or naphtho-condensed ring; provided that $R^1$, $R^2$, $R^3$, $R^4$, $R^5$, $R^6$, $Z^1$ and $Z^2$ are such that the dye molecule may have at least three acid groups; L represents a substituted or unsubstituted methine group; X represents an anion; and n represents 1 or 2; provided that when the dye is in the form of an internal salt, n is 1.

DETAILED DESCRIPTION OF THE INVENTION

The constitutional elements of the present invention will be explained in detail in the following order: (1) silver halide emulsions, (2) dyes, (3) processing methods, (4) light sources and (5) couplers and other elements.

(1) Silver Halide Emulsions:

It is necessary that the halogen composition of the silver halide emulsions of the present invention comprises a substantially silver iodide-free silver chlorobromide having a silver chloride content of 90 mol% or more. The "substantially silver iodide-free silver chlorobromide" as referred to herein means that the silver iodide content in the emulsion is 1.0 mol% or less, preferably 0.2 mol% or less. If the silver chloride content in the emulsion is less than the above-mentioned range or if the silver iodide content therein is above the limit, the development speed is so low that the emulsion could not be used in high-speed development. Accordingly, the silver chloride content is preferably higher. Specifically, it is 90 mol% or more. In order to reduce the amount of the replenisher to be added to the development-processing solution during processing of the photographic material of the present invention, further elevation of the silver chloride content in the silver halide emulsion is also preferred. In that case, an almost pure silver chloride emulsion having a silver chloride content of from 98 mol% to 99.9 mol% can be employed. However, a completely pure silver chloride emulsion is often inconvenient for the purpose of preventing the fog resulting from the elevation of the sensitivity of the photographic material or the application of pressure to the material.

The "layer average silver chloride content" in the present invention means an average silver chloride content of a silver halide emulsion in the same layer. In a case where two or more emulsions each having a different halogen composition, it is an average thereof.

In the present invention, at least one layer made of high silver chloride emulsion having a layer average silver chloride content of 90 mol% or more is provided. In order to further accomplish the object of the present invention effectively, it is preferred that three layers each having different sensitivity have a layer average silver chloride content of 90 mol% or more.

In the silver halide grains of the present invention, the material other than silver chloride mostly comprises silver bromide. The silver bromide may be uniformly in the inside of the silver halide grains, that is, one grain is made of a so-called uniform solid solution of silver chlorobromide. Alternatively, it may be in the grain in the form of a different phase having a different silver bromide content. In the latter case, the grain may be either a so-called laminate grain where the core and one or more shells surrounding the core have different halogen compositions or a composite grain where a localized phase having a different silver bromide content, preferably having a higher silver bromide content, is discontinuously formed on the surface and/or in the inside of the grain. The localized phase having a higher silver bromide content may be in the inside of the grain, on the surface of the grain and/or on the edge or corner of the grain. One preferred embodiment is one in which the localized phase is on the corner of the grain by epitaxial junction.

The mean grain size of the grains in the silver halide emulsion of the present invention, (which is defined as the mean value of the diameter of the corresponding sphere having the same volume as the respective grain), is preferably from 2 microns to 0.1 micron, especially preferably from 1.4 microns to 0.15 micron.

The grain size distribution in the silver halide emulsion of the present invention is preferably narrow, and the emulsion is more preferably in the form of a monodispersed emulsion. In particular, it is especially preferred to be in the form of a monodispersed emulsion containing regular-shaped grains. Specifically, an emulsion where 85% or more, preferably 90% or more, by number or by weight of the total grains each has a grain size falling within the range of the mean grain size plus/minus 20% is advantageously employed in the present invention.

The above-mentioned grains which are preferably employed in the present invention are desirably prepared by a double jet method.

When the grains are physically ripened in the presence of a known silver halide solvent (for example, ammonia, potassium thiocyanate, or thioethers and thione compounds as described in U.S. Pat. No. 3,271,157, and JP-A-51-12360, JP-A-53-82408, JP-A-53-144319, JP-A-54-100717 and JP-A-54-155828), a monodispersed silver halide emulsion having a narrow grain size distribution and containing grains each having a regular crystalline form can prefearbly be obtained.

The silver halide emulsion for use in the present invention can be chemically sensitized by sulfur-sensitization, selenium-sensitization, reduction-sensitization and/or noble metal-sensitization. In other words, a sulfur-sensitization method using a sulfur-containing compound capable of reacting on an active gelatin or silver ion (for example, thiosulfates, thiourea compounds, mercapto compounds, rhodanine compounds), a reduction-sensitization method using a reducing substance (for example, stannous salts, amines, hydrazine derivatives, formamidine-sulfinic acids, silane compounds), or a noble metal sensitization method using a noble metal compound (for example, gold complexes, complexes of metals of the Group VIII of the Periodic Table such as Pt, Ir, Pd or Fe) can be employed, either singly or in combination. A complex of a metal of the Group VIII of the Periodic Table such as Ir, Rh or Fe is preferably incorporated into the base and the localized phase of the grain, either separately or distributively. The monodispersed silver chlorobromide emulsion which is preferably employed in the present invention is especially advantageously subjected to sulfur-sensitization or selenium-sensitization preferably in the presence of a hydroxyazaindene compound.

In the present invention, employment of color-sensitizing dyes is important. Color-sensitizing dye which are employed in the present invention include cyanine dyes, merocyanine dyes and complex merocyanine dyes. In addition, complex cyanine dyes, holopolar cyanine dyes, hemicyanine dyes, styryl dyes and hemioxonole dyes may also be employed. As cyanine dyes, simple cyanine dyes, carbocyanine dyes, dicarbocyanine dyes, tricarbocyanine dyes and tetracarbocyanine dyes are employed.

In particular, those dyes selected from the sensitizing dyes represented by any of the formulae (I), (II) and (III) mentioned below are employed for red-sensitization or infrared-sensitization. These sensitizing dyes are relatively chemically stable and are additionally characterized by the fact that they can relatively strongly adsorb to the surfaces of silver halide grains and are desorbed hard by the action of the dispersion of the co-exisiting couplers or the like.

It is preferred that the silver halide photographic material to be processed by the method of the present invention has at least three silver halide light-sensitive layers and that at least two of the layers are color sensitized by at least one sensitizing dye to be selected from the group consisting of the compounds of the formulae (I), (II) and (III) selectively to the wavelength range from 660 to 690 nm, from 740 to 790 nm, from 800 to 850 nm or from 850 to 900 nm.

The "color-sensitization selective to the wavelength range from 660 to 690 nm, from 740 to 790 nm, from 800 to 850 nm or from 850 to 900 nm" as referred to herein means (1) that the principal wavelength of one light source is within any of the above-mentioned wavelength ranges, (2) that the principal light-sensitive layer is color-sensitized in accordance with the principal wavelength of the light source, and (3) that the sensitivity of other light-sensitive layer to the principal wavelength is color-sensitized practically lower by at least 0.8 (as a logarithmic expression) than the sensitivity of the principal light-sensitive layer to the principal wavelength of the light source. Accordingly, it is desired that the principal sensitivity wavelength of the respective light-sensitive layer is defined to be remote from the principal wavelength of the light source to be employed by at least 40 nm, individually. The sensitizing dyes to be employed for the purpose are those which give a high sensitivity to the principal wavelength and give a sharp spectral sensitivity distribution.

Specifically, the dyes employable in the present invention for the above-mentioned purpose are those represented by the following formulae (I), (II) and (III):

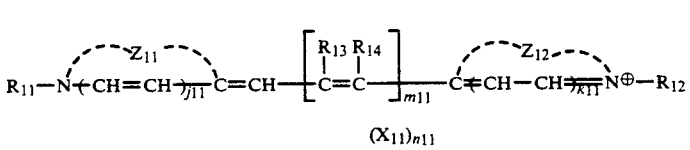

(I)

In the formula (I), $Z_{11}$ and $Z_{12}$ each represents an atomic group necessary for forming a heterocyclic ring.

The heterocyclic nucleus is preferably a 5-membered or 6-membered cyclic nucleus containing nitrogen atom(s) and optionally other sulfur atom(s), oxygen atom(s), selenium atom(s) and/or tellurium atom(s) as hetero atom(s), which may be fused with any other ring(s) to form a fused ring or may be substituted by any substituent(s).

Specific examples of such heterocyclic nuclei include thiazole nucleus, benzothiazole nucleus, naphthothiazole nucleus, selenazole nucleus, benzoselenazole nucleus, naphthoselenazole nucleus, oxazole nucleus, benzoxazole nucleus, naphthoxazole nucleus, imidazole nucleus, benzimidazole nucleus, naphthoimidazole nucleus, 4-quinoline nucleus, pyrroline nucleus, pyridine nucleus, tetrazole nucleus, indolenine nucleus, benzindolenine nucleus, indole nucleus, tetrazole nucleus, benzotellurazole nucleus and naphthotellurazole nucleus.

$R_{11}$ and $R_{12}$ each represents an alkyl group, an alkenyl group, an alkynyl group or an aralkyl group each having 1 to 18 carbon atoms. These groups and the groups mentioned below include substituted derivatives thereof. For instance, the alkyl group includes an unsubstituted alkyl group and a substituted alkyl group, which may be linear, branched or cyclic. The alkyl group preferably has from 1 to 8 carbon atoms.

Examples of the substituents for the substituted alkyl group include a halogen atom (e.g., chlorine, bromide, fluorine), a cyano group, an alkoxy group, a substituted or unsubstituted amino group, a carboxylic acid group, a sulfonic acid group and a hydroxyl group. The substituted alkyl group may be one substituted by one or more of the substituents.

One example of the alkenyl group is a vinylmethyl group.

Examples of the aralkyl group include a benzyl group and a phenethyl group.

$m_{11}$ represents a positive integer of 2 or 3.

$R_{13}$ represents a hydrogen atom, and $R_{14}$ represents a hydrogen atom, a lower $C_{1-8}$ alkyl group or a $C_{7-14}$ aralkyl group; or they may be bonded to $R_{12}$ individually to form a 5-membered or 6-membered ring. When $R_{14}$ represents a hydrogen atom, $R_{13}$ may be bonded to other $R_{13}$ to form a hydrocarbon ring or a hetero ring. Such a ring is preferably 5-membered or 6-membered. $j_{11}$ and $k_{11}$ each represents 0 or 1; $X_{11}$ represents an acid anion, and $n_{11}$ represents 0 or 1.

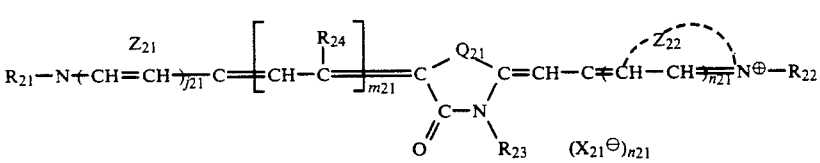

(II)

In the formula (II), $Z_{21}$ and $Z_{22}$ have the same meanings as those of the above-mentioned $Z_{11}$ and $Z_{12}$, respectively. $R_{21}$ and $R_{22}$ have the same meanings as those of the above-mentioned $R_{11}$ and $R_{12}$, respectively. $R_{23}$ represents a $C_{1-8}$ alkyl group, a $C_{2-10}$ alkenyl group, a $C_{2-10}$ alkynyl group or a $C_{6-12}$ aryl group (for example, a substituted or unsubstituted phenyl group). The $R_{23}$ group may optionally be substituted or unsubstituted.

$m_{21}$ represents 2 or 3. $R_{24}$ represents a hydrogen atom, a lower $C_{1-8}$ alkyl group or a $C_{6-12}$ aryl group. When $m_{21}$ represents 2, two $R_{24}$'s may be bonded to each other to form a hydrocarbon ring or a heterocyclic ring, which is preferably 5-membered or 6-membered.

$Q_{21}$ represents a sulfur atom, an oxygen atom, a selenium atom or $>N—R_{25}$, where $R_{25}$ has the same meaning as $R_{23}$. $j_{21}$, $R_{21}$, $X_{21}^{\ominus}$ and $n_{21}$ have the same meanings as those of $j_{11}$, $k_{11}^{\ominus}$ and $n_{11}$, respectively.

(III)

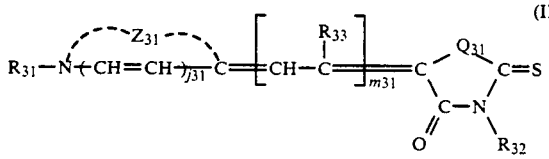

In the formula (III), $Z_{31}$ represents an atomic group necessary for forming a hetero ring. The ring has the same meaning as that mentioned for $Z_{11}$ and $Z_{12}$. Examples of the ring include thiazolidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline and naphthoimidazoline nuclei. $Q_{31}$ has the same meaning as $Q_{21}$. $R_{31}$ has the same meaning as $R_{11}$ or $R_{12}$; and $R_{32}$ has the same meaning as $R_{23}$. $m_{31}$ represents 2 or 3. $R_{33}$ has the same meaning as $R_{24}$, and a plurality of $R_{33}$ groups may be bonded to each other to form a hydrocarbon ring or a hetero ring. $j_{31}$ has the same meaning as $j_{11}$.

Preferred are the sensitizing dyes of the formula (I) where $Z_{11}$ and/or $Z_{12}$ forms a naphthothiazole nucleus, naphthoselenazole nucleus, naphthoxazole nucleus, naphthoimidazole nucleus or 4-quinoline nucleus.

The same applies to $Z_{21}$ and/or $Z_{22}$ in the formula (II) and to $Z_{31}$ in the formula (III). Especially preferred are sensitizing dyes where the methine chain forms a hydrocarbon ring or hetero ring.

For infrared-sensitization, M-band sensitization of the sensitizing dye is employed, and therefore the spectral sensitivity distribution is generally broader than that of J-band sensitization. Accordingly, a dye-containing color layer is provided as the colloid layer in the side nearer to the light-sensitive surface than the determined light-sensitive layer thereby to correct the spectral sensitivity distribution.

As the red-sensitizing or infrared-sensitizing dyes, compounds having a reduction potential of −1.00 (V vs SCE) or a value lower than the same are preferred. In particular, compounds having a reduction potential of −1 08 or a value lower than the same are preferred. The sensitizing dyes having such characteristic are advantageous for elevating the sensitivity of the photographic material, especially for stabilizing the sensitivity as well as stabilizing the latent image to be formed in the material.

Measurement of the reduction potential may be effected by phase-differentiating secondary higher harmonics alternating current polarography, where a dropping mercury electrode is used as the working electrode, a saturated calomel electrode as the reference electrode, and a platinum electrode as the counter electrode.

Measurement of the reduction potential by phase-differentiating secondary higher harmonics alternating voltammetry where a platinum electrode is used as the working electrode is described in *Journal of Imaging Science*, Vol. 30, pages 27 to 35 (1986).

Specific non-limiting examples of the sensitizing dyes of the formulae (I), (II) and (III) are mentioned below.

(I-1)

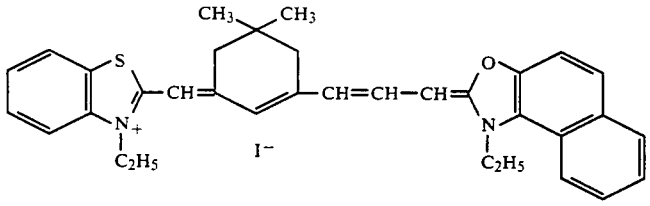

(I-2)

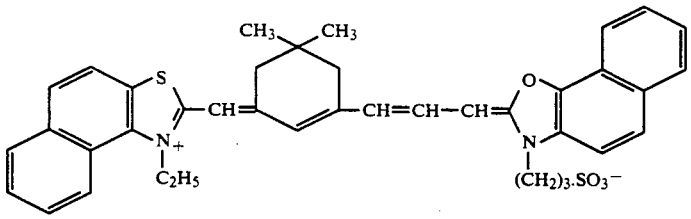

(I-3)

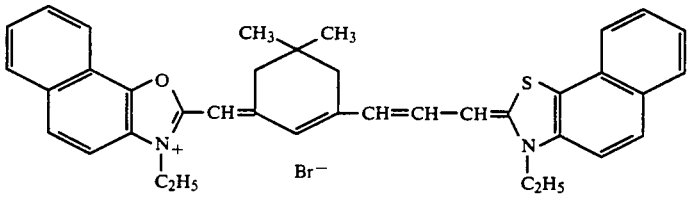

-continued
(I-4)
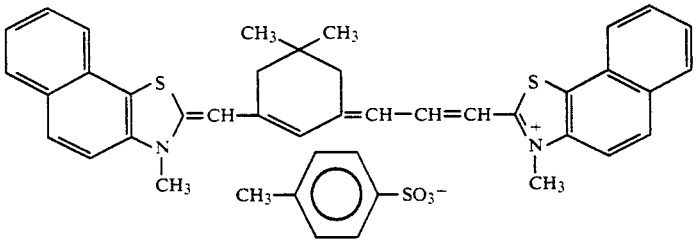
(I-5)
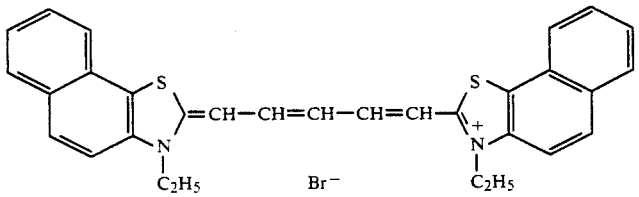
(I-6)
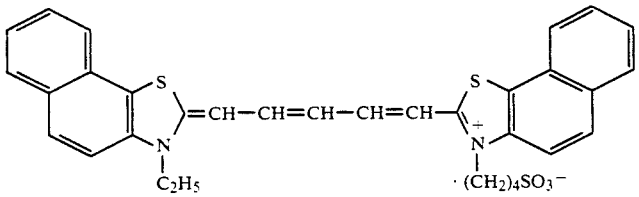
(I-7)
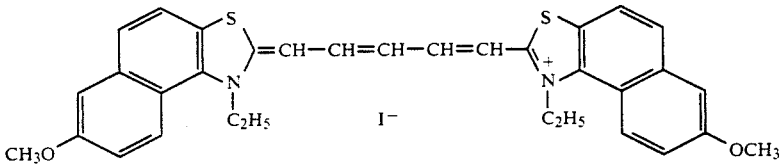
(I-8)
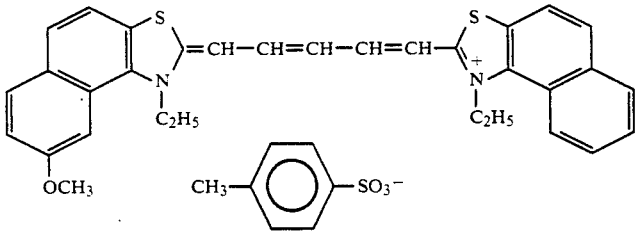
(I-9)
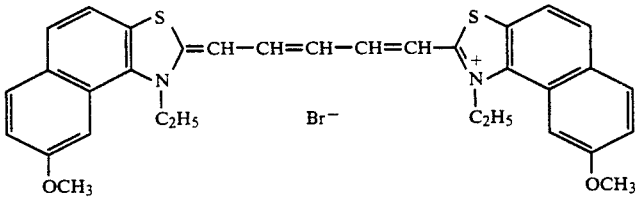
(I-10)
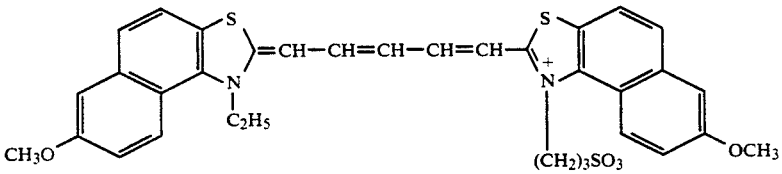

-continued
(I-11)
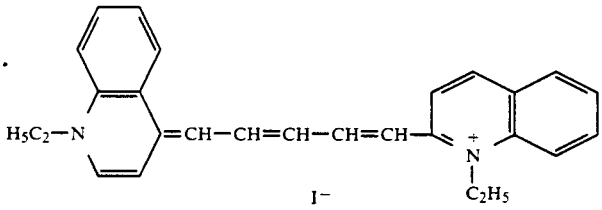
(I-12)
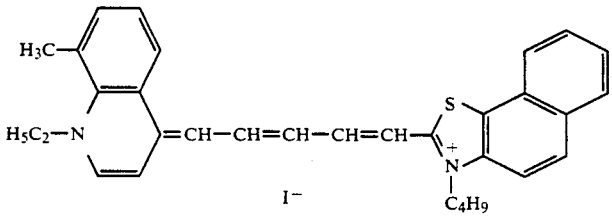
(I-13)
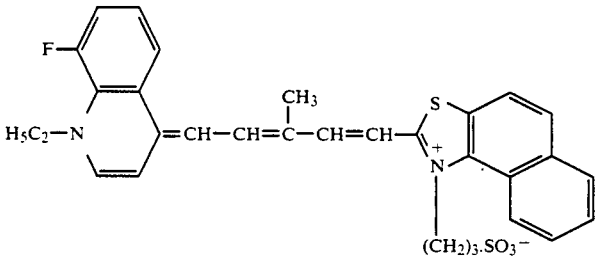
(I-14)
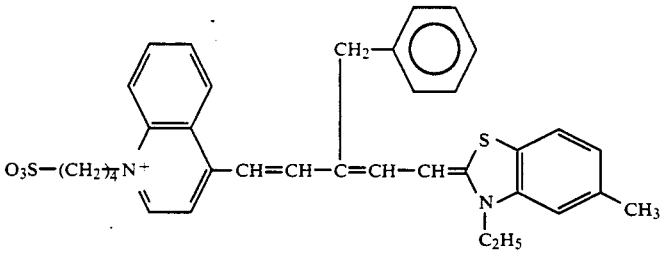
(I-15)
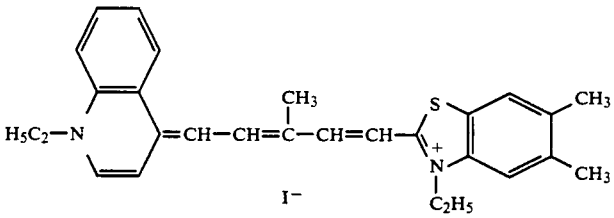
(I-16)
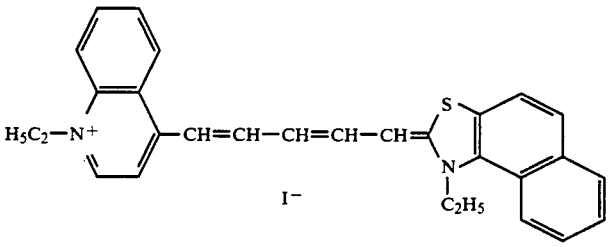

-continued
(I-17)
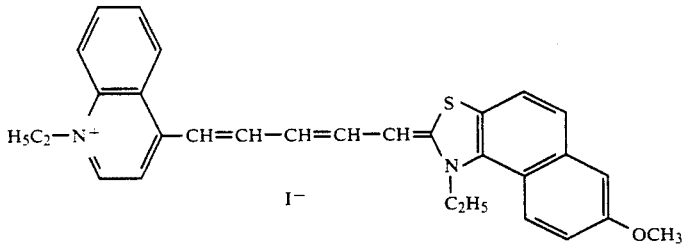
(I-18)
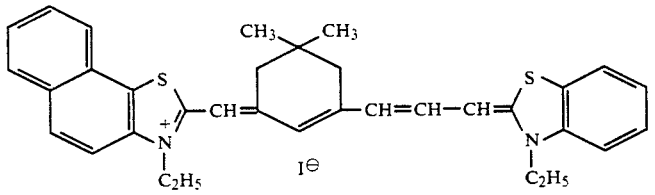
(I-19)
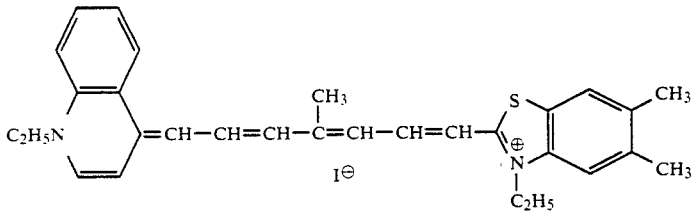
(II-1)
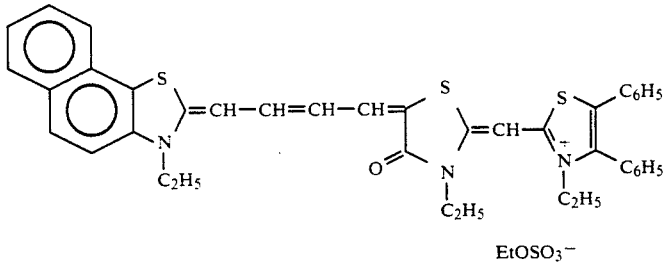
(II-2)
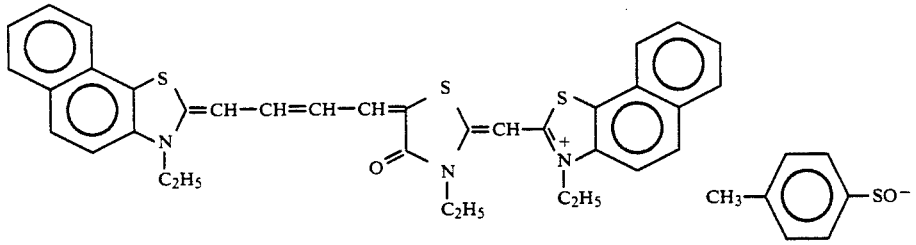
(II-3)
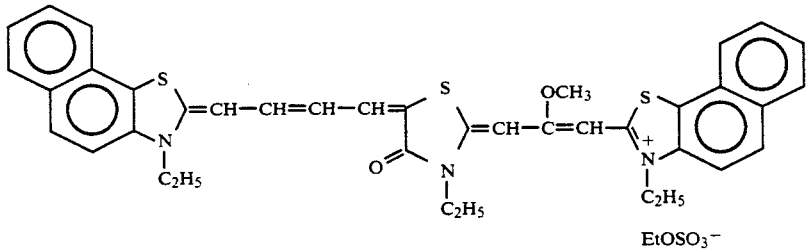

-continued
(II-4)
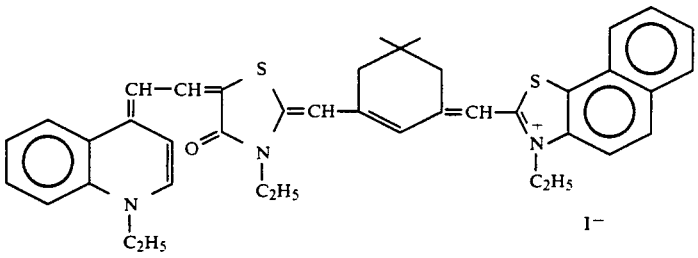
(II-5)
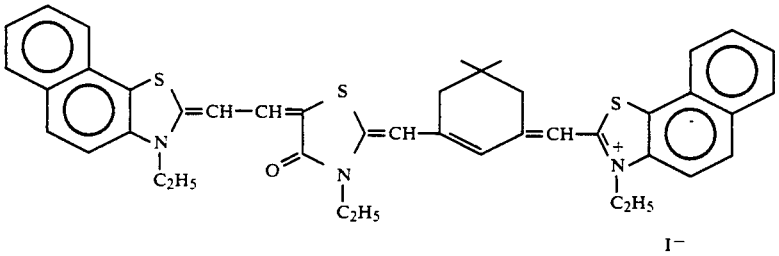
(II-6)
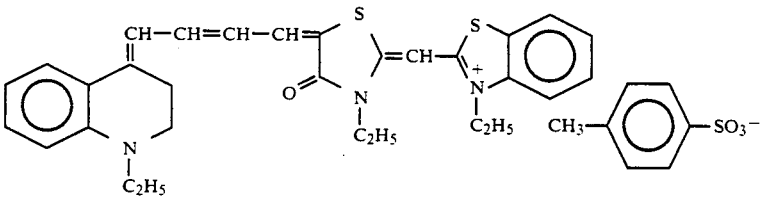
(III-1)
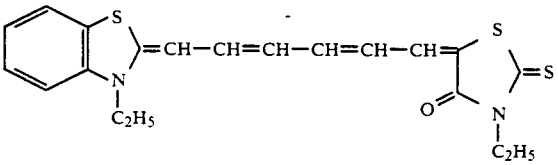
(III-2)
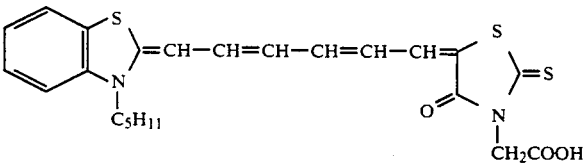
(III-3)
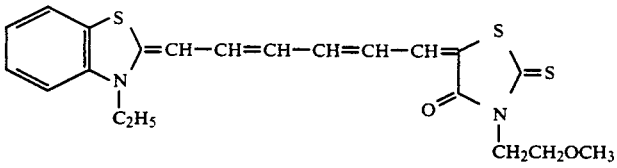
(III-4)
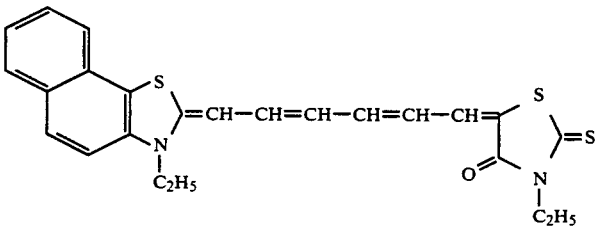
The sensitizing dyes represented by formulae (I), (II) and (III) can be synthesized according to *Cyanine Dyes and Related Compounds* (John Wiley & Sons, New York, London, 1964) or *Research Disclosure* No. 307105 (November, 1989).
In accordance with the present invention, the sensitizing dye mentioned above is incorporated into the silver halide photographic emulsion in an amount of from $5\times10^{-7}$ mol to $5\times10^{-3}$ mol, preferably from $1\times10^{-6}$ mol to $1\times10^{-3}$ mol, especially preferably from $2\times10^{-6}$ mol to $5\times10^{-4}$ mol, per mol of the silver halide in the emulsion.

The sensitizing dye may directly be dispersed in the emulsion. Alternatively, it may first be dissolved in an appropriate solvent, for example, methyl alcohol, ethyl alcohol, methyl cellosolve, acetone, water, pyridine or a mixed solvent thereof, and thereafter the resulting solution may be added to the emulsion. To dissolve the sensitizing dye, ultrasonic waves may be employed. To add the infrared-sensitizing dye to the photographic emulsion of the present invention, various methods may be employed, which include, for example, a method of dissolving the dye in a volatile organic solvent, dispersing the resulting solution into a hydrophilic colloid and adding the resulting dispersion into the emulsion, as described in U.S. Pat. No. 3,469,987; a method of dispersing the water-insoluble dye in a water-soluble solvent, without dissolving the dye, and thereafter adding the resulting dispersion into the emulsion, as described in JP-B-46-24185 (the term "JP B" as used herein means an "examined Japanese patent publication"); a method of dissolving the dye in a surfactant and then adding the resulting solution to the emulsion, as described in U.S. Pat. No. 3,822,135; a method of dissolving the dye in a red-shifting compound and adding the resulting solution to the emulsion, as described in JP-A-51-74624; and a method of dissolving the dye in a substantially water-free acid and adding the resulting solution to the emulsion, as described in JP-A-50-80826. In addition, the other methods described in U.S. Pat. Nos. 2,912,343, 3,342,605, 2,996,287 and 3,429,835 may also be employed for adding the dye to the emulsion. The above-mentioned infrared-sensitizing dye may be uniformly dispersed in the silver halide emulsion just before the emulsion is coated on the support. Alternatively, it may also be added to the emulsion before the emulsion is chemically sensitized or in the latter stage of formation of the silver halide grains.

For red-sensitization of infrared-sensitization of the photographic material of the present invention, super-color sensitization with the compound represented by the following formula (IV), (V), (VI), (VII), (VIIIa), (VIIIb) or (VIIIc) is especially helpful for the M-band sensitization.

The super-color sensitizing agent of the formula (IV) may specifically display an enlarged super-color sensitizing effect when it is combined with the super-color sensitizing agent of the formula (V), (VIIIa), (VIIIb) or (VIIIc).

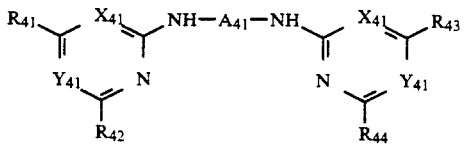

(IV)

In the formula (IV), A41 represents a divalent aromatic residue having 6 to 32 carbon atoms. $R_{41}$, $R_{42}$, $R_{43}$ and $R_{44}$ each represents a hydrogen atom, a hydroxyl group, a $C_{1-8}$ alkyl group, a $C_{1-8}$ alkoxy group, a $C_{6-18}$ aryloxy group, a halogen atom, a heterocyclic group, a heterocyclic-thio group, a $C_{1-18}$ alkylthio group, a $C_{6-18}$ arylthio group, a $C_{0-18}$ amino group, a $C_{1-18}$ alkylamino group, a $C_{6-18}$ arylamino group, a $C_{7-18}$ aralkylamino group, a $C_{6-18}$ aryl group or a mercapto group, Which may optionally be substituted.

At least one of $A_{41}$, $R_{41}$, $R_{42}$, $R_{43}$ and $R_{44}$ has a sulfo group. $X_{41}$ and $Y_{41}$ each represents —CH= or —N=, and at least one of $X_{41}$ and $Y_{41}$ is —N=.

More precisely, in the formula (IV), —$A_{41}$— represents a divalent aromatic residue which may contain —$SO_3M$ group where M represents a hydrogen atom or a water-solubilizing cation, such as sodium or potassium.

—$A_{41}$— is preferably selected from the following —$A_{42}$— or $A_{43}$—, provided that when $R_{41}$, $R_{42}$, $R_{43}$ or $R_{44}$ does not contain —$SO_3M$ group, —$A_{41}$— is selected from the group of —$A_{42}$—.

—$A_{42}$—:

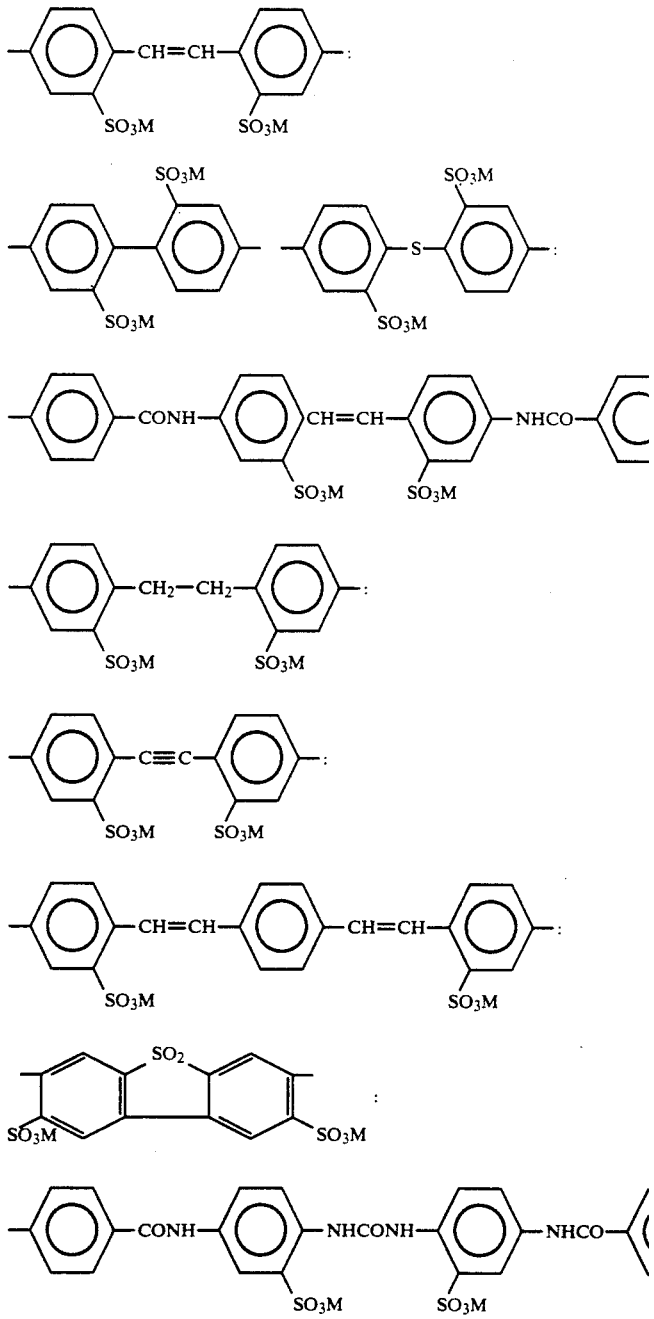

In the above, M is a hydrogen atom or a water-solubilizing cation.

—$A_{43}$—:

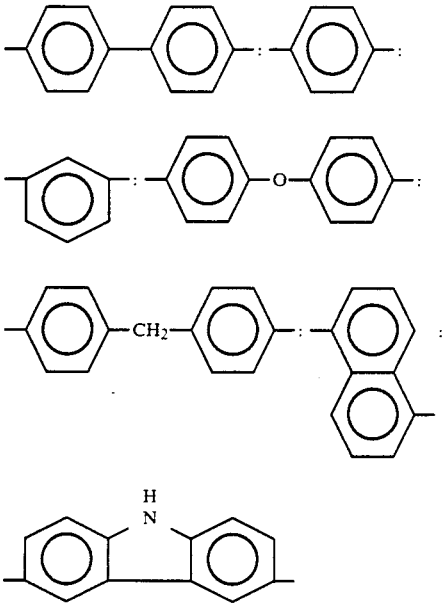

$R_{41}$, $R_{42}$, $R_{43}$ and $R_{44}$ each represents a hydrogen atom, a hydroxyl group, an alkyl group (preferably having from 1 to 8 carbon atoms, e.g., methyl, ethyl, n-propyl, n-butyl), an alkoxy group (preferably having from 1 to 8 carbon atoms, e.g., methoxy, ethoxy, propoxy, butoxy), an aryloxy group (e.g., phenoxy, naphthoxy, o-tolyloxy, p-sulfophenoxy), a halogen atom (e.g., chlorine, bromine), a heterocyclic group (e.g., morpholinyl, piperidyl), an alkylthio group (e.g., methylthio, ethylthio), a heterocyclic-thio group (e.g., benzothiazolylthio, benzimidazolylthio, phenyltetrazolylthio), an arylthio group (e.g., phenylthio, tolylthio), an amino group, an alkylamino group or a substituted alkylamino group (e.g., methylamino, ethylamino, propylamino, dimethylamino, diethylamino, dodecylamino, cyclohexylamino, β-hydroxyethylamino, di(β-hydroxyethyl)amino, β-sulfoethylamino), an arylamino group or a substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoainilino, o-anisidino, m-anisidino, p-anisidino, o-acetaminoanilino, hydroxyanilino, disulfophenylamino, naphthylamino, sulfonaphthylamino), a heterocyclic-amino group (e.g., 2-benzothioazolylamino, 2-pyridylamino), a substituted or unsubstituted aralkylamino group (e.g., benzylamino, o-anisylamino, m-anisylamino, p-anisylamino), an aryl group (e.g., phenyl), or a mercapto group.

$R_{41}$, $R_{42}$, $R_{43}$ and $R_{44}$ may be the same or different. Where —$A_{41}$— is selected from the group of —$A_{43}$—, it is necessary that at least one of $R_{41}$, $R_{42}$, $R_{43}$ and $R_{44}$ has one or more sulfo groups (which may be in the form of either a free acid group of a salt). $X_{41}$ and $Y_{42}$ each represents —CH= or —N=. Preferably, $X_{41}$ is —CH= and $Y_{41}$ is —N=.

Specific non limiting examples of the compounds of the formula (IV) which are preferably employed in the present invention are mentioned below:

(IV-1): Disodium 4,4'-Bis[2,6-di(2-naphthoxy)pyrimidin-4-ylamino]stilbene-2,2'-disulfonate (IV-2): Disodium 4,4'-Bis[2,6-di(2-naphthylamino)-pyrimidin-4-ylamino]stilbene-2,2'-disulfonate (IV-3): Disodium 4,4'-Bis[2,6-dianilinopyrimidin-4-ylamino]stilbene-2,2'-disulfonate (IV-4): Disodium 4,4'-Bis[2-(2-naphthylamino) 6-anilinopyrimidin-4-ylamino]stilbene-2,2'-disulfonate (IV-5): Triethylammonium 4,4'-Bis[2,6-dianilinopyrimidin-4-ylamino]stilbene-2,2'-disulfonate (IV-6): Disodium 4,4'-Bis[2,6-di(benzimidazolyl-2-thio)-pyrimidin-4-ylamino]stilbene-2,2'-disulfonate (IV-7): Disodium 4,4'-Bis[4,6-di(benzothiazolyl-2-thio)-pyrimidin-2-ylamino]stilbene 2,2'-disulfonate (IV-8): Disodium 4,4'-Bis[4,6-di(benzothiazolyl-2-amino)pyrimidin-2-ylamino]stilbene-2,2'-disulfonate (IV-9): Disodium 4,4,-Bis[4,6-di(naphtyl-2-oxy)pyrimidin-2-ylamino]stilbene-2,2'-disulfonate (IV-10): Disodium 4,4'-Bis[4.6-diphenoxypyrimidin-2-ylamino]stilbene-2,2'-disulfonate (IV-11): Disodium 4,4'-Bis[4,6-diphenylthiopyrimidin-2-ylamino]stilbene-2,2'-disulfonate (IV-12): Disodium 4,4'-Bis[4,6-dimethylmercaptopyrimidin-2-ylamino]biphenyl-2,2'-disulfonate (IV 13): Disodium 4,4'-Bis[4,6-dianilino-triazin-2ylamino]stilbene-2,2'-disulfonate (IV-14): Disodium 4,4'-Bis[anilino-6-hydroxytriazin-2-ylamino]stilbene-2,2'-disulfonate (IV-15): Disodium 4,4'-Bis[4,6-di(naphtyl-2-oxy)pyrimidin-2-ylamino]bibenzyl-2,2'-disulfonate (IV-16): Disodium 4,4'-Bis[4,6-dianilinopyrimidin-2-ylamino]stilbene-2,2'-disulfonate (IV-17): Disodium 4,4'Bis[4-chloro-6-(2-naphthyloxy)-pyrimidin-2-ylamino]biphenyl-2,2'-disulfonate (IV-18): Disodium 4,4'-Bis[4,6-di(1-phenyltetrazolyl-5-thio)pyrimidin-2-ylamino]stilbene-2,2'-disulfonate (IV-19): Disodium 4,4'-Bis[4,6-di(benzimidazolyl-2-thio)pyrimidin-2-ylamino]stilbene-2,2'disulfonate (IV-20): Disodium 4,4'-Bis[4-naphthylamino-6-anilino-triazin-2-ylamino]stilbene-2,2'-disulfonate Among the said examples, (IV-1) to (IV-6) are preferred, and (VI-1), (IV-2), (IV-4), (IV-5), (IV-9), (IV-15) and (IV-20) are especially preferred.

The compound of the formula (IV) is employed in an amount of from 0.01 to 5 g per mol of the silver halide. Advantageously, the weight ratio of the compound of the formula (IV) to the sensitizing dye is from 1/1 to 1/100, preferably from ½ to 1/50. The compound of the formula (IV) is more preferably combined with the compound of the following formula (V).

The compounds of the formula (V) are mentioned below.

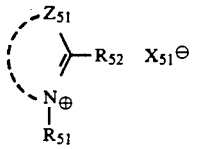

(V)

In the formula (V), $Z_{51}$ represents a non-metallic atomic group necessary for completing a 5-membered or 6-membered nitrogen-containing hetero ring, and the ring may be condensed with a benzene ring or a naphthalene ring. Such hetero rings include: thiazoliums (e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium), oxazoliums (e.g., oxazolium, 4-methyloxazolium, benzoxaxolium, 5-chlorobenzoxazolium, 5-phenylbenzoxazolium, 5-methylbenzoxazolium, naphtho[1,2 d]oxazolium), imidazoliums (e.g., 1-methylbenzimidazolium, 1-propyl-5-chlorobenzimidazolium, 1-ethyl-5,6-dichlorobenzimidazolium, 1-allyl-5-trifluoromethyl-6-chlorobenzimidazolium), and selenazoliums (e.g., benzoselenazolium, 5-chlorobenzoselenazolium, 5-methylbenzoselenazolium, 5-methoxybenzoselenazolium, naphtho[,1,2-d]selenazolium). $R_{51}$ represents a hydrogen atom, an alkyl group (preferably having 8 or less carbon atoms, e.g., methyl, ethyl, propyl, butyl, pentyl), or an alkenyl group having 2 to 10 carbon atoms (e.g., allyl). $R_{52}$ represents a hydrogen atom or a lower alkyl group having 1 to 8 carbon atoms (e.g., methyl, ethyl). $R_{51}$ and $R_{52}$ may also represent a substituted alkyl group, individually. $X_{51}$ represents an acid anion (e.g., $Cl^-$, $Br^-$, $I^-$, $ClO_4^-$). Thiazoliums are preferred for $Z_{51}$. More preferably, $Z_{51}$ forms a substituted or unsubstituted benzothiazolium or naphthothiazolium. The above-mentioned groups may be substituted.

Specific non-limiting examples of the compounds of the formula (V) are mentioned below.

(V-1)

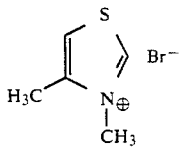

(V-2)

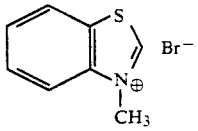

(V-3)

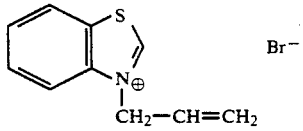

(V-4)

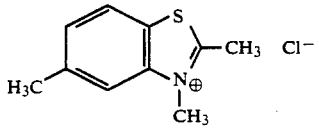

(V-5)

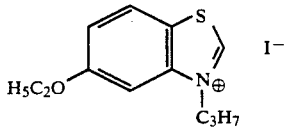

-continued (V-6)

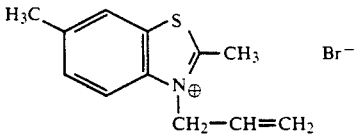

(V-7)

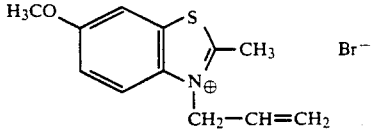

(V-8)

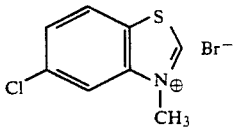

(V-9)

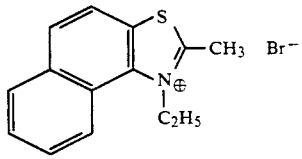

(V-10)

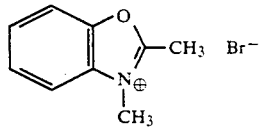

(V-11)

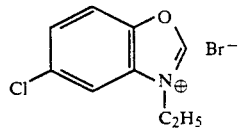

(V-12)

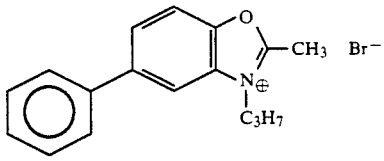

(V-13)

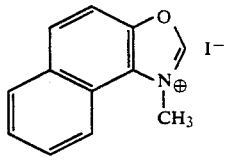

(V-14)

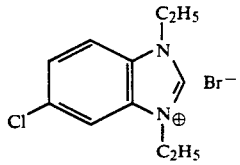

(V-15)

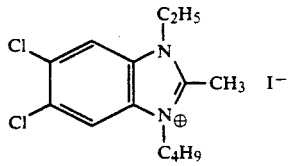

-continued (V-16)

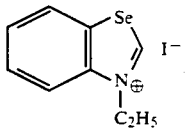

(V-17)

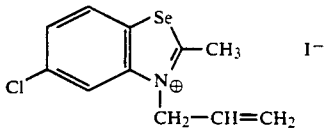

(V-18)

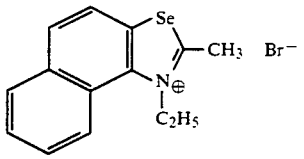

The amount of the compound of the formula (V) to be incorporated into the silver halide emulsion in accordance with the present invention is advantageously from about 0.01 g to about 5 g per mol of the silver halide in the emulsion.

The proportion of the infrared-sensitizing dye of the formulae (I) to (III) to the compound of the formula (V) is advantageously from 1/1 to 1/300, especially preferably from ½ to 1/50, by weight.

The compound of the formula (V) may be directly dispersed in the emulsion, or alternatively, it may be first dissolved in an appropriate solvent (e.g., water, methyl alcohol, ethyl alcohol, propanol, methyl cellosolve, acetone) or mixed solvent comprising two or more of those solvents, and then the resulting solution may be added to the emulsion. Additionally, it may also be added to the emulsion in the form of a solution of a colloid dispersion, in accordance with the method of adding the sensitizing dye to the emulsion.

The compound of the formula (V) may be added to the emulsion before of after the sensitizing dye of the formulae (I) to (III) is added to the emulsion. Alternatively, the compound of the formula (V) and the sensitizing dye of the formulae (I) to (III) are separately dissolved and the resulting two solutions may be added to the emulsion simultaneously or separately. If desired, the two solutions are previously blended and then added to the emulsion.

More, advantageously, the compound of the following formula (VI) is added to the combination of the infrared-sensitizing dye of the formulae (I) to (III) and the compound of the formula (V).

Where a heterocyclic mercapto compound is added to the infrared-sensitized high silver chloride emulsion of the present invention, along with the super-color sensitizing agent of the formula (IV) or (V), the sensitivity of the resulting emulsion is far elevated and the emulsion is prevented from fogging, and additionally, the latent image formed is stabilized and the development-dependency of the linear gradation of the image to be formed is extremely improved.

Such heterocyclic mercapto compounds employable for the purpose are mercapto-substituted compounds having a hetero ring of thiazole ring, oxazole ring, oxazine ring, thiazole ring, thiaozline ring, selenazole ring, imidazole ring, indoline ring, pyrrolidine ring, tetrazole ring, thiadiazole ring, quinoline ring or oxadiazole ring.

Preferably, the compounds are substituted by substituent(s) selected from a carboxyl group, a sulfo group, a carbamoyl group, a sulfamoyl group and a hydroxyl group. JP-B-43-22883 mentions a combination of a mercapto-heterocyclic compound and a super-color sensitizing agent. In accordance with the present invention, the above-mentioned heterocyclic mercapto compounds are employed in combination with the compound of the formula (V), whereby a noticeable fog-preventing effect and a super-color sensitizing effect can be attained. Above all, the mercapto compounds of the following formulae (VI) and (VII) are especially preferred.

(VI)

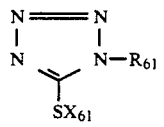

In the formula (VI), $R_{61}$ represents a $C_{1-8}$ alkyl group, a $C_{2-10}$ alkenyl group or a $C_{1-16}$ aryl group, $X_{61}$ represents a hydrogen atom, an alkali metal atom, an ammonium group or a precursor thereof. The alkali metal atom includes, for example, sodium atom and potassium atom. The ammonium group includes, for example, tetramethylammonium group and trimethylbenzylammonium group. The precursor means a group which may give a hydrogen atom or an alkali metal as $X_{61}$ under an alkaline condition, and it includes, for example, acetyl group, cyanoethyl group and methanesulfonylethyl group.

The alkyl and alkenyl groups for the above-mentioned $R_{61}$ may be substituted and may also be alicyclic. As examples of the substitutents for the substituted alkyl group, there are mentioned a halogen atom, a nitro group, a cyano group, a hydroxyl group, an alkoxy group, an aryl group, am acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic-thio group, as well as a carboxylic acid group and a sulfonic acid group and salts thereof.

The above-mentioned ureido group, thioureido group, sulfamoyl group, carbamoyl group and amino group may be unsubstituted, N-alkyl-substituted or N-aryl-substituted. Examples of the aryl group include a phenyl group and a substituted phenyl group. The substituents for the group include an alkyl group and the substituents mentioned for the aforesaid alkyl group.

(VII)

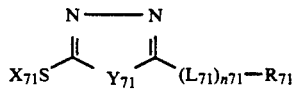

In the formula (VII), $Y_{71}$ represents an oxygen atom, a sulfur atom, =NH or =N—$(L_{71})n_{72}$-$R_{72}$; $L_{71}$ represents a divalent linking group; and $R_{71}$ and $R_{72}$ represent a hydrogen atom, an alkyl group, an alkenyl group or an aryl group. The alkyl group, alkenyl group or aryl group for $R_{71}$ or $R_{72}$ has the same meaning as $R_{61}$ and $X_{71}$ have the same meanings as $X_{61}$ in the formula (VI).

Specific examples of the divalent linking group of the above-mentioned $L_{71}$ include the following groups and combinations thereof.

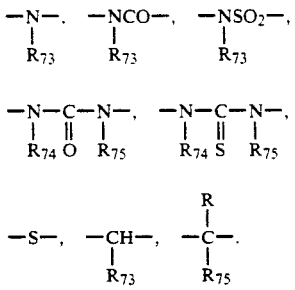

wherein $n_{71}$ and $n_{72}$ each represents 0 or 1; $R_{73}$, $R_{74}$ and $R_{75}$ each represents a hydrogen atom, a $C_{1-8}$ alkyl group or a $C_{7-16}$ aralkyl group.

The above-mentioned compounds can be added to any later of the silver halide photographic material of the present invention, for example, to any of the light-sensitive and non-light-sensitive hydrophilic colloid layers of the material.

The amount of the compound of the formula (VI) or (VII) to be added is preferably from $1\times10^{-5}$ to $5\times10^{-2}$ mol, more preferably from $1\times10^{-4}$ to $1\times10^{-2}$ mol, per mol of the silver halide where the compound is added to the silver halide color photographic material; or the compound may be added to the color developer to be employed for processing the photographic material as an antifoggant in an amount of from $1\times10^{-6}$ to $1\times10^{-3}$ mol/liter, preferably from $5\times10^{-6}$ to $5\times10^{-4}$ mol/liter.

Specific non-limiting examples of the compounds of the formulae (VI) and (VII) are mentioned below. In addition to these examples, the compounds mentioned in JP-A-62-269957, pages 4 to 8 may also be employed.

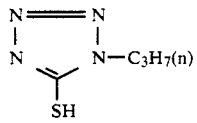

(VI-1)

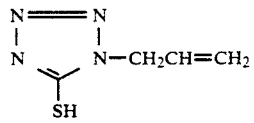

(VI-2)

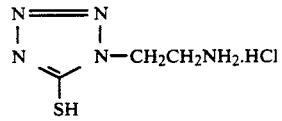

(VI-3)

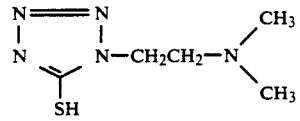

(VI-4)

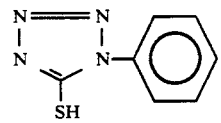

(VI-5)

-continued

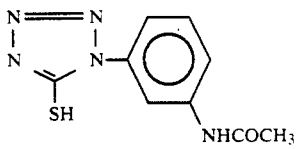

(VI-6)

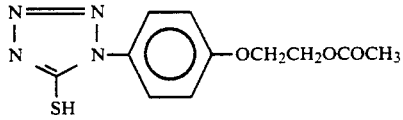

(VI-7)

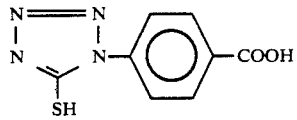

(VI-8)

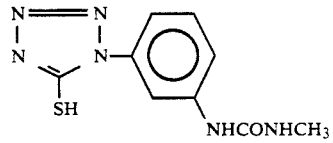

(VI-9)

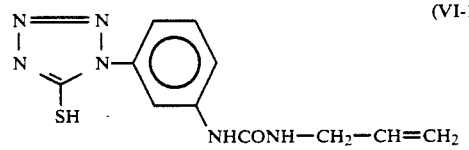

(VI-10)

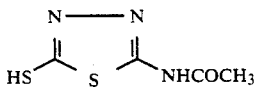

(VII-1)

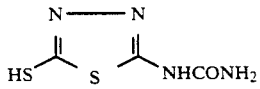

(VII-2)

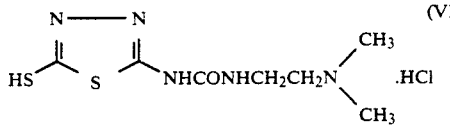

(VII-3)

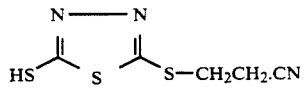

(VII-4)

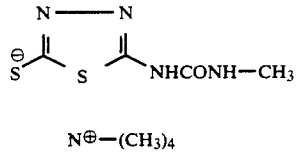

(VII-5)

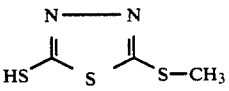

(VII-6)

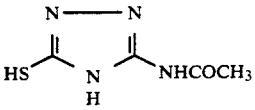

(VII-7)

-continued

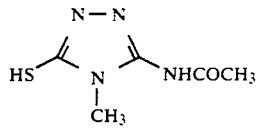
(VII-8)

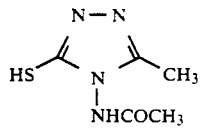
(VII-9)

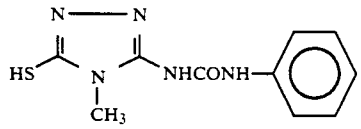
(VII-10)

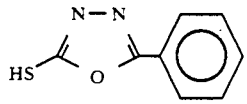
(VII-11)

For red-sensitization and infrared-sensitization of the photographic material of the present invention, a condensation product composed of from 2 to 10 condensation units comprising a substituted or unsubstituted polyhydroxybenzene of the following formulae (VIIIa), (VIIIb) and (VIIIc) and formaldehyde is appropriate as a super-color sensitizing agent. A condensation product of this kind is also effective for preventing the latent image from fading and the gradation thereof from lowering with the lapse of time.

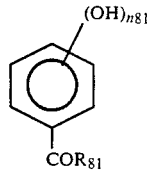
(VIIIa)

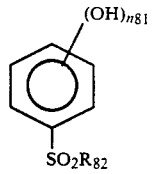
(VIIIb)

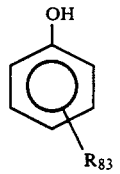
(VIIIc)

In the formulae, $R_{81}$ and $R_{82}$ each represents OH, $OM_{81}$, $OR_{84}$, $NH_2$, $NHR_{84}$, $—N(R_{84})_2$, $—NHNH_2$ or $—NHNHR_{84}$; $R_{84}$ represents an alkyl group having 1 to 8 carbon atoms, an aryl group having 6 to 18 carbon atoms or an aralkyl group having 7 to 18 carbon atoms; $M_{81}$ represents an alkali metal or an alkaline earth metal; $R_{83}$ represents OH or a halogen atom; and $n_{81}$ and $n_{82}$ each represents 1, 2 or 3.

The amount of the compounds represented by formulae (VIIIa), (VIIIb) and (VIIIc) to be added is 0.01 $g/m^2$ to 1.5 $g/m^2$.

Specific examples of the substituted or unsubstituted polyhydroxybenzenes which are employed as the condensing component for producing the aldehyde condensation products to be used in the present invention, will be mentioned below. These are not limiting.

(VIII-1) Beta-resorcylic Acid
(VIII-2) Gamma-resorcylic Acid
(VIII-3) 4-Hydroxybenzoic Acid Hydrazide
(VIII-4) 3,5-Hydroxybenzoic Acid Hydrazide
(VIII-5) P-Chlorophenol
(VIII-6) Sodium Hydroxybenzenesulfonate
(VIII-7) P-Hydroxybenzoic Acid
(VIII-8) O-Hydroxybenzoic Acid
(VIII-9) M-Hydroxybenzoic Acid
(VIII-10) P-Dioxybenzene
(VIII-11) Gallic Acid
(VIII 12) Methyl P-Hydroxybenzoate
(VIII-13) O-Hydroxybenzenesulfonic Acid Amide
(VIII-14) N-Ethyl-o-hydroxybenzoic Acid Amide

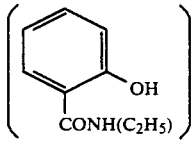

(VIII-15) N-Diethyl-o-hydroxybenzoic Acid Amide

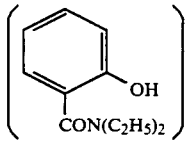

(VIII-16) O-Hydroxybenzoic Acid 2-Methylhydrazide

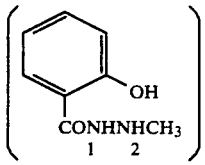

In addition, derivatives from the compounds of the formulae (IIa), (IIb) and (IIc) described in JP-B-49-49504 can also be employed.

(2) Dyes:

One characteristic feature of the constitution of the present invention is incorporation of the dye of the above-mentioned formula (A) into the hydrophilic colloid layer of the photographic material. By incorporation of the dye which is different from the above-mentioned color-sensitizing dyes, in accordance with the present invention, the light-sensitive characteristic of the material to near-infrared light and the image quality of the image to be formed on the material are extremely improved and the high-speed processability of the material, especially the decolorability thereof, when processed with a color developer having a chloride concentration of from $3.5\times10^{-2}$ to $1.5\times10^{-1}$ mol/liter and having a bromide concentration of from $3.0\times10^{-5}$ to $1.0\times10^{-3}$ mol/liter is noticeably improved.

In the formula (A), $R^1$, $R^2$, $R^3$, $R^4$, $R^5$ and $R^6$ may be the same or different and each represents a substituted or unsubstituted alkyl group, and $Z^1$ and $Z^2$ each represents a non-metallic atomic group necessary for forming a substituted or unsubstituted benzo-condensed or naphtho-condensed ring. At least three, mote preferably from four to six, of the groups of $R^1$, $R^2$, $R^3$, $R^4$, $R^5$ and $R^6$, $Z^1$ and $Z^2$ each has an acid substituent (for example, a sulfonic acid group or a carboxylic acid group), and more preferably, they are groups so that the dye molecule has from 4 to 6 sulfonic acid groups. The "sulfonic acid group" as referred to herein includes a sulfo group and salts thereof; and the "carboxylic group" includes a carboxyl group and salts thereof. Examples of the salts include alkali metal salts such as sodium and potassium, ammonium salt and organic ammonium salts of triethylamine, tributylamine and pyridine.

L represents a substituted or unsubstituted methine group, and X represents an anion. Examples of the anions for X include halogen ions (Cl, Br), p-toluenesulfonate ion and ethylsulfate ion.

n represents 1 or 2; and when the dye forms an internal salt, n is 1.

The alkyl group for $R^1$, $R^2$, $R^3$, $R^4$, $R^5$ and $R^6$ is preferably lower alkyl group having from 1 to 5 carbon atoms (e.g., methyl, ethyl, n-propyl, n-butyl, isopropyl, n-pentyl), which may optionally have substituent(s) (e.g., a sulfonic acid group, a carboxylic acid group, hydroxyl group). More preferably, $R^1$ and $R^4$ each represents a lower alkyl group having from 1 to 5 carbon atoms and having a sulfonic acid group (e.g., 2-sulfoethyl, 3-sulfopropyl, 4-sulfobutyl).

Preferred substituents for the benzo-condensed ring or naphtho-condensed ring to be formed by the non-metallic atomic group of $Z^1$ or $Z^2$ are a sulfonic acid group, a carboxylic acid group, a hydroxyl group, a halogen atom (e.g., F, Cl, Br), a cyano group, a substituted amino group (e.g., dimethylamino, diethylamino, ethyl-4-sulfobutylamino, di(3-sulfopropyl)amino), and a substituted or unsubstituted alkyl group having from 1 to 5 carbon atoms (e.g., methyl, ethyl, propyl or butyl), which alkyl group is bonded to the ring directly or via a divalent linking group. The substituents for the alkyl group are preferably a sulfonic acid group, a carboxylic acid group and a hydroxyl group; and the divalent linking group is, for example, preferably —O—, —NH—CO—, —$NHSO_2$—, —NHCOO—, —NHCONH—, —COO—, —CO— or —$SO_2$—.

Preferred substituents for the methine group of L include a substituted or unsubstituted lower alkyl group having from 1 to 5 carbon atoms (e.g., methyl, ethyl, 3-hydroxypropyl, benzyl, 2-sulfoethyl), a halogen atom (e.g., F, Cl, Br), a substituted or unsubstituted aryl group (e.g., phenyl, 4-chlorophenyl), a lower alkoxy group (e.g., methoxy, ethoxy). The substituents of the methine groups represented by L may be bonded to each other to form a 6-membered ring containing the three methine groups (for example, 4,4-dimethylcyclohexene ring).

The groups represented by L may combine to form a conjugated methine chain represented by formula (B), which is preferably used in the invention.

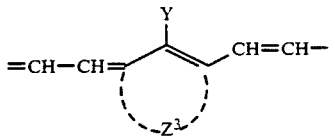

(B)

wherein $Z^3$ represents a non-metal atomic group (e.g., C, N, O) necessary for forming 5 or 6 membered ring and Y represents a hydrogen atom or a monovalent group.

Examples of 5 or 6 membered ring represented by $Z^3$ include, for example, cyclopentene ring, cyclohexene ring and 4,4-dimethylcyclohexene ring. In particular, the cyclohexane ring is preferred.

Examples of monovalent group represented by Y include, for example, a lower alkyl group (e.g., methyl), a substituted or unsubstituted aralkyl group (e.g., phenyl, benzyl), a lower alkoxy group (e.g., methoxy), a di-substituted amino group (e.g., dimethylamino, diphenylamino, methylphenylamino, morphorino, imidazolidino, ethoxycarbonylpiperadino), an alkylcarbonyloxy group (e.g., acetoxy), an alkylthio group (e.g., methylthio), a cyano group, a nitro group, and a halogen atom (e.g., F, Cl, Br). For the purpose of the present invention, Fe, Cl, or di-substituted amino group (e.g., morphorino, dialkylamino which has up to 6 carbon atoms and which may be cyclic) is preferred.

Specific non-limiting examples of the dye compounds of the formula (A) which are employed in the present invention are mentioned below:

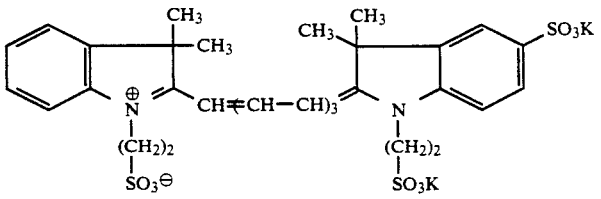

(A-1)

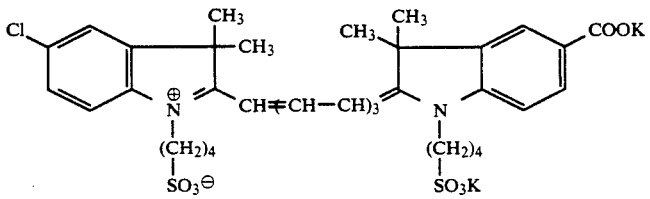

(A-2)

-continued
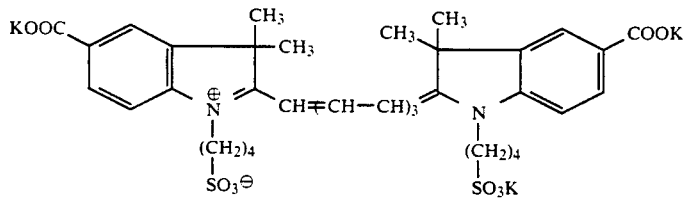
(A-3)
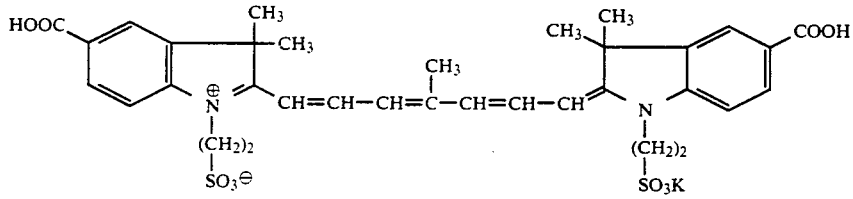
(A-4)
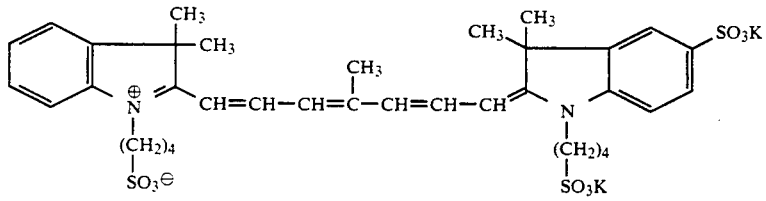
(A-5)
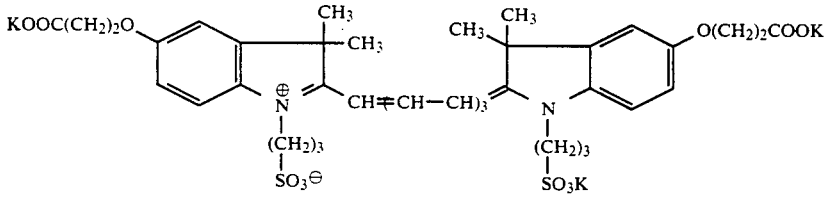
(A-6)
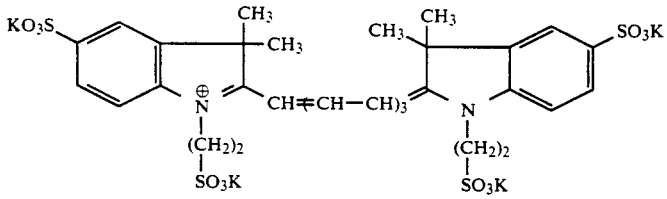
(A-7)
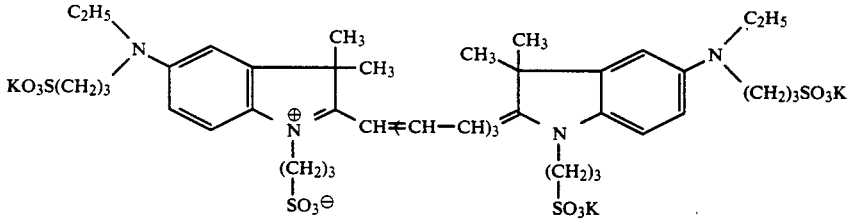
(A-8)
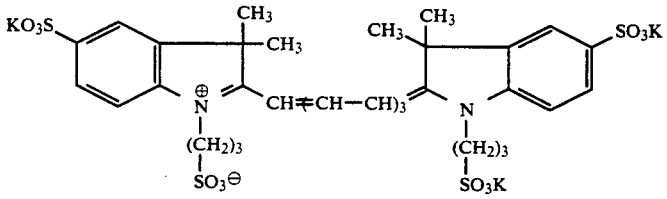
(A-9)

-continued
(A-10)
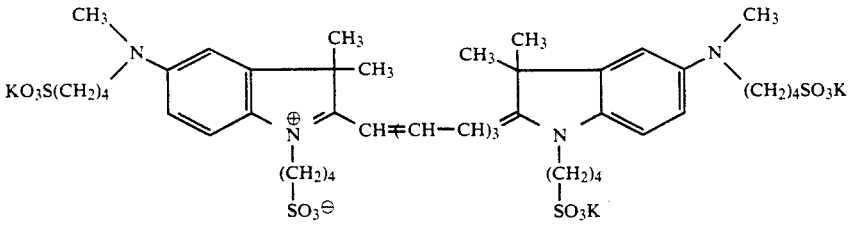
(A-11)
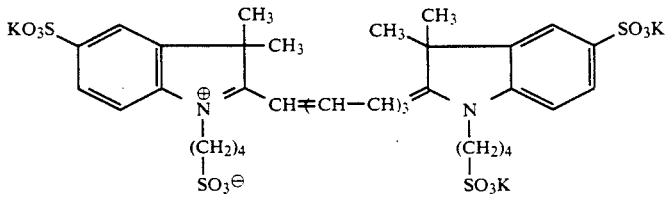
(A-12)
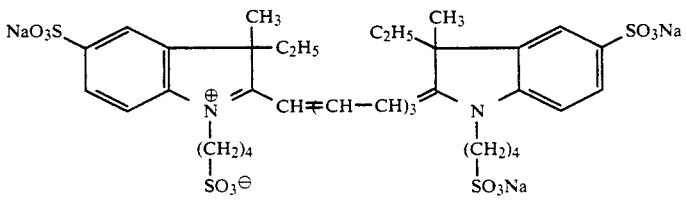
(A-13)
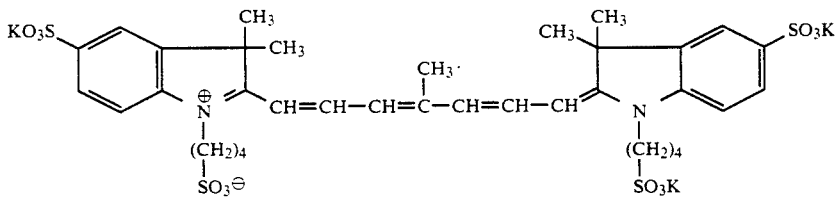
(A-14)
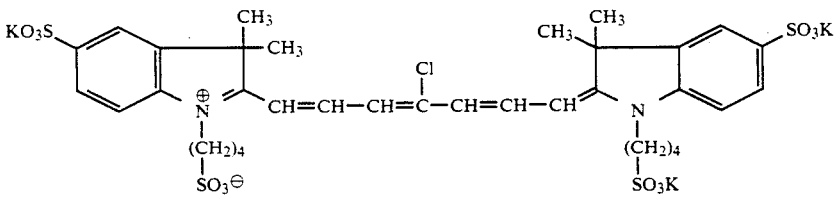
(A-15)
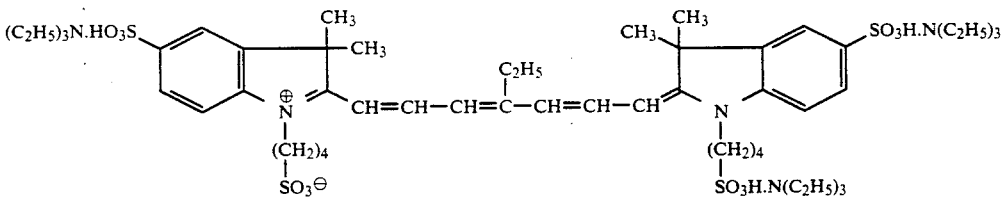
(A-19)
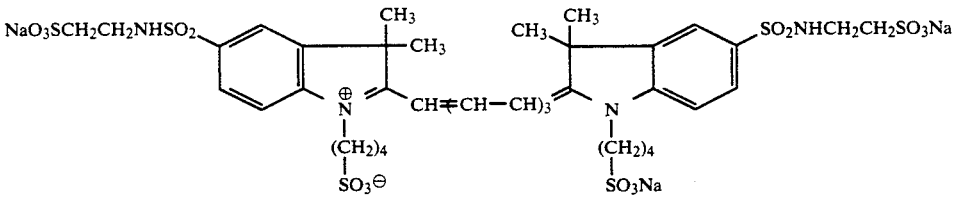
(A-20)
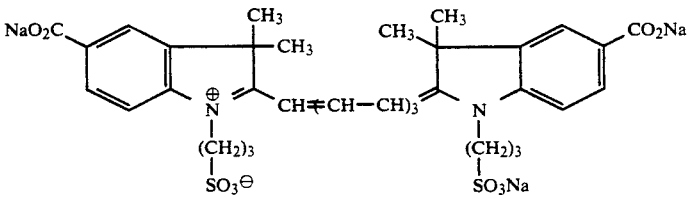

-continued
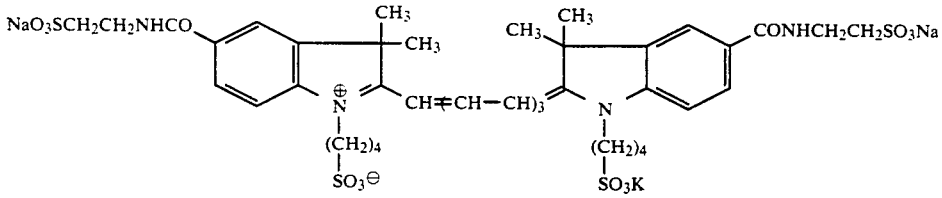
(A-21)
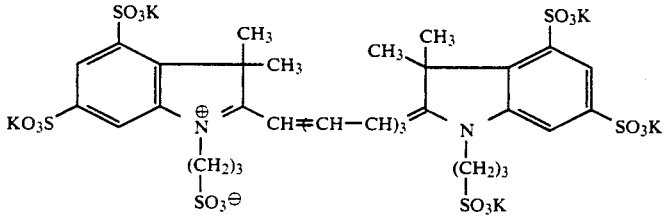
(A-16)
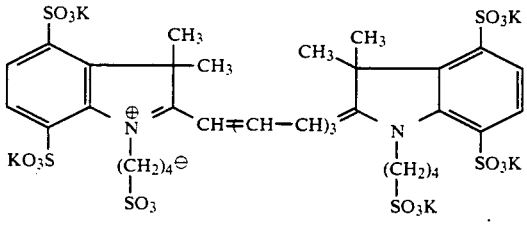
(A-17)
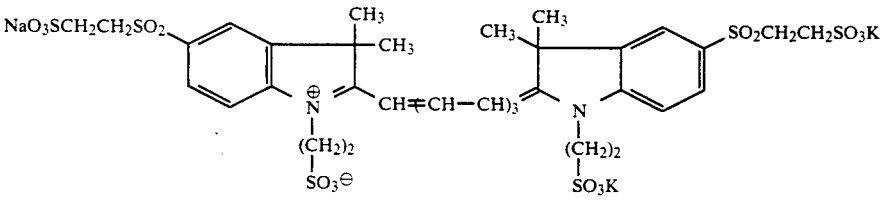
(A-18)
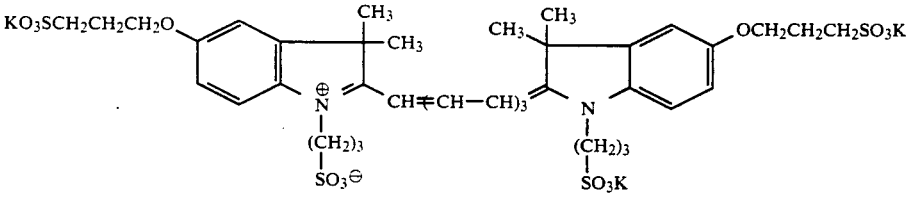
(A-22)
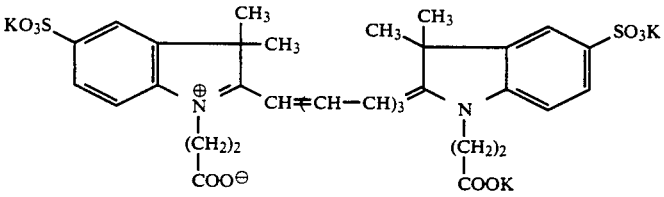
(A-23)
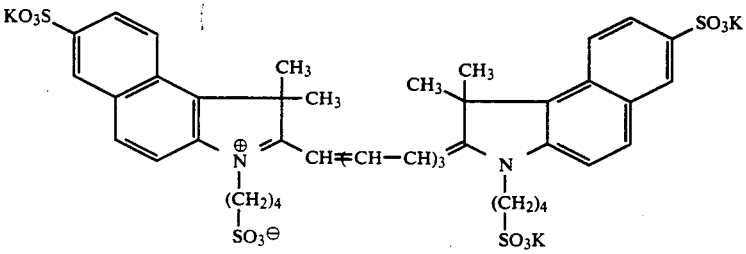
(A-24)

-continued
(A-25)
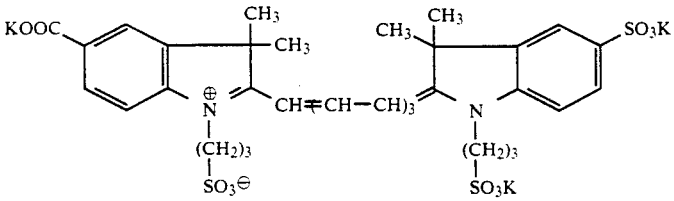
(A-26)
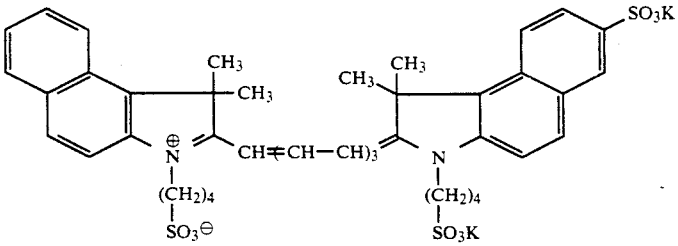
(A-27)
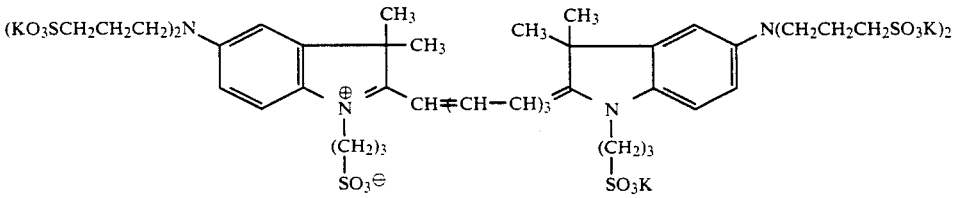
(A-28)
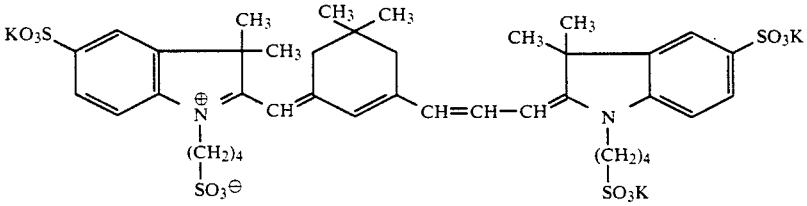
(A-29)
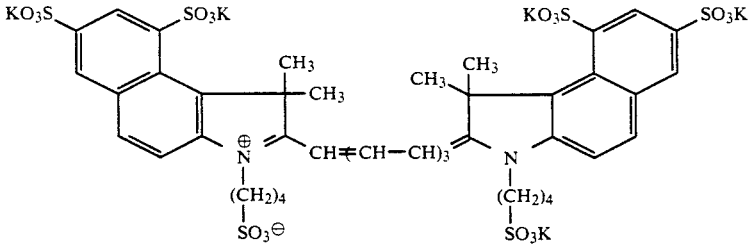
(A-30)
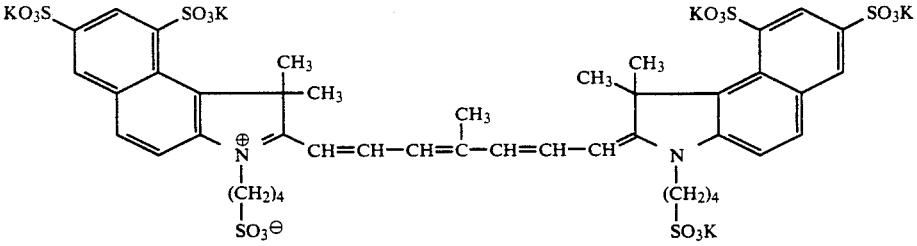
(A-31)
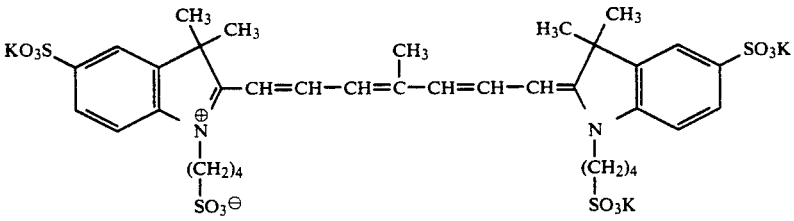

-continued
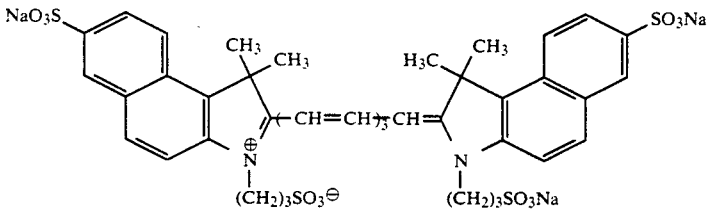
(A-32)
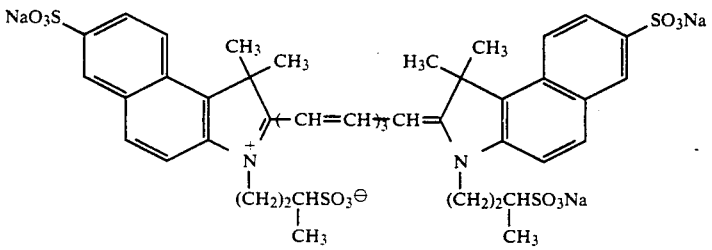
(A-33)
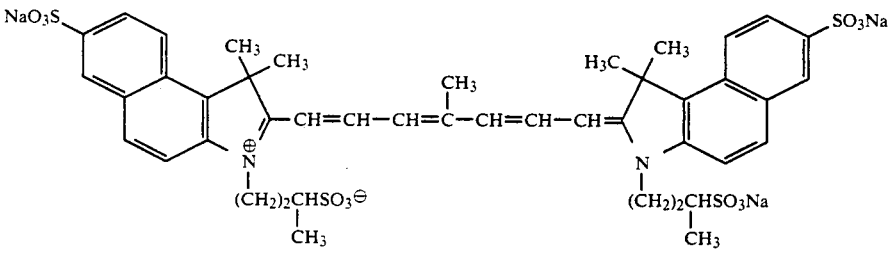
(A-34)
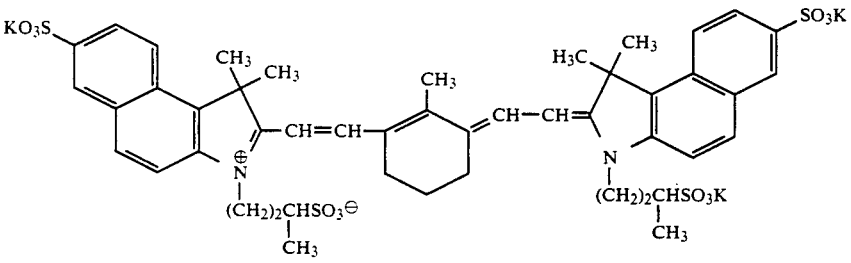
(A-35)
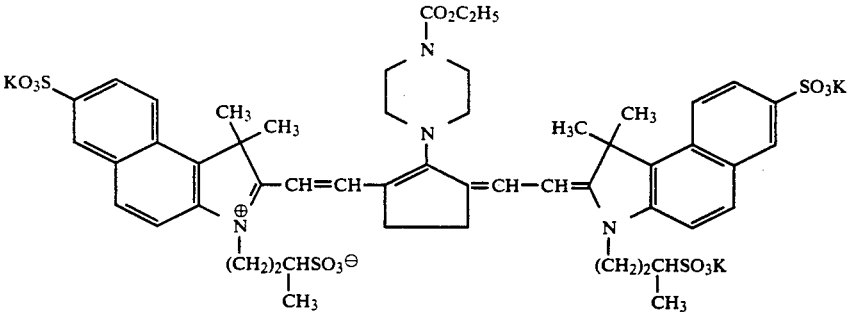
(A-36)
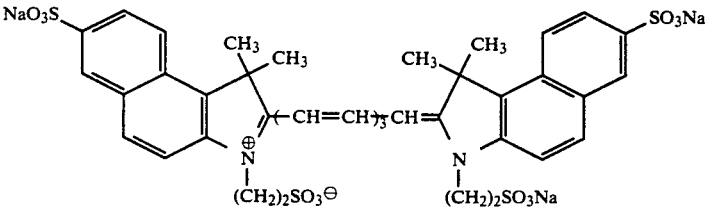
(A-37)

-continued (A-38)

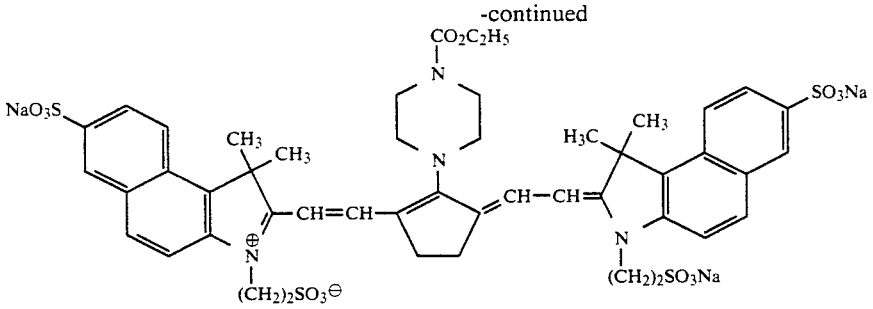

(A-39)

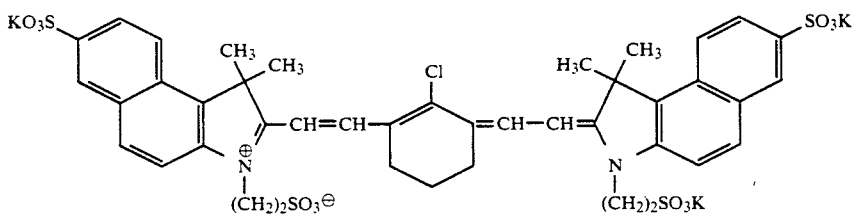

(A-40)

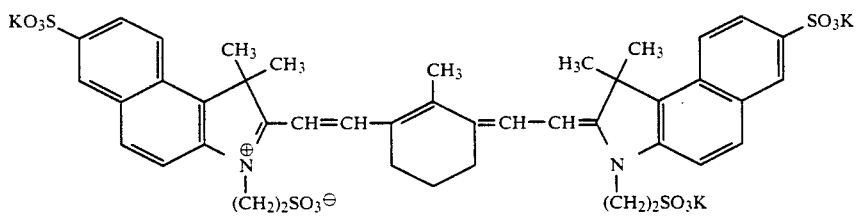

(A-41)

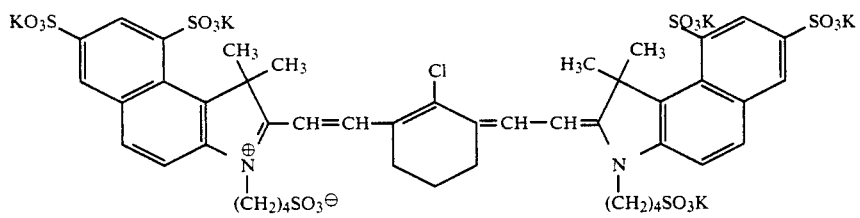

(A-42)

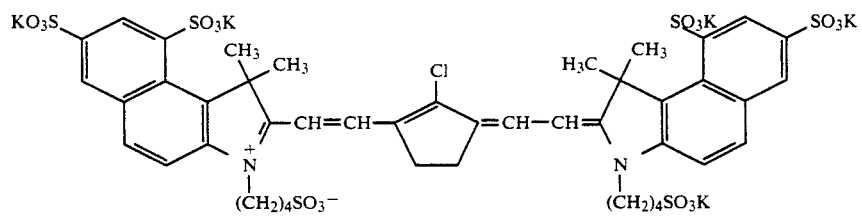

The dyes of the formula (A) have a maximum absorption wavelength range of from 730 to 850 nm. Of these, in view of the object of the present invention, it is preferred to select two or more dyes so as to have a maximum absorption wavelength range from 770 to 850 nm. In addition, it is particularly preferred to use a dye which has a maximum absorption wavelength range falling within ±50 nm of a maximum wavelength of light emitted from a light source of the longest wavelength in a scanning exposure from the standpoint of remarkable improvement e.g., in a resolving power. The dyes of the formula (A) can be produced by reference to the disclosure of *Journal of the Chemical Society,* 189 (1933) or to the examples illustrated in U.S. Pat. No. 2,895,955 (which is incorporated herein by reference) and JP-A-62-123454.

The above-mentioned dye is dissolved in an appropriate solvent (for example, water, alcohols (methanol, ethanol), methyl cellosolve, or a mixed solvent thereof) and then incorporated into the hydrophilic colloid layer-coating liquid of the present invention. Two or more kinds of the dyes can be employed in combination.

The specific amount of the dye to be employed can not be defined precisely, since the amount varies in accordance with the object thereof (for example, for color-sensitivity adjustment, anti-irradiation, antihalation, impartation of safety to safelight). In general, however, the preferred amount of the dye falls within the range of from $10^{-3}$ g/m$^2$ to 1 g/m$^2$, especially from $10^{-3}$ g/m$^2$ to 0.5 g/m$^2$.

The photographic dye of the above-mentioned formula (A) of the present invention is effective for anti-irradiation, and it is essentially incorporated into the emulsion layer where it is employed for the purpose of anti-irradiation.

The photographic dye of formula (A) of the present invention is also especially useful as a dye for an anti-halation; In that case, the dye is applied to the back surface of the support or is added to the interlayer between the support and the emulsion layer.

The photographic dye of formula (A) of the present invention can be employed as a dye for imparting a safelight-safety to the photographic material. In that case, the dye is optionally combined with any other dye which absorbs a light of another wavelength and is added to the layer positioned above the photographic emulsion layer (for example, added to the protective layer). In addition, the photographic dye of the present invention may also advantageously employed as a filter dye.

The full-color photographic material of the present invention may optionally contain colloidal silver and any other dyes than the dye of the formula (A), for anti irradiation and anti-halation, and especially for separation of the color-sensitivity distribution of the respective light-sensitive layers and insurance of the safety to the safelight in the visible wavelength range.

Such other dyes include, for example, oxonole dyes, hemioxonole dyes, styryl dyes, merocyanine dyes, cyanine dyes and azo dyes.

A dye which may be decolored and dissolved out during the step of processing the photographic material may be added to the material in the form of a dispersion of fine water-insoluble solid grains, as is described in JP-A-63-197947 and International Patent Application W088/04794.

The anionic dye of the present invention may be employed along with a cation side donating polymer or polymer latex, in the form of mordanting in a particular layer.

(3) Processing Step:

Another characteristic feature of the present invention is the color development step for processing the photographic material mentioned above, which will be explained in detail hereunder.

A chloride ion to be incorporated into a developer is well known as an antifoggant. However, the effect is small, and even though the ion is employed in a large amount, an increase of fog caused by continuous processing could not be prevented and the streaky fog to be formed on the photographic material when it is processed with an automatic developing machine could not completely be prevented. On the contrary, incorporation of too much chloride ion into the color developer would cause the problems of retarding the developing speed and lowering the maximum density of the image to be formed.

A bromide ion is also well known as an antifoggant. If it is incorporated into the developer in a sufficient amount, the fog caused by continuous processing as well as the streaky pressure mark can be prevented. However, such ion has the problems of retarding the developability and lowering the maximum density and the sensitivity, and therefore it could not be practically employed.

Under the situation, the present inventors variously investigated and at last have found that where the photographic material comprising the high silver chloride emulsion of the present invention which has a silver chloride content of 90 mol% or more is, after being scanning exposed, processed with a color developer having a chloride ion content of from $3.5\times10^{-2}$ to $1.5\times10^{-1}$, preferably $4\times10^{-2}$ to $1\times10^{-1}$ mol/liter and a bromide ion content of from $3.0\times10^{-5}$ to $1.0\times10^{-3}$, preferably $3.5\times10^{-5}$ to $5\times10^{-4}$ mol/liter, increase in maximum density and sensitivity is not impaired, which is particular to the scanning exposure, i.e., the maximum density of the image to be formed on the material is not lowered, the processed photographic material is free from the residual dye, the streaky pressure mark formed by processing with an automatic developing machine is prevented, the fluctuation of the photographic material (especially the minimum density of the image formed on the material) caused by continuous processing is prevented, and the amount of the residual silver in the processed material is extremely lowered.

If a chlorine ion or a bromide ion concentration is outside the above range, the above-mentioned effects are not attained, even though a scanning exposure is conducted. Only when the two ions (chloride ion and bromide ion) are incorporated each in the content as defined above into the scanning exposed color photographic material, these effects (in particular, decrease in maximum density and sensitivity) could be attained. This is quite unexpected and is surely surprising.

The effects attainable by combination of the relatively large amount of chloride ion and the extremely small amount of bromide ion to be incorporated into the color developer were quite unknown up to the present, and the details of the effects are not clear but may be presumed as follows.

The reason why the streaky pressure mark is formed by development with an automatic developing machine would be that the photographic material is, after being exposed, developed with a color developer whereupon an excessive pressure is applied to the material, and the part of the material to which pressure has been applied is intensified to give a fogging nucleus and form a fog from the nucleus. The fog means a so-called pressure mark and is therefore different from the densified part (so-called fog) which is formed in development of the non-exposed portion.

In accordance with the present invention, however, development of the fogging nucleus could be selectively inhibited by incorporation of pertinent amounts of bromide ion and chloride ion into the developer, whereby the fog may be inhibited without retardation of the developing speed and lowering of the maximum density and the sensitivity. Such selective development-inhibiting effect attainable by the combination of the specific contents of the chloride ion and the bromide ion in the developer could not be clarified only by the variation of the reduction potential of the silver ion in the presence of halogens, but it may presumed that the state of adsorption of the bromide ions and the chloride ions to the silver halide grains would have some great influences on the effect.

On the other hand, the effect of inhibiting the fluctuation of the photographic property of the photographic material caused by continuous processing could not also be clarified only by the balance between the high developing activity of the high silver chloride emulsion-containing photographic material and the lowering of the activity because of the presence of the pertinent amounts of the bromide ion and the chloride ion, or that is, it could not be decided that the inhibition of the fluctuation of the photographic property of the photographic material would be caused by the high active and high-inhibiting development system. The meaning of the present invention which sepcifically defines the particular combination of the bromide ion and the chloride ion would be clarified by the studies in future.

The extreme effect of inhibiting desilvering insufficiency attained by the present invention could be considered as follows: It is known that a high silver chloride emulsion causes desilvering insufficiency. The present inventors found that the reason of such desilvering insufficiency is caused by formation of silver sulfide. By existence of both the bromide ion of a pertinent amount and the chloride ion of a pertinent amount in the developer, the state of the halogen component as adsorbing to the developed silver would vary to thereby inhibit the formation of such silver sulfide.

JP-A-63-106655 describes a method of processing a photographic material having a silver chloride content of 70 mol% or more with a developer containing a chloride of $2\times10^{-2}$ mol/liter or more. However, the concentration of the chloride to be contained in the developer for the said known method is outside the scope of the content of the bromide ion in the developer to be employed in the present invention. Additionally, JP-A-63-106655 is quite silent on the specific effect to be attainable by the combination of the chloride ion of the defined amount and the bromide ion of the defined amount in accordance with the present invention. It is further silent on the problems to be solved by the present invention. Accordingly, it does not anticipate the present invention.

In accordance with the present invention, the chloride ion and the bromide ion may directly be added to the developer, or alternatively, they may be previously added to the photographic material to be processed and are dissolved out from the material during processing thereof. Where the amounts of the ions to be dissolved out from the photographic material being processed are to be increased, the amount of the replenisher to the developer is preferably decreased.

Where the ions are directly added to the color developer, a chloride ion-donating substance may be employed, which includes, for example, sodium chloride, potassium chloride, ammonium chloride, nickel chloride, magnesium chloride, maganese chloride, calcium chloride and cadmium chloride. Preferred are sodium chloride and potassium chloride among them.

The ions may also be introduced into the developer in the form of a pair ion to the brightening agent to be added to the developer. As the bromide ion-donating substance, there are mentioned sodium bromide, potassium bromide, ammonium bromide, lithium bromide, calcium bromide, magnesium bromide, manganese bromide, nickel bromide, cadmium bromide, cerium bromide and thallium bromide. Preferred are potassium bromide and sodium bromide amoung them.

Where the ions are dissolved out form the photographic material being processed into the developer, both the chloride ion and the bromide ion may be released from the emulsion or from any other than the emulsion.

In accordance with the present invention, it is preferred that the color developer does not substantially contain a sulfite ion from the viewpoint of maintenance of the processing stability in the continuous processing and of prevention of the streaky pressure mark. In order to inhibit deterioration of the developer, it is recommended that the developer is not used for a long period of time. In addition, various physical means of, for example, use of a floating lid on the developer tank as well as reduction of the opening area of the developer tank for inhibiting the influence of the aerial oxidation of the developer in the tank, and various chemical means of, for example, inhibition of the elevation of the developer temperature as well as addition of an organic preservative to the developer may also be employed in the method of the present invention. In particular, addition of an organic preservative to the color developer is advantageous, as being simple and easy.

The organic preservative referred to herein includes all organic compounds which may be added to a processing solution for color photographic materials thereby to reduce the deterioration of the aromatic primary amine color developing agent in the solution. Such compounds have the function of preventing the color developing agent from being oxidized with air or the like. In particular, hydroxylamine derivatives (except hydroxylamine the same shall apply hereunder), hydroxamic acids, hydrazines, hydrazides, phenols, alpha-hydroxyketones, alpha-aminoketones, saccharides, monoamines, diamines, polyamines, quaternary ammonium salts, nitroxy radicals, alcohols, oximes, diamide compounds and condensed cyclic amines are especially effective organic preservatives. These are described in detail in JP-A-63-4235, JP-A-63-3085, JP-A-63-21647, JP-A-63-44655, JP-A-63-53551, JP-A-63-431430, JP A-63-55546, JP-A-63-58346, JP-A-63-43138, JP-A-63-44657, JP-A-63-44656, U.S. Pat. Nos. 3,615,503, 2,494,903, 4,801,521, JP-A-52-142020, JP-B-48-30496.

The amount of the above-mentioned organic preservative to be added to the color developer is desirably from 0.005 mol/liter to 0.5 mol/liter, preferably from 0.03 mol/liter to 0.1 mol/liter.

In particular, addition of hydroxylamine derivatives (for example, N,N-dialkylhydroxylamines such as diethylhydroxylamine) and/or hydrazine derivatives (especially those described in JP A-63-146041, JP-A-63-146042 and JP-A-63-146043) is preferred.

The color developer to be employed in the method of the present invention will be explained in detail hereunder.

The color developer for use in the present invention contains a known aromatic primary amine color developing agent. Preferred examples of the color developing agent are p-phenylenediamines, and specific non limiting examples thereof are mentioned below:

D-1: N,N-diethyl-p-phenylenediamine
D-2: 4-[N-ethyl-N-(β-hydroxyethylamino]aniline
D-3: 2-Methyl-4-[N-ethyl-N-(β-hydroxyethyl-)amino]aniline
D-4: 4-Amino-3-methyl-N-ethyl-N-(β-methanesulfonamidoethyl)aniline The p-phenylenediamine derivatives may be in the form of salts thereof, such as sulfates, hydrochlorides or p-toluenesulfonates thereof. The amount of the said aromatic primary amine developing agent to be contained in the developer is preferably from about 0.1 g/liter to about 20 g/liter, more preferably from about 0.5 g/liter to about 10 g/liter.

The color developer for use in the present invention preferably has a pH value of from 9 to 12, more preferably from 9 to 11.0. The color developer may additionally contain other components of known developers.

In order to maintain the above-defined pH range, the color developer preferably contains a buffer. Examples of buffer which may be employed for the purpose include sodium carbonate, potassium carobonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of the buffer to be added to the color developer is preferably 0.1 mol/liter or more, especially preferably from 0.1 mol/liter to 0.4 mol/liter.

In addition, the color developer may further contain various chelating agents as a calcium- or magnesium-precipitation inhibitor or for the purpose of improving the stability of the color developer.

Examples of such chelating agents, which are not limitative, include nitrilotriacetic acid, diethylenetriamine-pentaacetic acid, ethylenediamine-tetraacetic acid, triethylenetetraminehexaacetic acid, N,N,N-trimethylenephosphonic acid, ethylenediamine-N,N,N',N'-tetramethylenephosphonic acid, 1,3-diamino-2-propanoltetraacetic acid, transcyclohexanediamine-tetraacetic acid, nitrilotripropionic acid, 1,2-diaminopropanetetraacetic acid, hydroxyethylimino-diacetic acid, glycol ether diamine-tetraacetic acid, hydroxyethylenediamine-tetraacetic acid, ethylenediamineorthohydroxyphenylacetic acid, 2-phosphonobutane-1,2,4-tricarboxylic acid, 1-hydroxyethylidene-1;1-diphosphonic acid N,N'-bis(2-hydroxybenzyl)ethylidenediamine-N,N'-diacetic acid, catechol-3,4,6-trisulfonic acid, catechol-3,5-disulfonic acid, 5-sulfosalicylic acid and 4-sulfosalicylic acid.

If desired, two or more kinds of the said chelating agents can be incorporated into the color developer.

The amount of the chelating agent to be added to the color developer may be a sufficient amount so that it may sequester the metal ions in the color developer. For instance, the amount may be from 0.1 g/liter to 10 g/liter.

The color developer may optionally contain any desired development accelerator.

As examples of development accelerators usable in the present invention, there are mentioned the thioether compounds described in JP-B-37-16088, JP-B-37-5978, JP-B-38-7826, JP-B-44-12380, JP-B 45-9019 and U.S. Pat. No. 3,813,247; the p-phenylenediamine compounds described in JP-A-52-49829 and JP-A-50-15554; the quaternary ammoniums described in JP-A-50 137726, JP-B-44-30074, JP-A-56-156826 and JP-A-52-43429; the p-aminophenols described in U.S. Pat. Nos. 2,610,122 and 4,119,462; the amine compounds described in U.S. Pat. Nos. 2,494,903, 3,128,182, 4,230,796, 3,253,919, JP-B-41-11431, U.S. Pat. Nos. 2,482,546, 2,596,926 and 3,582,346; the polyalkylene oxides described in JP-B-37-16088, JP-B-42-25201, U.S. Pat. No. 3,128,183, JP-B-41-11431, JP-B-42-23883 and U.S. Pat. No. 3,532,501; as well as other 1-phenyl-3-pyrazolidones, hydrazines, mesoionic compounds, ionic compounds and imidazoles.

It is desired that the color developer substantially contains no benzyl alcohol. Specifically, the content of benzyl alcohol in the developer should be 2.0 ml/liter or less, and more preferably, the color developer contains no benzyl alcohol at all. This is preferred since the fluctuation of the photographic characteristics during continuous processing is small and a more favorable result can be obtained.

The color developer for use in the present invention may further contain any desired antifoggant, in addition to the chloride ion and the bromide ion. As the antifoggant, alkali metal halides such as potassium iodide as well as organic antifoggants can be employed. Specific examples of the organic antifoggant are nitrogen containing heterocyclic compounds such as benzotriazole, 6-nitrobenzimidazole, <5-nitroisoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindene and adenine.

The color developer for use in the present invention preferably contains a brightening agent. Preferred brightening agents are 4,4'-diamino-2,2'-disulfostilbene compounds. The amount of the agent to be added to the color developer may be up to 10 g/liter, preferably from 0.1 g/liter to 6 g/liter.

If desired, the color developer may further contain various surfactants such as alkylsulfonic acids, arylphosphonic acids, aliphatic carboxylic acids or aromatic carboxylic acids.

The processing temperature of the color developer of the present invention is from 20° to 50° C, preferably from 30° to 40° C. The processing time with the color developer may be from 20 seconds to 1 minute, preferably from 30 seconds to 50 seconds.

In general, a replenisher is replenished to the color developer tank during color development. The amount of the replenisher is, although varying in accordance with the photographic material being processed, generally from 180 to 1000 ml per $m^2$ of the material being processed. Replenishment is one means for keeping the components of the color developer constant in continuous processing of a large amount of photographic materials by the use of an automatic developing machine or the like, for the purpose of prevention variation of the concentration of the components in the developer and of preventing variation of the photographic characteristics of the finished products. However, such replenishment inevitably gives a large amount of overflow waste liquid. Accordingly, the amount of the replenisher is preferably small from an economical viewpoint and for the purpose of reducing an environmental pollution to be caused by the waste liquid. The preferred amount of the replenisher is therefore from 20 to 150 ml per $m^2$ of the photographic material being processed. Although somewhat varying in accordance with the kind of the photographic material being processed, the amount of the replenisher of being 20 ml per $m^2$ of the photographic material being processed indicates such that the amount of the carryover of the processing solution with the material being processed is almost same as that of the replenisher, and under such condition, the amount of the overflow waste liquid is substantially 0 (zero). Even under such low replenishment condition, the effect of the present invention is practically noticeable.

In accordance with the present invention, the photographic material is, after being color-developed, subjected to desilvering. The desilversing step generally comprises a bleaching step and a fixation step, which are most preferably effected at the same time in the present invention.

The bleaching solution or bleach-fixing solution to be employed in the present invention can contain a rehalogenating agent such as bromides (e.g., potassium bromide, sodium bromide, ammonium bromide), chlorides (e.g., potassium chloride, sodium chloride, ammonium chloride) or iodides (e.g., ammonium chloride). If desired, the said solution may further contain one or more inorganic acids or organic acids or alkali metal or ammonium salts thereof, which have a pH-buffering capacity, for example, boric acid, borax, sodium metaborate, acetic acid, sodium acetate, sodium carbonate, potassium carbonate, phosphorous acid, phosphoric acid, sodium phosphate, citric acid, sodium citrate or tartaric acid; as well as corrosion-preventing agent such as ammonium nitrate or guanidine.

The fixing agent to be contained in the bleach-fixing solution or fixing solution for use in the present invention may be a known fixing agent, which is a water-soluble silver halide-solubilizing agent such as thiosulfates (e.g., sodium thiosulfate, ammonium thiosulfate), thiocyanates (e.g., sodium thiocyanate, ammonium thiocyanate), thioether compounds (e.g., ethylene-bisthioglycolic acid, 3,6 dithia-1,8-octane-diol) or thioureas. One or more kinds of such compounds may be in the bleach-fixing or fixing solution of the present invention. In addition, a particular bleach-fixing solution which comprises a fixing agent and a large amount of a halide such as potassium bromide in combination, which is described in JP-A-55-155354, can be employed in the present invention. In accordance with the present invention, employment of thiosulfates, especially ammonium thiosulfate, is preferred. The amount of the fixing agent in the solution is preferably from 0.3 to 2 mol/liter, more preferably from 0.5 to 1.0 mol/liter.

The bleach-fixing solution or the fixing solution to be employed in the present invention preferably has a pH value of from 3 to 10, more preferably from 5 to 9. If the pH value of the solution is lower than the said range, deterioration of the solution as well as leucoation of the cyan dye is accelerated, although the desilvering property of the solution is improved. On the contrary, if the pH value is higher than the said range, desilvering is retarded and the processed material often has stains.

In order to adjust the pH value of the solution, hydrochloric acid, sulfuric acid, nitric acid, acetic acid, bicarbonates, ammonia, potassium hydroxide, sodium hydroxide, sodium carbonate or potassium carbonate may be added to the solution, if desired.

The bleach-fixing solution may further contain other various brightening agents, defoaming agents or surfactants as well as organic solvents such as polyvinyl pyrrolidone or methanol.

The bleach-fixing solution or fixing solution contains, as a preservative, a sulfite ion-releasing compound such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite). The compound is preferably incorporated into the solution in an amount of approximately from 0.02 to 0.50 mol/liter, more preferably approximately from 0.04 to 0.40 mol/liter, as the sulfite ion.

As the preservatives, addition of sulfites is general, but other ascorbic acid, carbonyl-sulfite adducts, sulfinic acids, carbonyl compounds or sulfinic acids may also be added to the solution.

In addition, the solution may further contain a buffer, a brightening agent, a chelating agent and a fungicide, if desired.

After desilvered by fixation or bleach-fixation, the silver halide photographic material of the present invention is generally rinsed and or stabilized.

The amount of the water to be used in the rinsing step varies, depending upon the characteristics of the photographic material being processed (for example, the constituting elements such as couplers and others), the use of the material, the temperature of the rinsing bathes (the number of rinsing stages), the replenishment system of normal current of countercurrent, and other various conditions, and therefore it may be defined in a broad range. For instance, the relation between the number of the rinsing tanks and the amount of the rinsing water in a multi-stage countercurrent rinsing system may be obtained by the method described in *Journal of the Society of Motion Picture and Television Engineering*, Vol. 64, pages 248 to 253 (May, 1955).

In accordance with the multi stage countercurrent rinsing system described in the above-mentioned literature, the amount of the rinsing water to be used may noticeably be reduced., However, the system has a problem that bacteria would propagate in the rinsing tanks because of the increased residence time of the rinsing water in the tanks, so that the floating substances formed would adhere to the photographic material being processed. As a means of overcoming the problem in processing the color photographic material of the present invention, the method of reducing calcium and magnesium in water, described in JP-A-62-288838 can be employed extremely efficiently. In addition, isothiazolone compounds and thiabendazoles described in JP-A-57-8542, as well as chlorine-containing microbicides such as sodium chloroisocyanurate, other benzotriazoles and other microbicides described in H. Horiguchi, *Antibacterial and Antifungal Chemistry*, and *Bactericidal and Fungicidal Techniques to Microorganisms* (edited by Japan Sanitary Technique Association) and Encyclopeadia of Bactericidal and Fungicidal Agents (edited by Japan Bactericide and Funcigide Association) can also be used for overcoming the problem.

The rinsing water to be employed for rinsing the photographic material of the present invention has a pH value of from 4 to 9., preferably from 5 to 8. Although varying in accordance with the characteristics and the use of the photographic material being processed, the rinsing temperature is generally from 15° to 45° C. and the rinsing time is generally from 20 seconds to 10 minutes. Preferably, the rinsing temperature is from 25° to 40° C. and the rinsing time is from 30 seconds to 5 minutes.

The photographic material of the present invention may directly be processed with a stabilizing solution, in place of the above-mentioned rinsing step. For such stabilization treatment, each and every methods and means described in JP-A-57-8543, JP-A-58-14834, JP-A-59-184343, JP-A 60-220345, JP-A-60-238832, JP-A-60-239784, JP-A-60-239749, JP-A-61-4054 and JP-A-61-118749 cab be employed. In particular, a stabilization bath containing 1-hydroxyethylidene-1,1-diphosphonic acid, 5-chloro-2-methyl-4-isothiazolin-3-one, bismuth compounds or ammonium compounds is preferably employed.

Following the above-mentioned rinsing step, the photographic material may further be processed in a stabilization bath. As one example of the case, there is mentioned a stabilization bath containing formalin and a surfactant which is used as the final bath for processing picture-taking color photographic materials.

The processing time for processing the photographic material of the present invention indicates the time from the first contact of the photographic material with the color developer to the finish in the final bath (generally, rinsing bath or stabilization bath). The effect of the present invention is remarkable even in a high-speed processing where the processing time is 180 seconds or less, preferably 150 seconds or less.

(4) Light Sources (Scanning Exposure Light Sources):

As an exposure method, the use of a scanning exposure in the present invention is remarkably different from a conventional photographic image formation. In particular, the combined use of the scanning exposure and the photographic material containing a dye represented by formula (A) provides a preferred effect which cannot easily be analogized by the conventional image formation using a surface exposure.

As the light source for scanning exposure of the photographic material of the present invention, laser rays such as a light-emitting diode or semiconductor laser are preferred. Especially preferred is the semiconductor laser. By scanning exposure with three different light sources each having a different wavelength, a full color image can be obtained.

Specific examples of the semiconductor lasers which are employable in the present invention are those derived from light-emitting materials of $In_{1-x}Ga_xP$ (to 700 nm), $GaAs_{1-x}P_x$ (from 610 to 900nm), $Ga_{1-x}Al_xAs$ (from 690 to 900 nm), InGaAsP (from 1100 to 1670 nm) or AsGaAsSb (from 1250 to 1400 nm). Light-irradiation to the color photographic material of the present invention may also be effected by a YAG laser (1064 nm) to be derived by exciting Nb:YAg crystal with a light-emitting diode $GaAS_xP_{(1-x)}$, in addition to the above-mentioned semiconductor lasers. Preferably, three light sources each having a different wavelength are selected from the semiconductor laser rays of 670, 680, 750, 780, 810, 830 and 880 nm.

The secondary higher harmonics-generating element (SHG element) to be employed in the present invention is one which may convert the wavelength of the laser ray to ½ by employing a non-linear optical effect. For instance, CD*A and KD*P are employed as the non-linear optical crystal (refer to *Laser Handbook,* edited by Laser Society and published on Dec. 15, 1982, pages 122 to 139). In addition, an $LiNbO_3$ light wave guide element where $Li^+$ has been ion-exchanged by $H^+$ to form a light wave guide in the $LiNbO_3$ crystal can also be employed (*Nikkei Electronics,* No. 399, published on Jul. 14, 1986, pages 89 to 90).

As the light-emitting diode which may be employed in the present invention, there are mentioned GaP green light-emitting diode, Ga red light-emitting diode and GaAs infrared wave-emitting diode.

(5) Couplers and Other Elements:

The full-color recording material of the present invention generally contains yellow coupler, magenta coupler and cyan coupler which are coupled with the oxidation product of an aromatic amine color developing agent to form yellow, magenta and cyan colors, respectively.

As the yellow coupler for use in the present invention, acylacetamide derivatives such as benzoylacetanilide or pivaloylacetanilide are preferred.

In particular, the compounds of the following formulae (Y-I) and (Y-II) are preferred as the yellow coupler for use in the present invention.

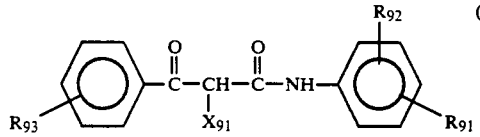

(Y-I)

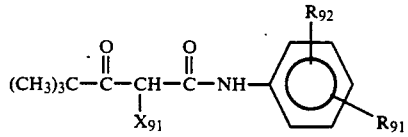

(Y-II)

In the formulae, $X_{91}$ represents a hydrogen atom or a coupling-releasing group; $R_{91}$ represents a nondiffusive group having from 8 to 32 carbon atoms in all; $R_{92}$ represents a hydrogen atom or one or more halogen atoms, lower alkyl groups, lower alkoxy groups or nondiffusive groups having from 8 to 32 carbon atoms in all; $R_{93}$ represents a hydrogen atom or a substituent; when the formula has two or more $R_{93}$'s, they may be the same or different.

The details of the pivaloylacetanilide yellow couplers are described in U.S. Pat. Nos. 4,622,287 (from column 3, line 15 to column 8, line 39) and 4,623,616 (from column 14, line 50 to column 19, line 41) which are incorporated herein by reference..

The details of the benzoylacetanilide yellow couplers are described in U.S. Pat. Nos. 3,408,194, 3,933,501, 4,046,575, 4,133,958 and 4,401,752 which are incorporated herein by reference.

As specific examples of the pivaloylacetanilide yellow couplers for use in the present invention, there are mentioned Compounds (Y-1) to (Y-39) described in U.S. Pat. No. 4,622,287, columns 37 to 54 which are incorporated herein by reference. Above all, Compounds (Y-1), (Y-4), (Y-6), (Y-7), (Y-15), (Y-21), (Y-22), (Y-23), (Y-26), (Y-35), (Y-36), (Y-37), (Y 38) and (Y-39) are preferred.

In addition, there are further mentioned Compounds (Y-1) to (Y-33) described in U.S. Pat. No. 4,632,616, columns 19 to 24 which is incorporated by reference. Above all, Compounds (Y-2), (Y-7), (Y-8), (Y-12), (Y-20), (Y-21), (Y-23) and (Y-29) are preferred.

Other preferred compounds, include Compound (34) described in U.S. Pat. No. 3,408,194, column 6; Compounds (16) and (19) described in U.S. Pat. No. 3,933,501, column 8; Compound (9) described in U.S. Pat. No. 4,046,575, columns 7 to 8; Compound (1) described in U.S. Pat. No. 4,133,958, columns 5 to 6; Compound (1) described in U.S. Pat. No. 4,401,752; and the following compounds (Y-1) to (Y-8), the patents being incorporated by reference.

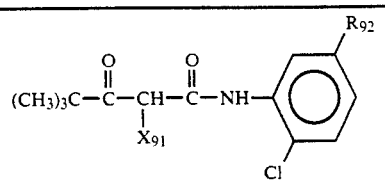

| Compound | $R_{92}$ | $X_{91}$ |
|---|---|---|
| Y-1 | $-CO_2CH(CH_3)CO_2C_{12}H_{25}$ | 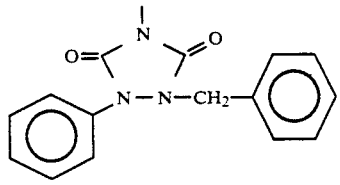 |
| Y-2 | $-CO_2CH(C_4H_9)CO_2C_{12}H_{25}$ | " |
| Y-3 | 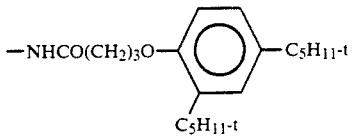 | $X_{92}$ 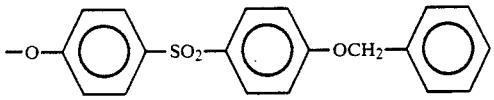 |
| Y-4 | " | 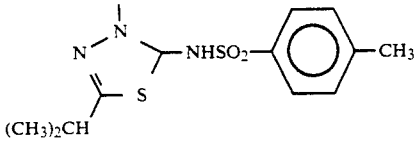 |
| Y-5 | " | 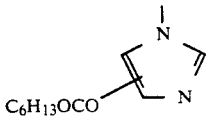 |
| Y-6 | $-NHSO_2C_{12}H_{25}$ | 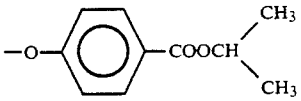 |
| Y-7 | $-NHSO_2C_{16}H_{33}$ | 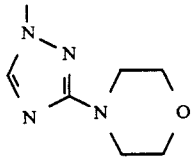 |
| Y-8 | 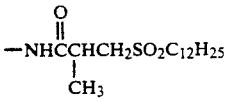 | 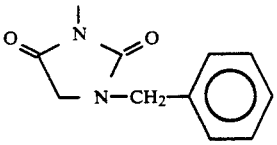 |

Among the above-mentioned couplers, those having a nitrogen atom as the releasing atom are especially preferred.

As the magenta couplers for use in the present invention, there are mentioned oil-protect type indazolone or cyanoacetyl couplers, preferably pyrazoloazole couplers such as 5-pyrazolone or pyrazolotriazole couplers. The 5-pyrazolone couplers are preferably those where the 3-position is substituted by an arylamino group or ah acylamino group, which give colors of good hue and high color density. Typical examples of such couplers are described in U.S. Pat. Nos. 2,311,082, 2,343,703, 2,600,788, 2,908,573, 3,062,653, 3,152,896 and 3,936,015. As the releasing group in the 2-equivalent 5-pyrazolone couplers, the nitrogen-releasing groups described in U.S. Pat. No. 4,310,619 and the arylthio group described in U.S. Pat. No. 4,351,897 are preferred. The ballast group-having 5-pyrazolone couplers described in European Patent 73,636 are also preferred as giving colors of high color density.

As the pyrazoloazole couplers for use in the present invention, there are mentioned the pyrazolobenzimidaozles described in U.S. Pat. No. 2,369,879, preferably the pyrazolo[5,1-c]1,2,4-triazoles described in U.S. Pat. No. 3,725,067, the pyrazolo-tetrazoles described in *Research Disclosure* Item No. 24220 (June, 1984) and the pyrazolopyrazoles described in *Research Disclosure* Item No, 24230 (June, 1984). All the above-mentioned couplers may be in the form of polymer couplers.

The above-mentioned compounds are represented by the following general formula (M-1), (M-II) or (M-III). In particular, the couplers of the formula (M-III) are useful.

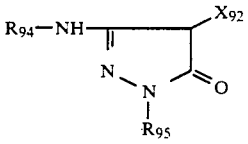
(M-I)

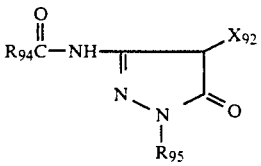
(M-II)

-continued

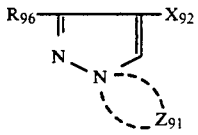
(M-III)

In these formulae, $R_{96}$ represents a non-diffusive group having from 8 to 32 carbon atoms in all; $R_{95}$ represents a phenyl group or a substituted phenyl group; $R_{96}$ represents a hydrogen atom or a substituent; $Z_{91}$ represents a non-metallic atomic group necessary for forming a 5-membered azole ring having from 2 to 4 nitrogen atoms, the azole ring optionally having substituent(s) (including condensed ring(s)). $X_{92}$ represents a hydrogen atom or a releasing group. The details of the substituents for $R_{96}$ as well as the substituents on the azole ring, if any, are described in, for example, U.S. Pat. No. 4,540,654, from column 2, line 41 to column 8, line 27.

Among the pyrazoloazole couplers, the imidazo-[1,2-b]pyrazoles described in U.S. Pat. No. 4,500,630 are preferred, as the colors to be derived therefrom have small yellow absorption and high light fastness. In particular, the pyrazolo[1,5-b][1,2,4]triazoles described in U.S. Pat. No. 4,540,654 are especially preferred.

In addition, the pyrazolotriazole couplers where a branched alkyl group is directly bonded to the 2-, 3- or 6-position of the pyrazolotriazole ring, described in JP-A-61-65245; the pyrazoloazole couplers containing a sulfonamido group in the molecule, described in JP-A-61-65246; the pyrazoloazole couplers having an alkoxyphenylsulfonamido ballast group, described in JP-A 61-147254; and the pyrazolotriazole couplers having an alkoxy group or an aryloxy group in the 6-position, described in EP-A-226849 also preferably employed.

Specific examples of such couplers are mentioned below.

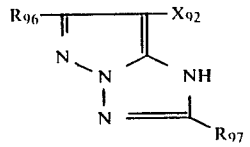
| Compound | $R_{96}$ | $R_{97}$ | $X_{92}$ |
|---|---|---|---|
| M-1 | $CH_3$— | 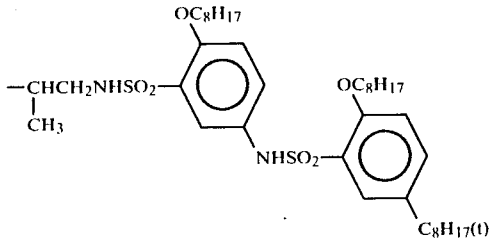 | Cl |
| M-2 | " | 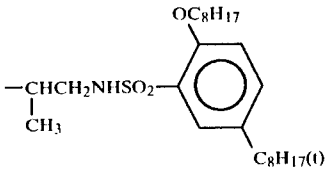 | " |
| M-3 | " | 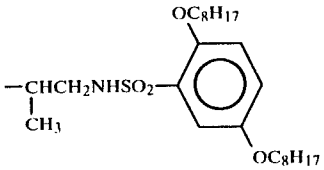 | 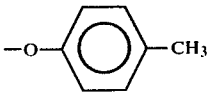 |
| M-4 | 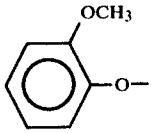 | 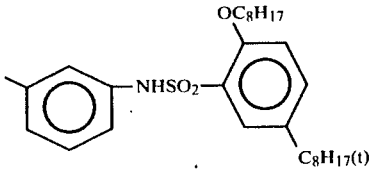 | 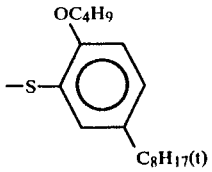 |

-continued
| | | | |
|---|---|---|---|
| M-5 | $CH_3$— | 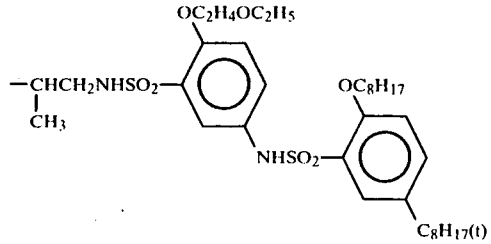 | Cl |
| M-6 | " | 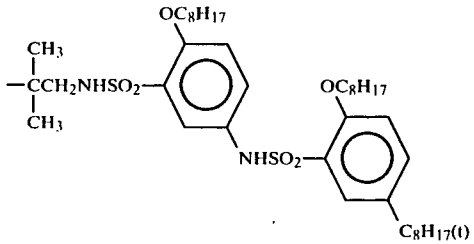 | " |
| M-7 | 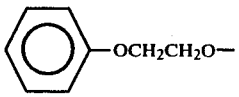 | 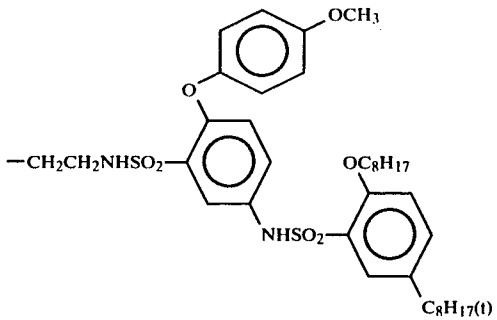 | 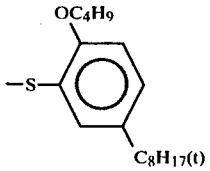 |
| M-8 | $CH_2CH_2O$— | " | " |
| M-9 | 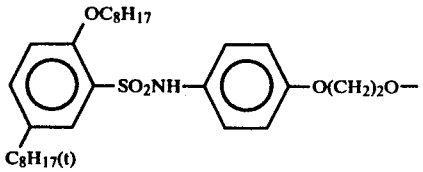 | 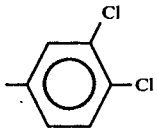 | " |

-continued
| | | | |
|---|---|---|---|
| M-10 | $CH_3$— | 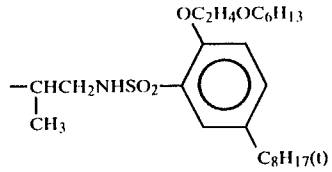 | Cl |
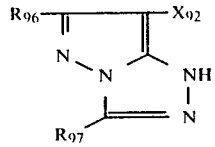
| Compound | $R_{96}$ | $R_{97}$ | $X_{92}$ |
|---|---|---|---|
| M-11 | $CH_3$— | 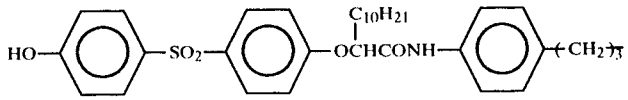 | Cl |
| M-12 | " | 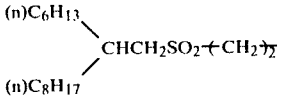 | " |
| M-13 | 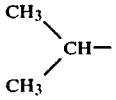 | 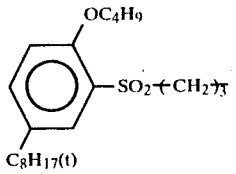 | " |
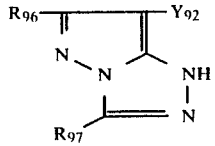
| Compound | $R_{96}$ | $R_{97}$ | $Y_{92}$ |
|---|---|---|---|
| M-14 | 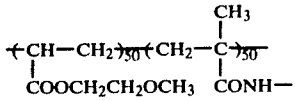 | 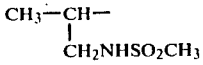 | " |

-continued
| | | | |
|---|---|---|---|
| M-15 | 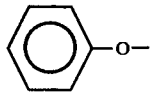 | 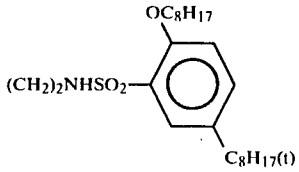 | Cl |
| M-16 | 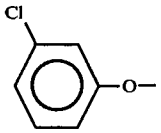 | 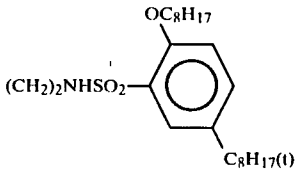 | 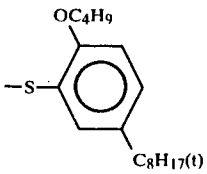 |
(M-17)
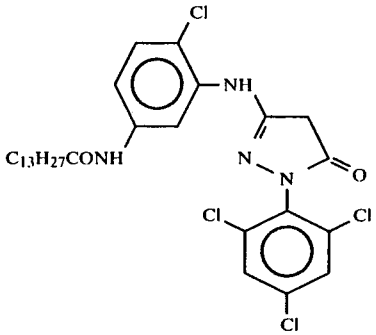
(M-18)
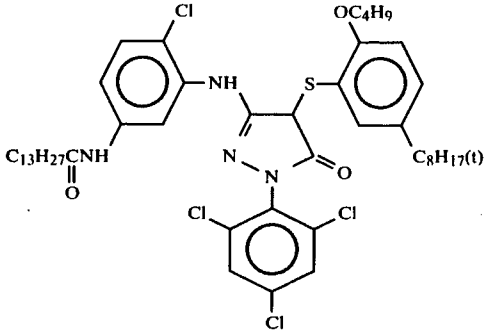

-continued
(M-19)
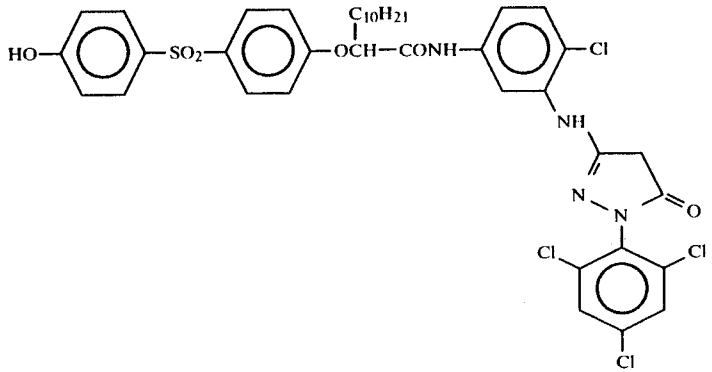
(M-20)
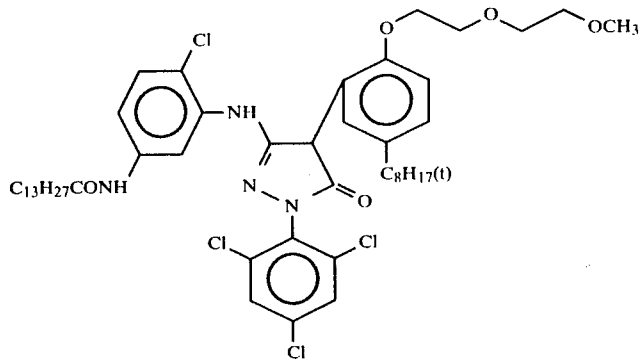
(M-21)
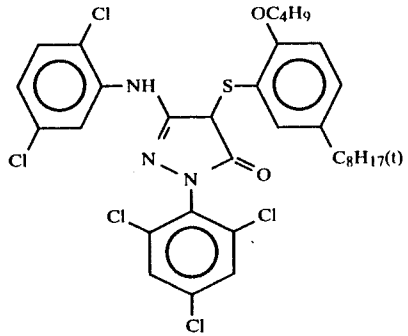

-continued
(M-22)
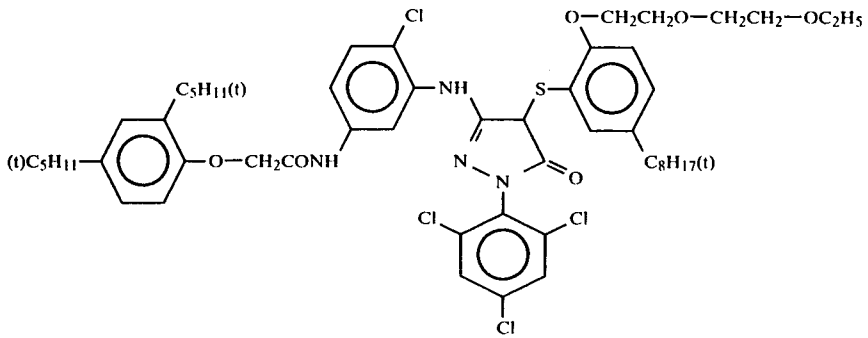
(M-23)
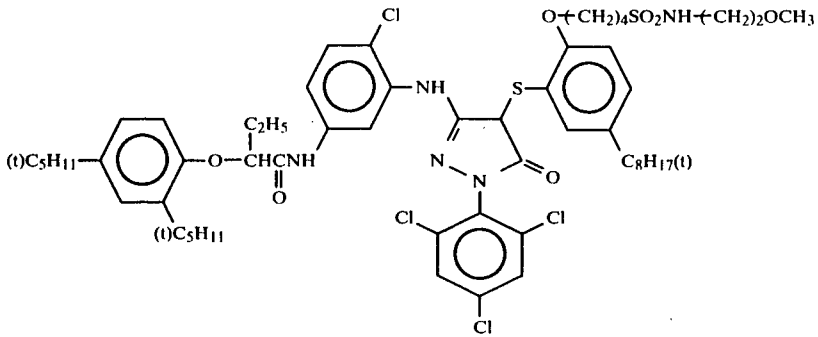
(M-24)
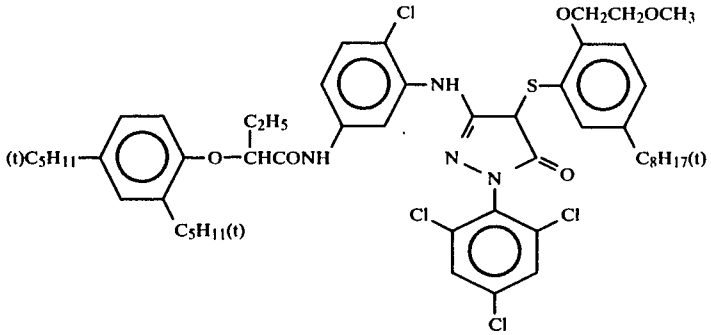

-continued
(M-25)
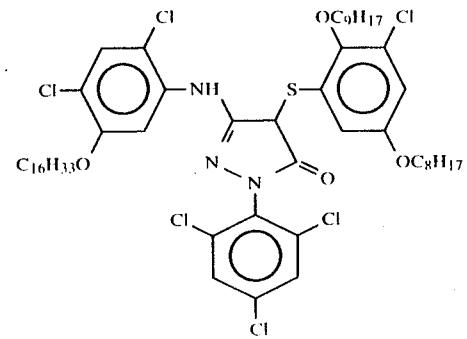
(M-26)
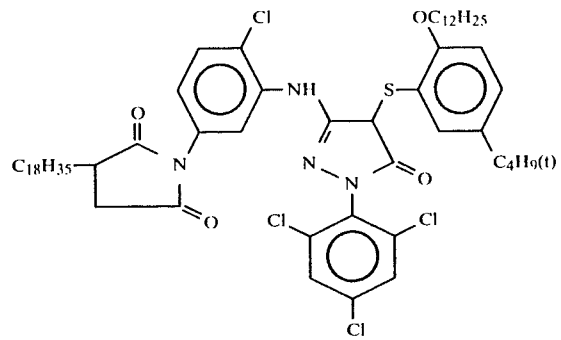
(M-27)
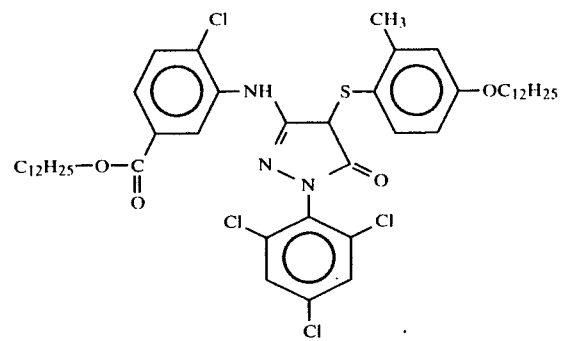

-continued
(M-28)
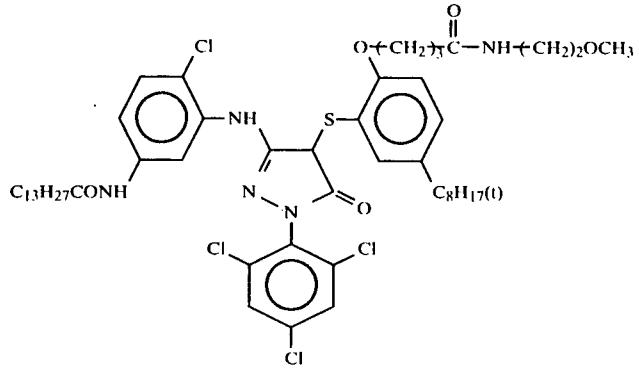
(M-29)
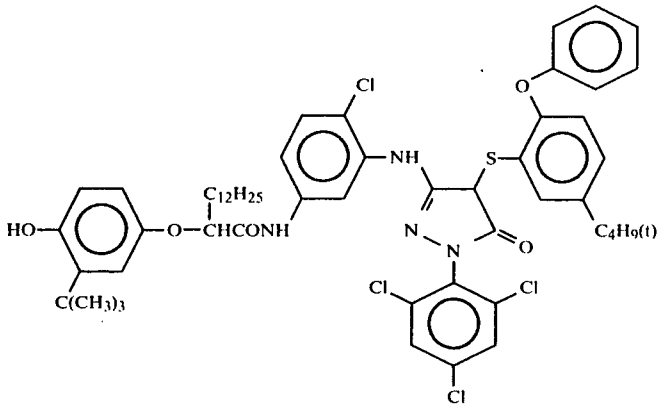
(M-30)
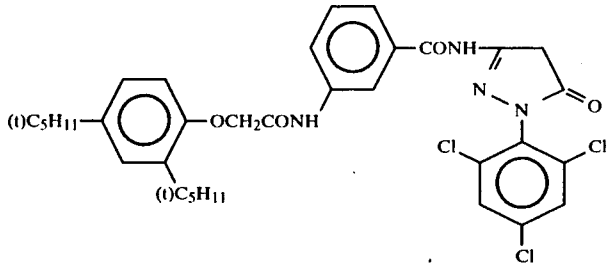

-continued
(M-31)
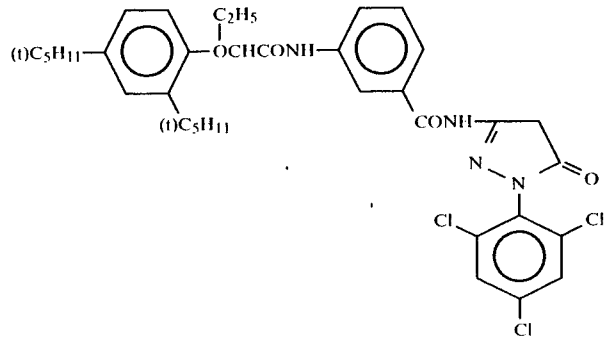
(M-32)
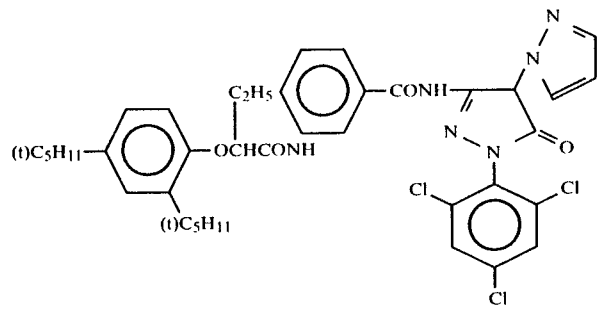
(M-33)
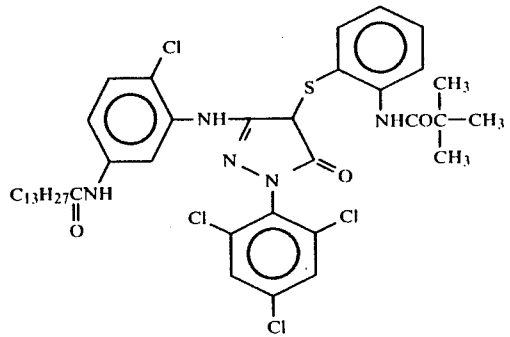

-continued
| | |
|---|---|
| (M-34) | 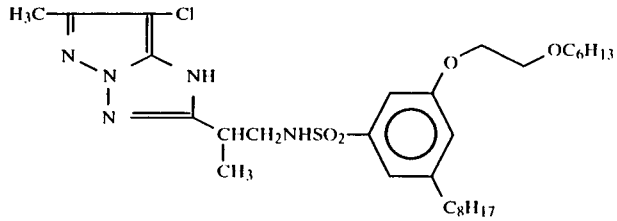 |

As the cyan couplers for use in the present invention, phenol cyan couplers and naphthol cyan couplers are mentioned.

As the cyan couplers, there are mentioned the compounds (including polymer couplers) having an acylamino group in the 2-position of the phenol nucleus and an alkyl group in the 5-position thereof, described in U.S. Pat. Nos. 2,369,929, 4,518,687, 4,511,647 and 3,772,002. As specific examples of such couplers, there are mentioned the couplers described in Example 2 of Canadian Patent 625,822; Compound (1) described in U.S. Pat. No. 3,772,002; Compounds (I-4) and (-5) described in U.S. Pat. No. 4,564,590; Compounds (1), (2), (3) and (24) described in JP-A-61-39045; and Compound (C-2) described in JP-A-62-70846.

As the phenol cyan couplers, there are further mentioned the 2,5-diacylaminophenol couplers described in U.S. Pat. No. 2,772,162, 2,895,826, 4,334,011 and 4,500,653 and JP-A-59-164555. As specific examples of such couplers, there are mentioned Compound (V) described in U.S. Pat. No. 2,895,826; Compound (17) described in U.S. Pat. No. 4,557,999; Compounds (2) and (12) described in U.S. Pat. No. 4,565,777; Compound (4) described in U.S. Pat. No. 4,124,396; and Compound (I-19) described in U.S. Pat. No. 4,613,564.

As the phenol cyan couplers, there are further mentioned nitrogen-containing hetero ring-condensed phenol compounds described in U.S. Pat. Nos. 4,327,173, 4,564,586 and 4,430,423, JP-A-61-390441 and JP-A-62-257158. As specific examples of the compounds, there are mentioned Couplers (1) and (3) described in U.S. Pat. No. 4,327,173; Compounds (3) and (16) described in U.S. Pat. No. 4,564,586; Compounds (1) and (3) described in U.S. Pat. No. 4,430,423; and the following compounds:

(C-1)

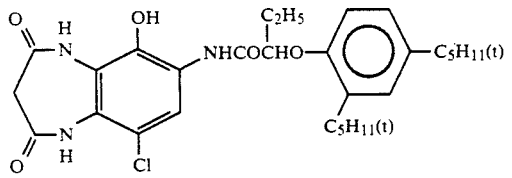

(C-2)

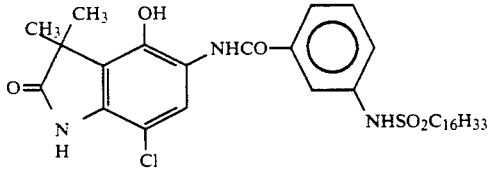

(C-3)

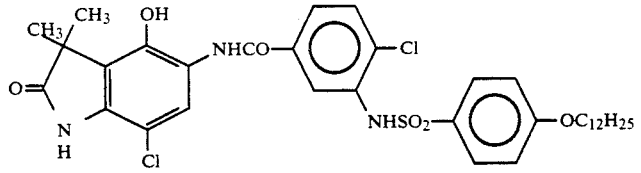

(C-4)

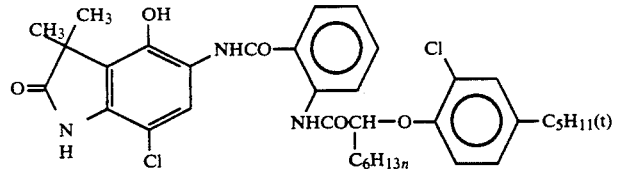

(C-5)

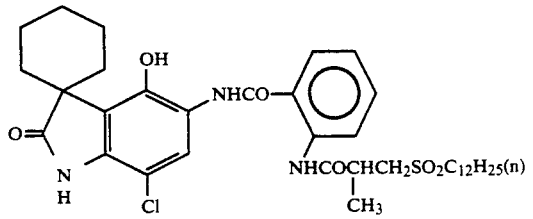

-continued (C-6)

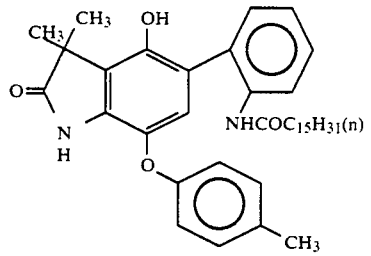

(C-7)

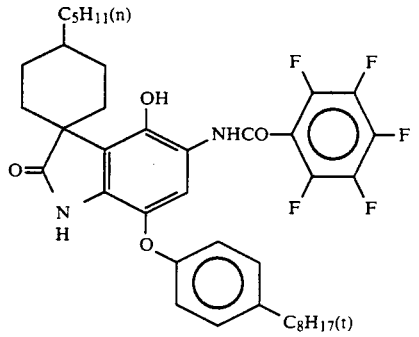

(C-8)

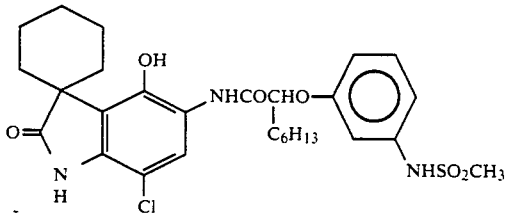

In addition to the cyan couplers of the above-mentioned types, the diphenylimidazole cyan couplers described in EP-A2-249453 can also be employed in the present invention.

As the phenol cyan couplers, there are further mentioned ureido couplers described in U.S. Pat. Nos. 4,333,999, 4,451,559, 4,444,872, 4,427,767 and 4,579,813 and EP-B1-67689. As specific examples of the compounds, there are mentioned Coupler (7) described in U.S. Pat. No. 4,333,999; Coupler (1) described in U.S. Pat. No. 4,451,559; Coupler (14) described in U.S. Pat. No. 4,444,872; Coupler (3) described in U.S. Pat. No. 4,427,767; Couplers (6) and (24) described in U.S. Pat. No. 4,609,619; Couplers (1) and (11) described in U.S. Pat. No. 4,579,813; Couplers (45) and (50) described in EP-B1-67689; and Coupler (3) described in JP-A-61-42658.

As the naphthol cyan couplers for use in the present invention, there are mentioned naphthol compounds having an N-alkyl-N-arylcarbamoyl group in the 2-position of the naphthol nucleus (for example, those described in U.S. Pat. No. 2,313,586); naphthol compounds having an alkoxycarbamoyl group in the 2-position of the nucleus (for example, those described in U.S. Pat. Nos. 2,474,293 and 4,282,312); naphthol compounds having an arylcarbamoyl group in the 2-position of the nucleus (for example, those described in JP-B-50-14523); naphthol compounds having a carbonamido or sulfonamido group in the 5 position of the nucleus (for example, those described in JP-A-60-237448, JP-A-61-14557, JP-A-61-153640); naphthol compounds having an aryloxy-releasing group (for example, those described in U.S. Pat. No. 3,476,563); naphthol compounds having a substituted alkoxy-releasing group (for example, those described in U.S. Pat. No. 4,296,199); and naphthol compounds having a glycolic acid-releasing group (for example, those described in JP-B-60-39217).

The couplers are preferably dispersed in the corresponding emulsion layers along with at least one high boiling point organic solvent. Favorably, high boiling point organic solvents as represented by the following formulae (A) to (E) are used for the purpose.

(A)

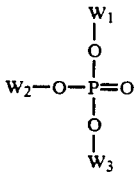

(B)

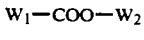

(C)

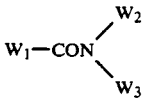

(D)

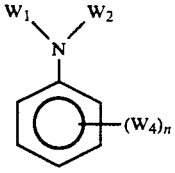

-continued $$W_1-O-W_2 \quad (E)$$

In these formulae, $W_1$, $W_2$ and $W_3$ each represent a substituted or unsubstituted alkyl, cycloalkyl, alkenyl, aryl or heterocyclic group; $W_4$ represents $W_1$, $OW_1$ or $S-W_1$; n represents an integer of from 1 to 5; and when n is 2 or more, plural $W_4$'s may be the same or different. In the formula (E), $W_1$ and $W_2$ may form a condensed ring.

The couplers may be applied to a loadable latex polymer (for example, one described in U.S. Pat. No. 4,203,716) in the presence or absence of the above-mentioned high-boiling point organic solvent or dissolved in a water-insoluble and organic solvent-soluble polymer, and then dispersed by emulsification in the aqueous hydrophilic colloid to be coated on the support.

Preferably, the homopolymers or copolymers described in International Patent Application Laid-Open No. W088/00723, pages 12 to 30 are employed. In particular, use of acrylamide polymers is especially preferred for the purpose of stabilization of the color images formed.

The photographic material to be processed by the method of the present invention may contain, as a color-fogging inhibitor, hydroquinone derivatives, aminophenol derivatives, gallic acid derivatives or ascorbic acid derivatives.

The photographic material may also contain various anti-fading agents. As specific examples of organic anti-fading agents for cyan, magenta and/or yellow images, which can be employed in the present invention, there are mentioned hindered phenols such as hydroquinones, 6-hydroxychromans, 5-hydroxycoumarans, spirochromans, p-alkoxyphenols and bisphenols; gallic acid derivatives; methylenedioxybenzenes; aminophenols; hindered amines; as well as ether or ester derivatives thereof prepared by silylating or alkylating the phenolic hydroxyl group in the said compounds. In addition, metal complexes such as (bissalicylaldoximato)nickel complexes and (bis-N,N-dialkyldithiocarbamato)nickel complexes may also be employed.

Specific examples of the organic anti-fading agents which can be employed in the present invention are described in various patent publications. For instance, spiroindans are described in U.S. Pat. No. 4,360,589; hindered amines are in U.S. Pat. Nos. 3,336,135, 4,268,593, British Patents 1,32 ,889, 1,354,313, 1,410,846, JP-B-51-1420, JP A-58-114036, JP-A-59-53846 and JP-A-59-78344.

In accordance with the present invention, the following compounds are preferably employed together with the above-mentioned couplers. In particular, such compounds are especially preferably employed in combination with pyrazoloazole couplers.

Specifically, compounds (F) which may chemically bond with the aromatic amine developing agent which remains after color development to give a chemically inactive and substantially colorless compound and/or compounds (G) which may chemically bond with the oxidation product of the aromatic amine developing agent which remains after color development to give a chemically inactive and substantially colorless compound are preferably employed simultaneously or singly. Employment of such compounds is preferred, for example, for preventing stains to be caused by formation of colored dyes by reaction between the developing agent or the oxidation product thereof which remains in the film and the coupler also remaining therein during storage of the material as processed and also for preventing other harmful side-effects.

As the compounds (F), preferred are compounds which react with p-anisidine with a secondary reaction speed constant k2 (in trioctyl phosphate at 80° C.) of from 0.1 liter/mol·sec to $1\times10^{-5}$ liter/mol·sec.

If the value k2 is larger than the said range, the compounds themselves would be unstable and would often react with gelatin and water to decompose. On the other hand, if it is smaller than the said range, the reaction speed of the said compound with the remaining aromatic amine developing agent would be low and, as a result, the object of the present invention to prevent the harmful side effects of the remaining aromatic amine developing agent could not be attained.

More preferred examples of such compounds (F) are those represented by the following formula (FI) or (FII).

$$R_{101}-(A_{101})_{n101}-X_{101} \quad (FI)$$

$$R_{102}-\underset{\underset{B_{101}}{|}}{C}=Y_{101} \quad (FII)$$

In these formulae, $R_{101}$ and $R_{102}$ each represent an aliphatic group, an aromatic group or a heterocyclic group; $n_{101}$ represents 1 or 0; $B_{101}$ represents a hydrogen atom, an aliphatic group, an aromatic group, a heterocyclic group, an acyl group or a sulfonyl group; $Y_{101}$ represents a group which accelerates the addition of an aromatic amine developing agent to the compound of the formula (FII). $R_{101}$ and $X_{101}$; and $Y_{101}$ and $R_{102}$ or $B_{101}$ may be bonded to each other to form a cyclic structure.

Typical methods of reacting the compounds and the remaining aromatic amine developing agent by chemical bond are substitution reaction and addition reaction.

Specific examples of the compounds of the formulae (FI) and (FII) are described in JP-A-64-2042, JP-A-64-55558, JP-A-64-57259, JP-A-1-198751, JP-A-1-120554 and EP-A-277589.

The details of the combination of the above-mentioned compound (G) and compound (F) are described in JP-A-64-86139.

The photographic material to be processed by the method of the present invention can contain an ultraviolet absorbent in the hydrophilic colloid layer. For instance, aryl group-substituted benzotriazole compounds (for example, those described in U.S. Pat. No. 3,533,794), 4-thiazolidone compounds (for example, those described in U.S. Pat. Nos. 3,314,794, 3,352,681), benzophenone compounds (for example, those described in JP-A-46-2784), cinnamic acid ester compounds (for example, those described in U.S. Pat. Nos. 3,705,805, 3,707,375), butadiene compounds (for example, those described in U.S. Pat. No. 4,045,229) or benzoxidol compounds (for example, those described in U.S. Pat. No. 3,700,455) can be used as the ultraviolet absorbent. Ultraviolet-absorbing couplers (for example, alpha-naphthol cyan dye-forming couplers) as well as ultraviolet-absorbing polymers may also be employed for the same purpose. The ultraviolet absorbents may be mordanted in a particular layer in the photographic material.

As the binder or protective colloid which can be employed in the light-sensitive layer for constituting the photographic material of the present invention, gelatin is advantageously used. In addition, any other hydrophilic colloids may also be employed singly or in combination with gelatin.

The gelatin to be used in the present invention may be either lime-processed or acid-processed. The details of the method of preparing gelatins are described in *The Molecular Chemistry of Gelatin* (published by Academic Press, 1964).

The color photographic material to be processed by the method of the present invention has an yellow coupler-containing light-sensitive layer (YL), a magenta coupler-containing light-sensitive layer (ML), a cyan coupler-containing light sensitive layer (CL), a protective layer (PL), an interlayer (IL) and optionally a color layer which may be decolored during development, especially an antihalation layer (AH), on the support. YL, ML and CL each has a different color-sensitivity, which corresponds to each of at least three lights each having a different principal wavelength. The principal sensitivity wavelength of each of YL, ML and CL is apart from each other by 30 nm or more, preferably from 50 nm to 100 nm. Accordingly, the main sensitivity wavelength of one light-sensitive layer is different from that of the other light-sensitive layer by at least 0.8 logE (quantity of light), preferably 1.0 logE. At least one of the light-sensitive layers has a sensitivity in the longer wavelength range than 670 nm. More preferably, at least one more layer has a sensitivity in the longer wavelength range than 750 nm.

For instance, some typical examples of the layer constitution of the light-sensitive layers to constitute the photographic materials to be processed by the present invention are mentioned in the following Table (A).

TABLE (A)

| | (1) | (2) | (3) | (4) | (5) |
|---|---|---|---|---|---|
| Protective Layer | PL | PL | PL | PL | PL |
| Light-sensitive Layer Units | YL = R<br>ML = 1R-1<br>CL = 1R-2<br>(AH) | YL = 1R-2<br>ML = 1R-1<br>CL = R<br>(AH) | YL = R<br>CL = 1R-1<br>ML = 1R-2<br>(AH) | ML = R<br>YL = 1R-1<br>CL = 1R-2<br>(AH) | CL = R<br>YL = 1R-1<br>ML = 1R-2<br>(AH) |
| Support | | | | | |

| | (6) | (7) | (8) | (9) |
|---|---|---|---|---|
| Protective Layer | PL | PL | PL | PL |
| Light-sensitive Layer Units | CL = R<br>ML = 1R-1<br>YL = 1R-2<br>(AH) | CL = 1R-2<br>ML = 1R-1<br>YL = R<br>(AH) | ML = 1R-2<br>CL = 1R-1<br>YL = R<br>(AH) | ML = R<br>CL = 1R-1<br>YL = 1R-2<br>(AH) |
| Support | | | | |

As the support for the photographic materials of the present invention, in general, transparent films such as cellulose nitrate film or polyethylene terephthalate film or reflective supports which are employed in parepar-ing ordinary photographic materials can be employed. Reflective supports are more preferred for the object of the present invention.

The reflective support which can be employed in the present invention means one which may improve the reflectivity so that the color image as formed on the silver halide emulsion layer is made sharp. Such reflective support includes a support prepared by coating a hydrophobic resin which contains a dispersion of a light-reflecting substance such as titanium oxide, zinc oxide, calcium carbonate or calcium sulfate or a support made of a hydrophobic resin which contains a dispersion of the said light-reflecting substance. For instance, there are mentioned a baryta paper, a polyethylene-coated paper, a synthetic polypropylene paper, as well as a transparent support (e.g., glass sheet, polyester films such as polyethylene terephthalate, cellulose triacetate or cellulose nitrate, or polyamide films, polycarbonate films, polystyrene films or vinyl chloride resin films) coated with a reflective layer to contain a reflecting substance. The supports may properly be selected in accordance with the object.

As the above-mentioned light-reflecting substance, it is preferred that a white pigment is fully kneaded in the presence of a surfactant, or pigment grains as surface-treated with a di- to tetra-hydric alcohol are also preferably employed.

Where fine grains of a white pigment are incorporated into the support, the exclusive area ration (%) of the grains per the unit area is obtained most typically by dividing the observed area into the adjacent unit area of 6 μm×6 μm and measuring the exclusive area ratio (%) (Ri) of the fine grains as projected to the unit area. The fluctuation coefficient of the exclusive area ratio (%) can be obtained as the ratio $s/\overline{R}$ of being the standard deviation (s) of Ri to the mean value (R) of Ri. The number (n) of the unit areas for the measurement is preferably 6 or more. Accordingly, the fluctuation coefficient $s/\overline{R}$ can be obtained from the following formula:

$$\sqrt{\frac{\sum_{n=1}^{n}(Ri-\overline{R})^2}{n-1}} \Big/ \frac{\sum_{i=1}^{n} Ri}{n}$$

In accordance with the present invention, the exclusive area ratio of the fine pigment grains is preferably 0.15 or less, especailly 0.12 or less.

As the light-reflecting substance, thin metal layers, for example, the mirror-reflective or secondary diffusion reflective surface-having metals as described in JP-A-63-118154, JP-A-63-24247, JP-A-63-24251, JP-A-63-24252, JP-A-63-24253, JP-A-63-24255, can also be employed.

The support for use in the present invention is preferably light, thin and tough, since the photographic material of the present invention is, after being image-formed used as a, hard copy. In addition, it is preferably low-priced. As the support for the present invention, therefore, a polyethylene-coated paper or a synthetic paper having a thickness of from 10 to 250 microns, preferably from 30 to 180 microns, is desired.

In accordance with the image-forming method of the present invention, color images may rapidly be formed by high-speed process, and the color images formed are free from unfavorable results of residual colors or high density streaks induced by pressure.

Accordingly, by the method of the present invention, good full-color images can be formed by scanning exposure system.

The following examples are intended to illustrate the present invention in more detail but not to restrict it in any way.

EXAMPLE 1

32 g of a lime-processed gelatin was added to 100 ml of distilled water and dissolved at 40° C., and 3.3 g of sodium chloride was added thereto and the temperature of the resulting mixture was elevated up to 52° C. 3.2 ml of N,N'-dimethylimidazolidin-2-thione (1% aqueous solution) was added to the solution. Next, a solution of 32.0 g of silver nitrate dissolved in 200 ml of distilled water and a solution of 11.0 g of sodium chloride dissolved in 200 ml. of distilled water were added to the above-mentioned solution over a period of 14 minutes whereupon the temperature of the reaction system was kept at 52° C. Further, a solution of 128.0 g of silver nitrate as dissolved in 560 ml of distilled water and a solution 0f 44.0 g of sodium chloride and 0.4 mg of potassium hexachloroiridate (IV) dissolved in 560 ml of distilled water were added thereto over a period of 20 minutes, also with the temperature kept at 52° C. After the resulting mixture was allowed to stand at 52° C. for 15 minutes, the temperature was lowered to 40° C. and the resulting mixture was subjected to desalting and then washed with water. Further, a lime-processed gelatin was added thereto to obtain an emulsion which was called Emulsion (A). The emulsion thus obtained contained cubic silver chloride grains having a mean grain size of 0.45 micron and a fluctuation coefficient of grain size distribution of 0.08.

In the same manner as in preparation of Emulsion (A), except that the aqueous sodium chloride solution to be added along with the aqueous silver nitrate solution was replaced by a mixed solution comprising sodium chloride and potassium bromide (where the total molar number was the same but the molar ration, of sodium chloride to potassium bromide was 98/2), a silver chlorobromide emulsion having a silver bromide content of 2 mol% was obtained. The emulsion was called Emulsion (B). The time for adding the reaction solutions was properly adjusted so that the silver halide grains in Emulsion (B) could have the same mean grain size as that of the grains in Emulsion (A). The grains in Emulsion (B) thus prepared were cubic and the fluctuation coefficient of the grain size distribution of the grains was 0.08.

Also in the same manner as in preparation of Emulsion (A), except that the aqueous sodium chloride solution to be added along with the aqueous silver nitrate solution was replaced by a mixed solution comprising sodium chloride and potassium bromide (where the total molar number was the same but the molar ratio of sodium chloride to potassium bromide was 9/1), a silver chlorobromide emulsion having a silver bromide content of 10 mol% was obtained. The emulsion was called Emulsion (C). The time for adding the reaction solutions was properly adjusted so that the silver halide grains in Emulsion (C) could have the same mean grain size as that of the grains in Emulsion (A). The grains in Emulsion (C) thus prepared were cubic and the fluctuation coefficient of the grain size distribution of the grains was 0.09.

Each of the three emulsions obtained was adjusted with respect to the pH and pAg values, and then triethylthiourea was added thereto for optimum chemical sensitization. Accordingly, Emulsions (A-1), (B 1) and (C-1) were obtained.

Additionally, a fine silver bromide grains-containing emulsion Emulsion D having a mean grain size of 0.05 micron was prepared.

Emulsion D was added to Emulsion (A) in an amount of 2 mol% as the silver halide and then triethylthiourea was added for optimum chemical sensitization, and accordingly, Emulsion (A-2) was obtained.

To each of these four silver halide emulsions was added the following compound as a stabilizer in an amount of $5.0\times10^{-4}$ mol per mol of silver halide.

Stabilizer (I-1):

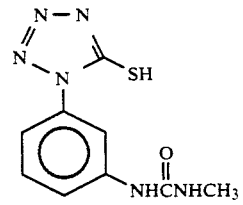

Each of these four silver halide emulsions was subjected to X-ray diffraction to analyze the halogen composition and the distribution thereof.

As a result, Emulsion (A-1) showed a single diffraction peak of 100% silver chloride; Emulsion (B-1) showed that of 98% silver chloride (2% silver bromide); Emulsion (C-1) showed that of 90% silver chloride (10% silver bromide). As opposed to them, Emulsion (A-2) showed a principal peak of 100% silver chloride and additionally a broad side peak having a center of 70% silver chloride (30% silver bromide) with a foot to 60% silver chloride (40% silver bromide).

Next, emulsified dispersions of color couplers were prepared and combined with the respective silver halide emulsions. The thus prepared coating compositions were coated on a polyethylene-laminated paper support. Accordingly, a multi-layered color photographic material having the layer constitution mentioned below was prepared.

Layer Constitution:

The compositions of the respective layers are mentioned below. The figures indicate the amounts coated ($g/m^2$, but $ml/m^2$ only for solvents). The amount of the silver halide coated was represented by the silver content therein.

| | |
|---|---|
| Support: | |
| Polyethylene-laminate Paper | |
| (This contained white pigment ($TiO_2$) and blueish dye (ultramarine) in the polyethylene under emulsion layers.) | |
| First Layer (Yellow-Coloring Layer): | |
| Silver Halide Emulsion (A-1) | 0.30 |
| Color-sensitizing Dye (S-1) | |
| Yellow Coupler (Y-1) | 0.82 |
| Color Image Stabilizer (Cpd-7) | 0.09 |
| Solvent (Solv-6) | 0.28 |
| Gelatin | 1.75 |

-continued

| | |
|---|---|
| Second Layer (Color Mixing Prevention Layer): | |
| Gelatin | 1.25 |
| Dye (Dye-3) | 0.01 |
| Color Mixing Preventing Agent (Cpd-4) | 0.11 |
| Solvent (Solv-2) | 0.24 |
| Solvent (Solv-5) | 0.26 |
| Third Layer (Magenta-coloring Layer): | |
| Silver Halide Emulsion (Table 2) | 0.12 |
| Color-Sensitizing Dye (I-15) | |
| Super-Color Sensitizing Dye (IV-1) | 0.0015 |
| Magenta Coupler (M-1) | 0.13 |
| Magenta Coupler (M-2) | 0.09 |
| Color Image Stabilizer | |
| (Cpd-1) | 0.15 |
| (Cpd-8) | 0.02 |
| (Cpd-9) | 0.03 |
| Solvent | |
| (Solv-1) | 0.34 |
| (Solv-2) | 0.17 |
| Gelatin | 1.25 |
| Fourth Layer (Ultraviolet Absorbent Layer): | |
| Gelatin | 1.58 |
| Dye (Table 2) | |
| Ultraviolet Absorbent (UV-1) | 0.47 |
| Color Mixing Preventing Agent (Cpd-4) | 0.05 |
| Solvent (Solv-3) | 0.26 |
| Fifth Layer (Cyan-Coloring Layer): | |
| Silver Halide Emulsion (Table 2) | 0.23 |
| Color-Sensitizing Dye (I-18) | |
| Super-Color Sensitizing Dye (IV-1) | 0.003 |
| Cyan Coupler (C-1) | 0.32 |
| Color Image Stabilizer | |
| (Cpd-5) | 0.17 |
| (Cpd-6) | 0.04 |
| (Cpd-7) | 0.40 |
| solvent (Solv-4) | 0.15 |
| Gelatin | 0.34 |
| Seventh Layer (Ultraviolet Absorbing Layer): | |
| Gelatin | 0.53 |
| Dye (Table 2) | |
| Ultraviolet Absorbent (UV-1) | 0.16 |
| Color Mixing Preventing Agent (Cpd-4) | 0.02 |
| Solvent (Solv-3) | 0.09 |
| Seventh Layer (Protective Layer): | |
| Gelatin | 1.33 |

-continued

| | |
|---|---|
| Acryl-modified Copolymer of Polyvinyl Alcohol (modification degree 17%) | 0.17 |
| Liquid Paraffin | 0.03 |

As the gelatin-hardening agent for each layer, there was employed 1-hydroxy-3,5-dichloro-s-triazine sodium salt in an amount of 14.0 mg per gram of gelatin.

The substances used above were as follows:

S-1: Mixture of the following two compounds,

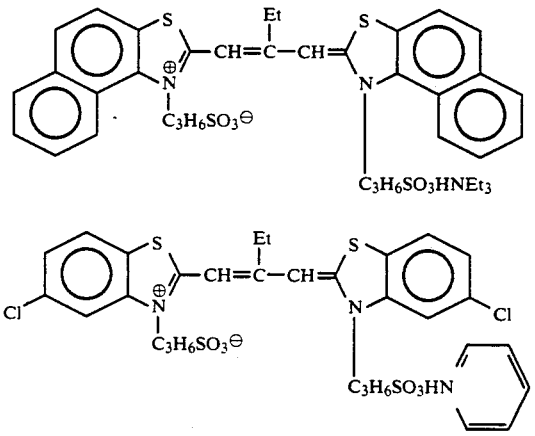

Amounts Added: $3.2\times10^{-5}$ mol (the former) and $2.7\times10^{-5}$ mole (the latter), each per mol of the silver halide.

I-15:

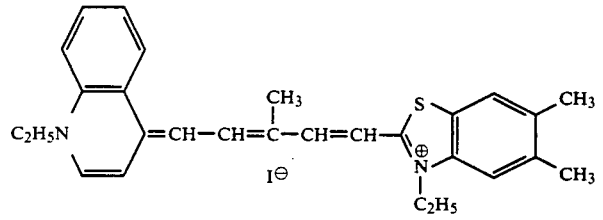

Amount Added: $2\times10^{-5}$ mol per mol of the silver halide.

I-18:

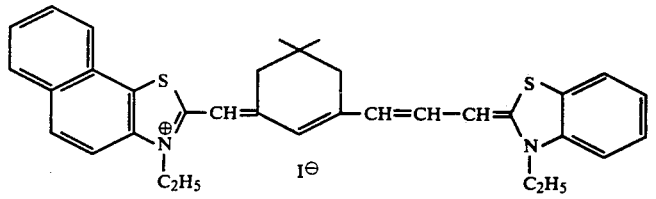

Amount Added: $2\times10^{-5}$ mol per mol of the silver halide.

Dye 1:

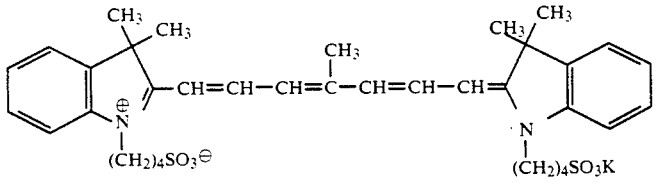
Dye 2: 2/4/4 (by weight) mixture of R=$C_2H_5$, R=$C_4H_9$ and
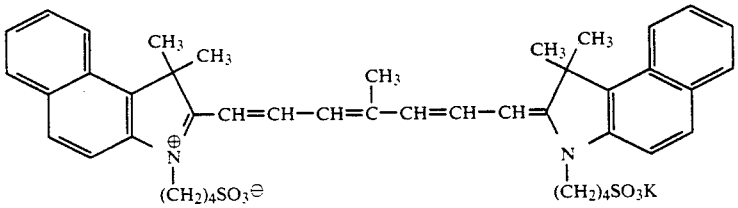
Dye 3: R=
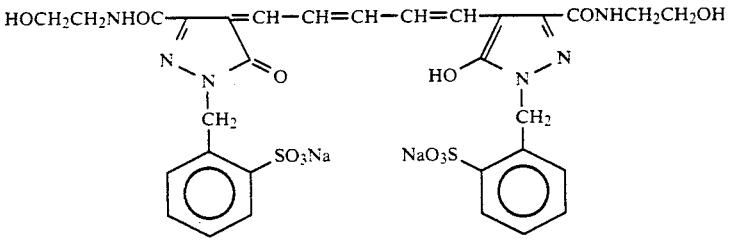
Yellow coupler (Y-1):
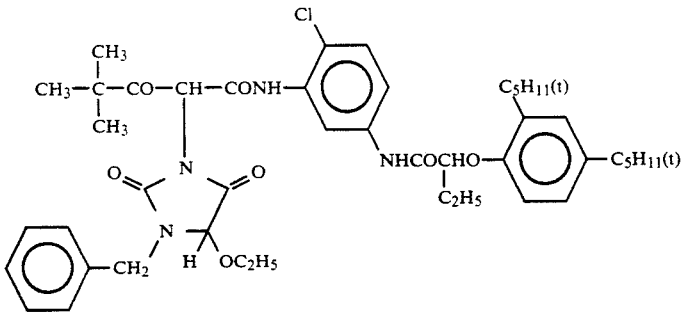
Cyan Coupler (C-1):
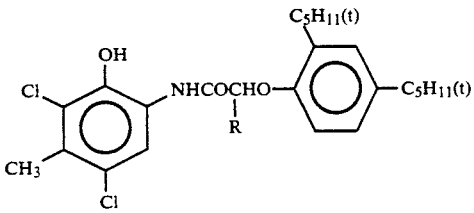
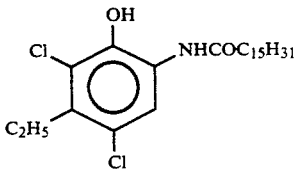
Magenta Coupler (M-1):

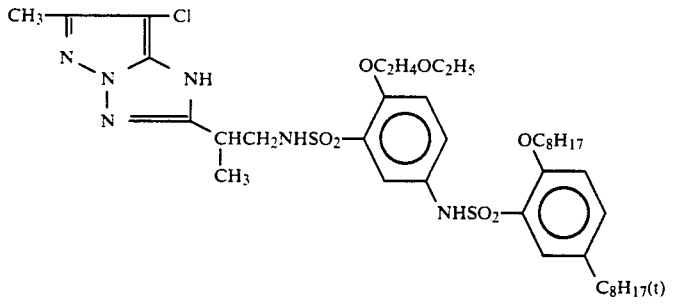
Magenta Coupler (M-2):
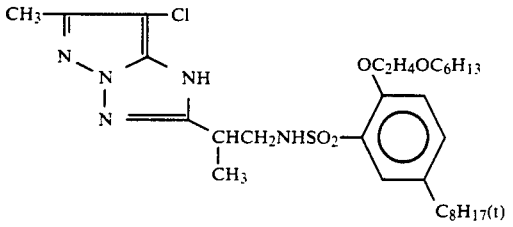
Colored Image Stabilizer (Cpd-1):
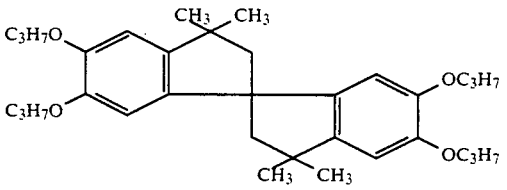
Colored Image Stabilizer (Cpd-2):
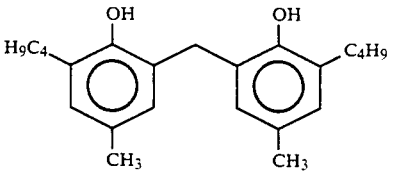
Colored Image Stabilizer (Cpd-3):
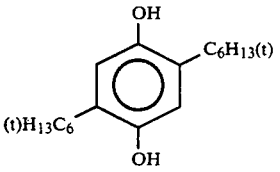
Color Mixing Preventing Agent (Cpd-4):
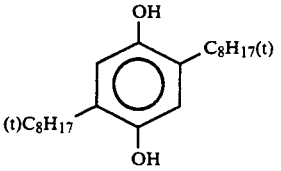
Colored Image Stabilizer (Cpd-5):
2/4/4 (by weight) mixture of the following compounds.
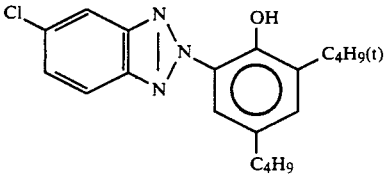
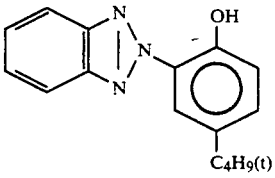
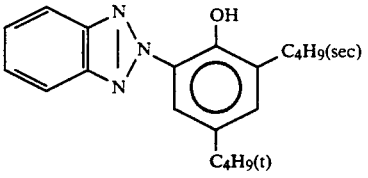
Colored Image Stabilizer (Cpd-6):
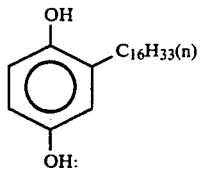
Colored Image stabilizer (Cpd-7):
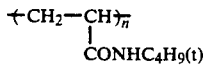
Colored Image stabilizer (Cpd-8):

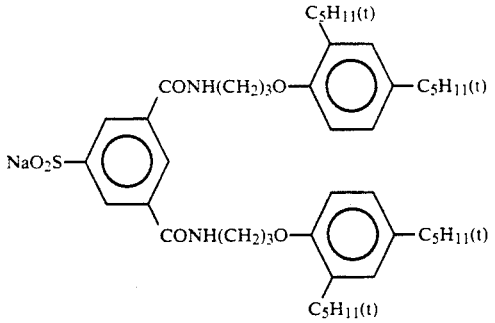

Colored Image Stabilizer (Cpd-9):

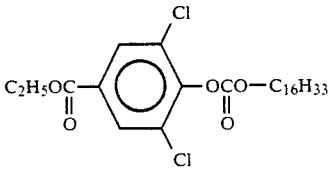

Solvent (Solv-1):

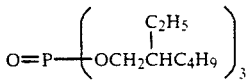

Solvent (Solv-2):

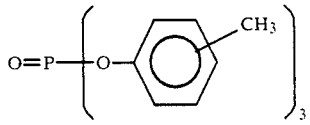

Solvent (Solv-3):

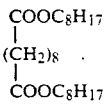

Solvent (Solv-4):

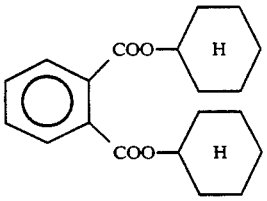

Solvent (Solv-5):

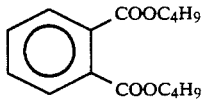

Solvent (Solv-6):

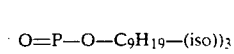

Ultraviolet Absorber (UV-1):
4/1/4 (by mol) mixture of the following A/B/C.

A:

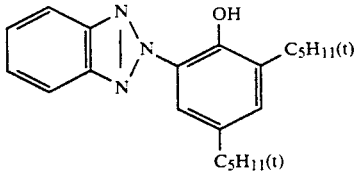

B:

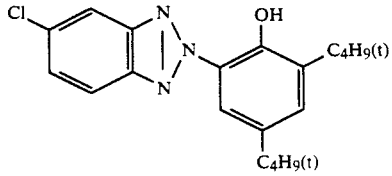

C:

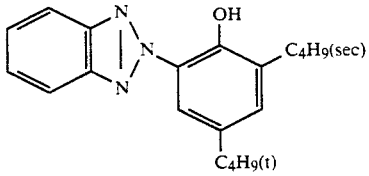

The samples shown in Table 2 below were exposed by exposing apparatus mentioned below and then processed in accordance with the steps mentioned below by an automatic color paper-developing machine to form an image on each sample. After processing, the residual color, if any, on the white background portion to be derived from the sensitizing dyes and other dyes in the sample as well as the high density streaks induced by pressure, if any, on the sample were checked for every case.

The results obtained are shown in Table 2.

As is obvious therefrom, a full-color image which is free from residual color and the high density streaks can be obtained by the method of the present invention even when the photographic material is processed by high-speed processing.

Exposing Apparatus:

The lasers employed were a semiconductor laser AlGaInP (oscillation wavelength, about 670 nm), a semiconductor laser GaAlAs (oscillation wavelength, about 780 nm) and GaAlAs (oscillation wavelength, about 830 nm). The laser rays were so constructed to give a scanning exposure in order to the color photographic paper which was moving in a direction vertical to the scanning direction, by the use of a rotary polyhedron mirror. The amount of exposure was adjusted by electrically controlling the exposing time of the respective semiconductive lasers.

Processing Steps:

| Step | Temperature (°C.) | Time (sec) |
|---|---|---|
| Color Development | 38 | 45 |
| Bleach-fixation | 30 to 36 | 45 |

-continued

| Step | Temperature (°C.) | Time (sec) |
|---|---|---|
| Rinsing (1) | 30 to 37 | 20 |
| Rinsing (2) | 30 to 37 | 20 |
| Rinsing (3) | 30 to 37 | 20 |
| Drying | 70 to 85 | 60 |

The processing solutions employed in the above-mentioned steps had the following compositions.

Color Developer:

| | |
|---|---|
| Water | 800 ml |
| Ethylenediamine-N,N,N',N'-tetramethylenephosphonic Acid | 5.0 g |
| 5,6-Dihydroxybenzene-2,4-disulfonic Acid | 0.5 g |
| Triethanolamine | 8 g |
| Sodium Chloride | Table 1 |
| Potassium Chloride | Table 1 |
| Potassium Bromide | 25 g |
| N-ethyl-N-(β-methanesulfonamidoethyl)-3-methyl-4-aminoaniline Sulfate | 5.0 g |
| N,N-diethylhydroxyamine | 0.03 mol |
| Sodium Sulfite | 0.02 g |
| Brightening Agent (WHITEX-4, product of Sumitomo Chemical, diaminostylbene compound) | 1.0 g |
| Water to make | 1000 ml |
| pH (25° C.) | 10.05 |

Bleach-fixing Solution:

| | |
|---|---|
| Water | 400 ml |
| Ammonium Thiosulfate (70%) | 100 ml |
| Ammonium Sulfite | 17 g |
| Ferric (III) Ammonium Ethylenediamine-tetraacetate | 55 g |
| Disodium Ethylenediamine-tetraacetate | 5 g |
| Glacial Acetic Acid | 9 g |
| Ammonium Bromide | 30 g |
| Water to make | 1000 ml |
| pH (25° C.) | 5.40 |

Rinsing Solution:

The rinsing solution used was an ion-exchanged water having a calcium ion concentration of 3 ppm or less and a magnesium ion concentration of 3 ppm or less.

TABLE 1

| Color Developer | $Cl^-$ Concentration (mol/liter) | $Br^-$ Concentration (mol/liter) |
|---|---|---|
| 1 | $3.5 \times 10^{-2}$ | $3.0 \times 10^{-5}$ |
| 2 | $4.0 \times 10^{-2}$ | $5.0 \times 10^{-5}$ |
| 3 | $1.0 \times 10^{-1}$ | $5.0 \times 10^{-4}$ |
| 4 | $1.5 \times 10^{-1}$ | $1.0 \times 10^{-3}$ |
| 5 | 0 | $5.0 \times 10^{-4}$ |
| 6 | $1.0 \times 10^{-1}$ | 0 |
| 7 | $3.0 \times 10^{-1}$ | $5.0 \times 10^{-3}$ |

EVALUATION (1) Residual Color:

The mark (+) indicates that the sample had residual color in the white background portion; and (−) indicates that the sample did not.

(2) Density Streaks induced by Pressure:

The mark "O" indicates that the sample had no streaks in the area of 10 cm×10 cm; "X" indicates that the sample had from 3 to 5 streaks in the same area; and "XX" indicates that the sample had more than five streaks in the same area.

TABLE 2

| Sample No. | Emulsion of 3rd Layer | Dye of 4th Layer (a) | Emulsion of 5th Layer | Dye of 6th Layer (b) |
|---|---|---|---|---|
| 1 | A-1 | Dye-1 | A-1 | Dye-2 |
| 2 | " | A-11 | " | A-24 |
| 3 | " | " | " | A-28 |
| 4 | " | " | " | A-29 |
| 5 | " | " | " | A-30 |
| 6 | B-1 | Dye-1 | B-1 | Dye-2 |
| 7 | " | A-11 | " | A-24 |
| 8 | " | " | " | A-28 |
| 9 | " | " | " | A-29 |
| 10 | " | " | " | A-30 |
| 11 | C-1 | Dye-1 | C-1 | Dye-2 |
| 12 | " | A-11 | " | A-24 |
| 13 | " | " | " | A-28 |
| 14 | " | " | " | A-29 |
| 15 | " | " | " | A-30 |
| 16 | A-2 | Dye-1 | A-2 | Dye-2 |
| 17 | " | A-11 | " | A-24 |
| 18 | " | " | " | A-28 |
| 19 | " | " | " | A-29 |
| 20 | " | " | " | A-30 |

| | Developers (1) to (7), and Photographic Properties (Residual Color and Stress Mark Streaks) | | | | | | | | | | | | | |
|---|---|---|---|---|---|---|---|---|---|---|---|---|---|---|
| | (1) | | (2) | | (3) | | (4) | | (5) | | (6) | | (7) | |
| Sample No. | Residual Color | Streaks | Residual Color | Streaks | Residual Color | Streaks | Residual Color | Streaks | Residual Color | Streaks | Residual Color | Streaks | Residual Color | Streaks |
| 1 | + | ○ | + | ○ | + | ○ | + | ○ | + | ×× | + | ×× | | |
| 2 | − | ○ | − | ○ | − | ○ | − | ○ | − | ×× | − | ×× | | |
| 3 | − | ○ | − | ○ | − | ○ | − | ○ | − | ×× | − | ×× | | |
| 4 | − | ○ | − | ○ | − | ○ | − | ○ | − | ×× | − | ×× | | |
| 5 | − | ○ | − | ○ | − | ○ | − | ○ | − | ×× | − | ×× | | |
| 6 | + | ○ | + | ○ | + | ○ | + | ○ | + | ×× | + | ×× | | |
| 7 | − | ○ | − | ○ | − | ○ | − | ○ | − | ×× | − | ×× | (As the image | |
| 8 | − | ○ | − | ○ | − | ○ | − | ○ | − | ×× | − | ×× | density was | |
| 9 | − | ○ | − | ○ | − | ○ | − | ○ | − | ×× | − | ×× | low, the | |
| 10 | − | ○ | − | ○ | − | ○ | − | ○ | − | ×× | − | ×× | photographic | |

TABLE 2-continued

| | | | | | | | | | | | | | |
|---|---|---|---|---|---|---|---|---|---|---|---|---|---|
| 11 | + | ○ | + | ○ | + | ○ | + | ○ | + | × | + | × | properties |
| 12 | + | ○ | + | ○ | + | ○ | + | ○ | + | × | + | × | were |
| 13 | + | ○ | + | ○ | + | ○ | + | ○ | + | × | + | × | impractical.) |
| 14 | + | ○ | + | ○ | + | ○ | + | ○ | + | × | + | × | |
| 15 | + | ○ | + | ○ | + | ○ | + | ○ | + | × | + | × | |
| 16 | + | ○ | + | ○ | + | ○ | + | ○ | + | ×× | + | ×× | |
| 17 | − | ○ | − | ○ | − | ○ | − | ○ | − | ×× | − | ×× | |
| 18 | − | ○ | − | ○ | − | ○ | − | ○ | − | ×× | − | ×× | |
| 19 | − | ○ | − | ○ | − | ○ | − | ○ | − | ×× | − | ×× | |
| 20 | − | ○ | − | ○ | − | ○ | − | ○ | − | ×× | − | ×× | |
| | | | | | | | | | | ×× | − | ×× | |

The framed ranges indicate the present invention, and the outsides are comparative examples.

(a) The amount added was 0.003 mol per mol of silver halide.

(b) The amount added was 0.005 mol per mol of silver halide.

As is obvious from the results in Table 2 above, the image-forming method of the present invention gave color images with neither residual color nor high density streaks, even when the processing time from the development to drying was a short period of 210 seconds.

EXAMPLE 2

Samples as indicated in Table 3 below were prepared in the same manner as in Example 1, except that the sensitizing dye in the fifth layer was (I-19) and that the dyes in the fourth layer and the sixth layer were those indicated in Table 3. The samples were exposed by the exposing apparatus mentioned below and then processed in the same manner as in Example 1 to obtain images in the samples. After processing, the residual color, if any, on the white background portion to be derived from the sensitizing dyes and other dyes in the sample as well as the high density streaks, if any, on the sample were checked for every case. The results obtained are shown in Table 3 below.

As is obvious therefrom, a high-quality full-color image with neither residual color nor high density streaks can be obtained by the method of the present invention.

Exposing Apparatus:

The lasers employed were a semiconductor laser AlGaInP (oscillation wavelength, about 670 nm), a semiconductor laser GaAlAs (oscillation wavelength, about 780 nm) and a semiconductor laser GaAlAs (oscillation wavelength, 880 nm). The laser rays so constructed that it may give a scanning exposure in order to the color photographic paper which was moving in a direction vertical to the scanning direction, by the use of a rotary polyhedron mirror. The amount of exposure was adjusted by electrically controlling the exposing time of the respective semiconductor lasers.

TABLE 3

| Sample No. | Emulsion of 3rd Layer | Dye of 4th Layer (a) | Emulsion of 5th Layer | Dye of 6th Layer (b) |
|---|---|---|---|---|
| 21 | A-1 | Dye-1 | A-1 | Dye-4 |
| 22 | " | A-31 | " | A-28 |
| 23 | " | " | " | A-30 |
| 24 | B-1 | Dye-1 | B-1 | Dye-4 |
| 25 | " | A-31 | " | A-28 |
| 26 | " | " | " | A-30 |
| 27 | C-1 | Dye-1 | C-1 | Dye-4 |
| 28 | " | A-31 | " | A-28 |
| 29 | " | " | " | A-30 |
| 30 | A-2 | Dye-1 | A-2 | Dye-4 |
| 31 | " | A-31 | " | A-28 |
| 32 | " | " | " | A-30 |

| | Developers (1) to (7), and Photographic Properties (Residual Color and Stress Mark Streaks) | | | | | | | | | | | | | |
|---|---|---|---|---|---|---|---|---|---|---|---|---|---|---|
| | (1) | | (2) | | (3) | | (4) | | (5) | | (6) | | (7) | |
| Sample No. | Residual Color | Streaks | Residual Color | Streaks | Residual Color | Streaks | Residual Color | Streaks | Residual Color | Streaks | Residual Color | Streaks | Residual Color | Streaks |
| 21 | + | ○ | + | ○ | + | ○ | + | ○ | + | ×× | + | ×× | | |
| 22 | − | ○ | − | ○ | − | ○ | − | ○ | ○ | ×× | ○ | ×× | | |
| 23 | − | ○ | − | ○ | − | ○ | − | ○ | ○ | ×× | ○ | ×× | (As the image | |
| 24 | + | | + | | + | | + | | + | ×× | + | ×× | density was | |
| 25 | − | ○ | − | ○ | − | ○ | − | ○ | ○ | ×× | ○ | ×× | low, the | |
| 26 | − | ○ | − | ○ | − | ○ | − | ○ | ○ | ×× | ○ | ×× | photographic | |
| 27 | + | ○ | + | ○ | + | ○ | + | ○ | + | × | + | × | properties | |
| 28 | + | ○ | + | ○ | + | ○ | + | ○ | + | × | + | × | were | |
| 29 | + | ○ | + | ○ | + | ○ | + | ○ | + | × | + | × | impractical.) | |
| 30 | + | ○ | + | ○ | + | ○ | + | ○ | + | ×× | + | ×× | | |
| 31 | − | ○ | − | ○ | − | ○ | − | ○ | ○ | ×× | ○ | ×× | | |
| 32 | − | ○ | − | ○ | − | ○ | − | ○ | ○ | ×× | ○ | ×× | | |

The framed ranges indicate the present invention, and the outsides are comparative examples.

(a) The amount added was 0.003 mol per mol of silver halide.

(b) The amount added was 0.005 mol per mol of silver halide.

The substances used above were as follows:

(I-19):

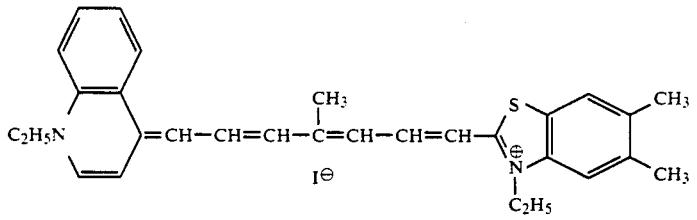

Amount Added: $2.0\times10^{-5}$ mol per mol of silver halide.

Dye 4:

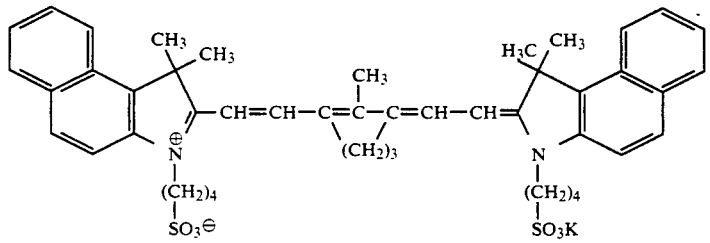

As is obvious from the results in Table 3 above, the scanning exposure system image-forming method of the present invention gave color images with neither residual color nor high density streaks, even when the processing time from the development to drying was a short period of 210 seconds.

EXAMPLE 3

The color photographic material samples of Example 1 were subjected to scanning exposure in the same manner as in Example 1 and then processed by the continuous color development process described below.

Samples were imagewise exposed and then continuously processed in accordance with the processing steps mentioned below until the amount of the replenisher added to the color developer tank reached three times of the capacity of the developer tank.

| Processing Step | Temp. | Time | Amount of Replenisher (*) | Tank Capacity |
|---|---|---|---|---|
| Color Development | 38° C. | 45 Sec | 109 ml | 4 litters |
| Bleach-fixation | 30 to 36° C. | 45 sec | 61 ml | 4 litters |
| Rinsing (1) | 30 to 37° C. | 30 sec | — | 2 litters |
| Rinsing (2) | 30 to 37° C. | 30 sec | — | 2 litters |
| Rinsing (3) | 30 to 37° C. | 30 sec | 364 ml | 2 litters |
| Drying | 70 to 85° C. | 60 sec | | |

(*) per $m^2$ of Sample Processed.

The rising was effected by a three-tank countercurrent system from the rinsing tank (3) to the rinsing tank (1). The rinsing solution in the tank (1) was replenished to the bleach-fixing bath in an amount of 122 ml/$m^2$ of the sample being processed.

The processing solutions used in the above steps were as follows:

| | Tank Solution | Replenisher |
|---|---|---|
| Color Developer: | | |
| Water | 800 ml | 800 ml |

-continued

| | Tank Solution | Replenisher |
|---|---|---|
| Ethylenediamine-N,N,N',N'-tetramethylenephosphonic Acid | 3.0 g | 3.0 g |
| Triethanolamine | 8.0 g | 11.0 g |
| Sodium Chloride | $4.2\times10^{-2}$M | — |
| Potassium Bromide | $1.3\times10^{-4}$M | — |
| Potassium Carbonate | 25 g | 25 g |
| N-ethyl-N-(-methanesulfonamidoethyl)-3-methyl-4-aminoaniline Sulfate | 5.0 g | 9.5 g |
| $NH_2N(CH_2COOH)_2$ | $2.7\times10^{-2}$M | $5.4\times10^{-2}$M |
| Brightening Agent (WHITEX-4, manufactured by Sumitomo Chemical Co.) | 1.25 g | 2.5 g |
| Water to make | 1000 ml | 1000 ml |
| pH (25° C.) | 10.05 | 10.60 |
| Bleach-fixing Solution: | | |
| Water | 400 ml | |
| Ammonium Thiosulfate (70 wt. %) | 100 ml | 250 ml |
| Ammonium Sulfite | 38 g | 95 g |
| Ammonium Ethylenediamine-tetraacetate/Iron (III) | 55 g | 138 g |
| Ammonium Bromide | 30 g | 75 g |
| Disodium ethylenediaminetetra-acetate | 5 g | 10 g |
| Glacial Acetic Acid | 9 g | 20 g |
| Water to make | 1000 ml | 1000 ml |
| pH (25° C.) | 5.40 | 5.40 |
| Rinsing Solution: | | |
| Tank solution and replenisher were same. | | |

Ion-exchanged Water (Calcium content and magnesium content each was 3 ppm or less.

In continuous processing, distilled water was added to the color development tank, bleach-fixing tank and rinsing tank each in an amount equal to the amount which was evaporated out from the respective tanks for compensation of the evaporated and concentrated amount.

The chloride ion concentration in the color developer was from $3.5\times10^{-2}$ to $1.5\times10^{-1}$ mol/liter and the bromide ion concentration therein was from $3.0\times10^{-5}$ to $1.0\times10^{-3}$ mol/liter. The same good results as those obtained in Example 1 were also obtained, and the images formed had neither residual color nor high density streaks.

EXAMPLE 4

TABLE 4

| Sample No. | Resolving Power (CFT 50) (line number/mn) | Sensitivity at Surface Exposure | Sensitivity at High Density: Scanning Exposure | Sensitivity at High Density: Streaks | Dye in 6th Layer | Amount of Dye in 6th Layer ($g/m^2$) |
|---|---|---|---|---|---|---|
| Color Developer (3) | | | | | | |
| 33 | 3 | −0.20 | −0.06 | ○ | A-29 | $7 \times 10^{-3}$ |
| 34 | 6 | −0.47 | −0.11 | ○ | A-29 | $1.3 \times 10^{-2}$ |
| 35 | 11 | −0.60 | −0.28 | ○ | A-29 | $2.6 \times 10^{-2}$ |
| 36 | 3 | −0.23 | −0.07 | ○ | A-30 | $7 \times 10^{-3}$ |
| 37 | 7 | −0.50 | −0.13 | ○ | A-30 | $1.3 \times 10^{-2}$ |
| 38 | 11 | −0.62 | −0.30 | ○ | A-30 | $2.6 \times 10^{-2}$ |
| 39 | 4 | −0.25 | −0.08 | ○ | A-41 | $6 \times 10^{-3}$ |
| 40 | 11 | −0.60 | −0.15 | ○ | A-41 | $1.23 \times 10^{-2}$ |
| 41 | 15 | −0.70 | −0.32 | ○ | A-41 | $2.5 \times 10^{-2}$ |
| 42 | 1.5 | 0 | 0 | ○ | none | 0 |
| Color Developer (7) (Comparison) | | | | | | |
| 33 | 3 | −0.20 | −0.07 | X | A-29 | $7 \times 10^{-3}$ |
| 34 | 6 | −0.48 | −0.10 | X | A-29 | $1.3 \times 10^{-2}$ |
| 35 | 11 | −0.61 | −0.27 | X | A-29 | $2.6 \times 10^{-2}$ |
| 36 | 3 | −0.24 | −0.07 | X | A-30 | $7 \times 10^{-3}$ |
| 37 | 7 | −0.50 | −0.13 | X | A-30 | $1.3 \times 10^{-2}$ |
| 38 | 11 | −0.61 | −0.31 | X | A-30 | $2.6 \times 10^{-2}$ |
| 39 | 3 | −0.26 | −0.09 | X | A-41 | $6 \times 10^{-3}$ |
| 40 | 11 | −0.61 | −0.15 | X | A-41 | $1.23 \times 10^{-2}$ |
| 41 | 15 | −0.71 | −0.33 | X | A-41 | $2.5 \times 10^{-2}$ |
| 42 | 1.5 | 0 | 0 | X | none | 0 |

Samples 33 to 42 were prepared in the same manner as in Sample 7 in Example 1, except that the dye in the 6th layer and the amount thereof were those indicated in Table 4. The samples were scanning exposed as in Example 1 or surface exposed through optical wedge for $10^{-4}$ second, and then an image formation was conducted using Color Developer 3 of Example 1.

The image density of the thus obtained images was determined, and the resolveing power and sensitivity was obtained. The sensitivity was represented by a logarithm of an exposure amount giving a density of 2.0, and difference of the obtained value and the value of Sample 42 (no dye is added) was indicated. For comparison, an image formation using Color Developer 7 which is outside the scope of the invention was conducted.

From the results of Table 4, it was found that an image formation using the scanning exposure of the present invention can be compatible with high resolving power and high sensitivity. This is a novel finding which cannot be analogized by a conventional image formation with which a scanning exposure is not conducted.

In a case where an image formation is carried out using a processing solution which is within the scope of the invention, there are no high density streaks induced by pressure and a good image can be obtained despite high sensitivity. In a case where an image formation is carried out using a processing solution which is outside the scope of the invention, however, there are remarkable high density streaks induced by pressure and a good image cannot be obtained, which does not make a good use of high sensitivity by a scanning exposure. In other words, it can be found that an image formation of high sensitivity, high resolving power and free of a resudial color and high density streaks by pressure can be obtained for the first time by the combination of the photographic material which contains the above characteristics, the scanning exposure and the color developer containing the specific concentration of $Cl^-$ and $Br^-$.

While the invention has been described in detail and with reference to specific embodiments thereof, it will be apparent to one skilled in the art that various changes and modifications can be made therein without departing from the spirit and scope thereof.

What is claimed is:

1. A method for forming a color image wherein a full-color photographic material which has at least three silver halide light-sensitive layers each containing yellow-coloring, magenta-coloring or cyan-coloring couplers, at least two of the layers being color-sensitized so that they have a maximum value of color sensitivity at a different wavelength of 670 nm or more and at least one of the layers being made of a high silver chloride emulsion having a layer average silver chloride content of 90 mol% or more, and which has a hydrophilic colloid layer containing at least one dye of the following formula (A), is subjected to scanning exposure by three lights each having a different wavelength and then processed with a color developer containing at least one aromatic primary amine color developing agent and containing chloride ion in an amount of from $3.5 \times 10^{-2}$ to $1.5 \times 10^{-1}$ mol/liter and bromide ion in an amount of from $3.0 \times 10^{-5}$ to $1.0 \times 10^{-3}$ mol/liter,

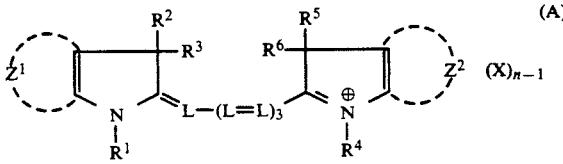

(A)

where $R^1$, $R^2$, $R^3$, $R^4$, $R^5$ and $R^6$ may be same or different and each represents a substituted or unsubstituted alkyl group; $Z^1$ and $Z^2$ each represent a non-metallic atomic group necessary for forming a substituted or unsubstituted benzo-condensed or naphtho-condensed ring; provided that $R^1$, $R^2$, $R^3$, $R^4$, $R^5$, $R^6$, $Z^1$ and $Z^2$ are such that the dye molecule has at least three acid groups; L represents a substituted or unsubstituted methine group; X represents an anion; n represents 1 or 2; provided that when the dye is in the form of an internal salt, n is 1.

2. The method for forming a color image as in claim 1, in which the photographic material contains a super-color sensitizing agent of one of the following formulae (IV), (V), (VI), (VII), (VIIIa), (VIIIb) and (VIIIc):

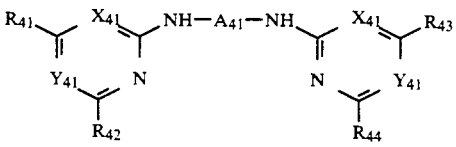

(IV)

where $A_{41}$ represents a divalent aromatic residue; $R_{41}$, $R_{42}$, $R_{43}$ and $R_{44}$ each represent a hydrogen atom, a hydroxyl group, an alkyl group, an alkoxy group, an aryloxy group, a halogen atom, a heterocyclic group, a heterocyclic-thio group, an arylthio group, an amino group, an alkylamino group, an arylamino group, an aralkylamino group, an aryl group or a mercapto group, which may optionally be substituted; provided that at least one of $A_{41}$, $R_{41}$, $R_{42}$, $R_{43}$ and $R_{44}$ has a sulfo group; $X_{41}$ and $Y_{41}$ each represents —CH= or —N=; and at least one of $X_{41}$ and $Y_{41}$ represents —N=;

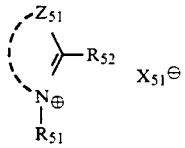

(V)

where $Z_{51}$ represents a non-metallic atomic group necessary for completing a 5-membered or 6-membered nitrogen-containing hetero-ring, which may be condensed with a benzene ring or a naphthalene ring; $R_{51}$ represents a hydrogen atom, an alkyl group or an alkenyl group; $R_{52}$ represents a hydrogen atom or a lower alkyl group; and $X_{51}$ represents an acid anion;

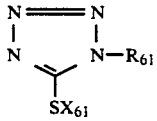

(VI)

where $R_{61}$ represents an alkyl group, an alkenyl group or an aryl group; and $X_{61}$ represents a hydrogen atom, an alkali metal atom, an ammonium group or a percursor thereof;

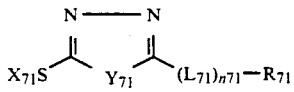

(VI)

where $Y_{71}$ represents an oxygen atom, a sulfur atom, =NH or =N—$(L_{71})n_{72}$—$R_{72}$; $L_{71}$ represents a divalent linking group; $R_{71}$ and $R_{72}$ each represents a hydrogen atom, an alkyl group, an alkenyl group or an aryl group; $n_{72}$ represents 0 or 1; $X_{71}$ has the same meaning as $X_{61}$; and $n_{71}$ represents 0 or 1;

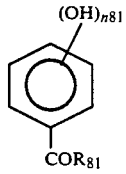

(VIIIa)

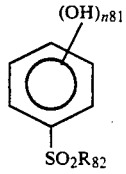

(VIIIb)

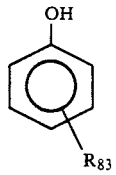

(VIIIc)

where $R_{81}$ and $R_{82}$ each represent OH, $OM_{81}$, $OR_{84}$, $NH_2$, $NHR_{84}$, —$N(R_{84})_2$, —$NHNH_2$ or —$NHNHR_{84}$; $R_{84}$ represents an alkyl group, an aryl group or an aralkyl group; $M_{81}$ represents an alkali metal or an alkaline earth metal; $R_{83}$ represents OH or a halogen atom; and $n_{81}$ and $n_{82}$ each represent 1, 2 or 3.

3. The method for forming a color image as in claim 1, in which the content of the dye of the formula (A) is from $10^{-3}$ g/m$^2$ to 1 g/m$^2$.

4. The method for forming a color image as in claim 1, which L groups in formula (A) may combine to form a group according to formula (B):

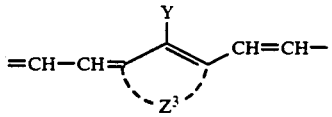

(B)

wherein $Z^3$ represents a non-metal atomic group necessary for forming 5 or 6 membered ring and Y represents a hydrogen atom or a monovalent group.

5. The method for forming a color image as in claim 1, the maximum absorption wavelength range of said dyes represented by formula (A) is from 730 to 850 nm.

6. The method for forming a color image as in claim 1, the maximum absorption wavelength range of said dyes represented by formula (A) is from 770 to 850 nm.

* * * * *